US008857639B2

(12) United States Patent
Meager

(10) Patent No.: US 8,857,639 B2
(45) Date of Patent: Oct. 14, 2014

(54) PRESSURE EQUALIZATION APPARATUS FOR A BOTTLE AND METHODS ASSOCIATED THEREWITH

(75) Inventor: Benjamin Meager, Bozeman, MT (US)

(73) Assignee: Paha Designs, LLC, Denver, CO (US)

( * ) Notice: Subject to any disclaimer, the term of this patent is extended or adjusted under 35 U.S.C. 154(b) by 0 days.

(21) Appl. No.: 13/358,390

(22) Filed: Jan. 25, 2012

(65) Prior Publication Data

US 2012/0193318 A1 Aug. 2, 2012

Related U.S. Application Data

(63) Continuation-in-part of application No. 13/019,941, filed on Feb. 2, 2011, application No. 13/358,390, filed on Jan. 25, 2012, which is a continuation-in-part of application No. 13/101,907, filed on May 5, 2011.

(60) Provisional application No. 61/301,133, filed on Feb. 3, 2010, provisional application No. 61/319,030, filed on Mar. 30, 2010.

(51) Int. Cl.

| | |
|---|---|
| ***B65D 51/16*** | (2006.01) |
| ***B65D 83/36*** | (2006.01) |
| ***B65D 83/70*** | (2006.01) |
| ***B67D 3/00*** | (2006.01) |
| ***B65D 23/04*** | (2006.01) |
| ***B65D 25/40*** | (2006.01) |
| ***B65D 47/32*** | (2006.01) |

(52) U.S. Cl.

CPC ..... *B65D 25/40* (2013.01); *B65D 23/04* (2013.01); *B65D 47/32* (2013.01)

USPC ..... 215/309; 215/307; 215/310; 215/388; 215/389; 222/478; 222/479; 222/464.1

(58) Field of Classification Search

USPC ..... 215/307, 309, 310, 389; 222/478, 479, 222/464.1

See application file for complete search history.

(56) References Cited

U.S. PATENT DOCUMENTS

| | | | |
|---|---|---|---|
| 2,796,205 | A | 6/1957 | Kuzma |
| 2,812,113 | A | 11/1957 | Beall |

(Continued)

FOREIGN PATENT DOCUMENTS

| | | |
|---|---|---|
| DE | 19652216 | 8/1997 |
| DE | 202008010647 | 10/2008 |

(Continued)

OTHER PUBLICATIONS

International Search Report for PCT/US2011/023511 mailed Mar. 25, 2011 3 pages.

(Continued)

*Primary Examiner* — Fenn Mathew
*Assistant Examiner* — Jennifer Castriotta
(74) *Attorney, Agent, or Firm* — Sheridan Ross P.C.

(57) ABSTRACT

A device that assists with equalizing air pressure within a bottle with the atmospheric air pressure as liquid is being poured from the bottle and includes one or more relatively short air tubes. The air tubes are situated with an upper inlet rim of the air tubes located flush with or relatively near the bottle rim. Whether an insert or integrated into the manufacture of a container, the one or more air tubes that extend partially into the container allow air to pass into the container as the liquid exits the container. The pressure equalizer not only minimizes or prevents the common glugging effect, but it allows liquid from a bottle to be poured smoothly at any angle and orientation. A cap incorporating a detachable pressure equalizer is also described.

16 Claims, 44 Drawing Sheets

(56) References Cited

U.S. PATENT DOCUMENTS

| | | | | |
|---|---|---|---|---|
| 2,835,403 | A | | 5/1958 | Scheminger, Jr. |
| 3,168,221 | A | | 2/1965 | Parker |
| 3,506,167 | A | | 4/1970 | Orr |
| 3,655,102 | A | | 4/1972 | Moran |
| 3,834,594 | A | | 9/1974 | Schiemann |
| 3,944,104 | A | | 3/1976 | Watson et al. |
| 3,966,099 | A | | 6/1976 | Sanford, Jr. et al. |
| 4,153,173 | A | * | 5/1979 | Ward et al. ..... 215/232 |
| 4,452,381 | A | | 6/1984 | Freeman |
| 4,597,513 | A | | 7/1986 | Schiemann |
| 4,793,514 | A | | 12/1988 | Sheets |
| 4,838,464 | A | | 6/1989 | Briggs |
| 4,886,194 | A | | 12/1989 | Schiemann |
| 4,911,315 | A | | 3/1990 | Shrum |
| 5,002,209 | A | | 3/1991 | Goodall |
| 5,104,010 | A | | 4/1992 | Codorniz et al. |
| 5,133,482 | A | | 7/1992 | Burrows et al. |
| 5,134,875 | A | | 8/1992 | Jensen et al. |
| 5,228,603 | A | | 7/1993 | Pham et al. |
| 5,232,110 | A | | 8/1993 | Purnell |
| 5,340,000 | A | | 8/1994 | Ring |
| 5,346,097 | A | | 9/1994 | Melland et al. |
| 5,392,947 | A | | 2/1995 | Gentile |
| 5,392,957 | A | | 2/1995 | Parsons |
| 5,474,112 | A | | 12/1995 | Carola |
| 5,538,165 | A | | 7/1996 | Frohn |
| 5,605,254 | A | | 2/1997 | Wagner, III et al. |
| 5,839,625 | A | | 11/1998 | Braginetz |
| 6,138,877 | A | | 10/2000 | Goff |
| 6,170,719 | B1 | | 1/2001 | Wilkinson et al. |
| 6,196,425 | B1 | | 3/2001 | Fielding et al. |
| 6,439,433 | B1 | | 8/2002 | Dubach et al. |
| 6,460,741 | B1 | | 10/2002 | Ho |
| 6,478,058 | B1 | | 11/2002 | Pears |
| 6,644,471 | B1 | | 11/2003 | Anderson |
| 6,845,885 | B2 | | 1/2005 | Morgenroth |
| 7,395,949 | B2 | | 7/2008 | Ehret et al. |
| 7,441,677 | B2 | | 10/2008 | Garcia |
| 7,464,834 | B2 | | 12/2008 | Law et al. |
| 7,543,723 | B2 | | 6/2009 | Wilford et al. |
| 8,016,146 | B2 | | 9/2011 | Rekstad |
| 2002/0003154 | A1 | | 1/2002 | Soehnlen et al. |
| 2004/0026466 | A1 | | 2/2004 | Lehner et al. |
| 2004/0035894 | A1 | | 2/2004 | Gobbini et al. |
| 2005/0040130 | A1 | | 2/2005 | Bivens |
| 2006/0081662 | A1 | | 4/2006 | Miura |
| 2007/0108156 | A1 | | 5/2007 | Durand et al. |
| 2007/0199953 | A1 | | 8/2007 | Laveault et al. |
| 2007/0284399 | A1 | | 12/2007 | Baughman et al. |
| 2008/0078765 | A1 | | 4/2008 | Steiger et al. |
| 2008/0099514 | A1 | | 5/2008 | Carter et al. |
| 2008/0110849 | A1 | | 5/2008 | Wachsberg |
| 2009/0159620 | A1 | | 6/2009 | Nielsen |
| 2009/0212079 | A1 | | 8/2009 | Baughman et al. |
| 2011/0186535 | A1 | | 8/2011 | Meager |
| 2011/0210092 | A1 | | 9/2011 | Meager |
| 2013/0334161 | A1 | | 12/2013 | Meager |

FOREIGN PATENT DOCUMENTS

| | | |
|---|---|---|
| EP | 1860037 | 11/2007 |
| FR | 2875485 | 3/2006 |

OTHER PUBLICATIONS

Written Opinion for PCT/US2011/023511 mailed Mar. 25, 2011 8 pages.
International Search Report and Written Opinion for International (PCT) Patent Application No. PCT/US12/36430, mailed Jul. 26, 2012 9 pages.
Official Action for U.S. Appl. No. 13/019,941, mailed Jan. 9, 2013 5 pages Restriction Requirement.
Official Action for U.S. Appl. No. 13/019,941, mailed Feb. 12, 2013 5 pages Preinterview First Office Action.
Official Action for U.S. Appl. No. 13/019,941, mailed Mar. 27, 2013 22 pages.
Official Action for U.S. Appl. No. 13/101,907, mailed Jan. 31, 2013 5 pages Restriction Requirement.
Official Action for U.S. Appl. No. 13/101,907, mailed Mar. 26, 2013 5 pages Restriction Requirement.
Official Action for U.S. Appl. No. 13/019,941, mailed Sep. 13, 2013 10 pages.
Official Action for U.S. Appl. No. 13/101,907, mailed Jul. 1, 2013 9 pages.
Notice of Allowance for U.S. Appl. No. 13/019,941, mailed Oct. 22, 2013, 7 pages.
Official Action for U.S. Appl. No. 13/101,907, mailed Nov. 1, 2013, 6 pages.
Extended European Search Report for European Patent Application No. 11740314.7 dated Jan. 2, 2014, 5 pages.
International Preliminary Report on Patentability for International (PCT) Patent Application No. PCT/US12/36430 mailed Nov. 14, 2013, 7 pages.
Official Action for U.S. Appl. No. 13/101,907, mailed May 2, 2013, 4 pages.
Notice of Allowance for U.S. Appl. No. 13/101,907 mailed Dec. 26, 2013, 6 pages.
Official Action for U.S. Appl. No. 13/967,860 mailed May 23, 2014, 6 pages.

* cited by examiner

Figure 10
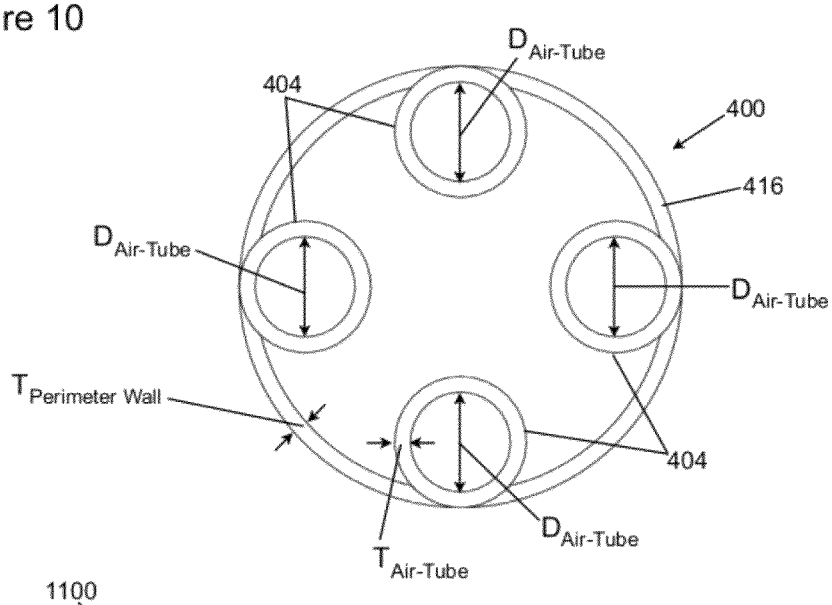
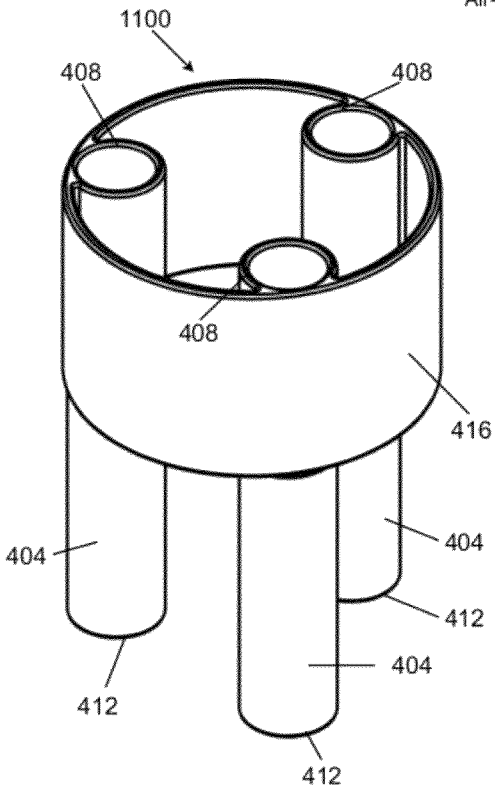
Figure 11
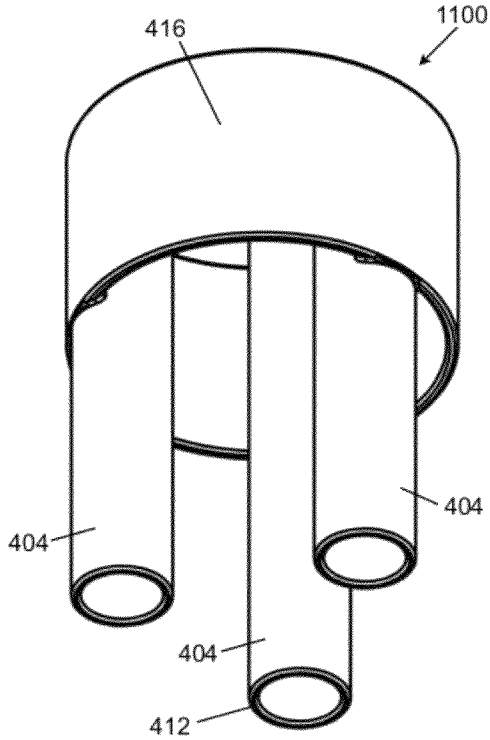
Figure 12

Figure 13
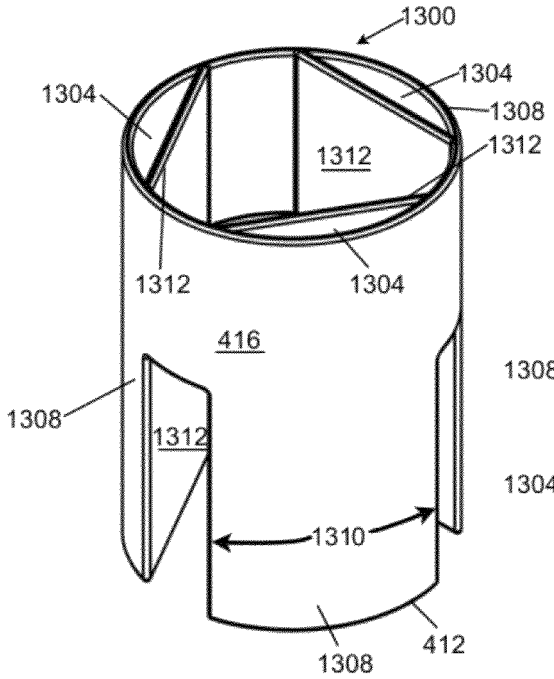
Figure 14
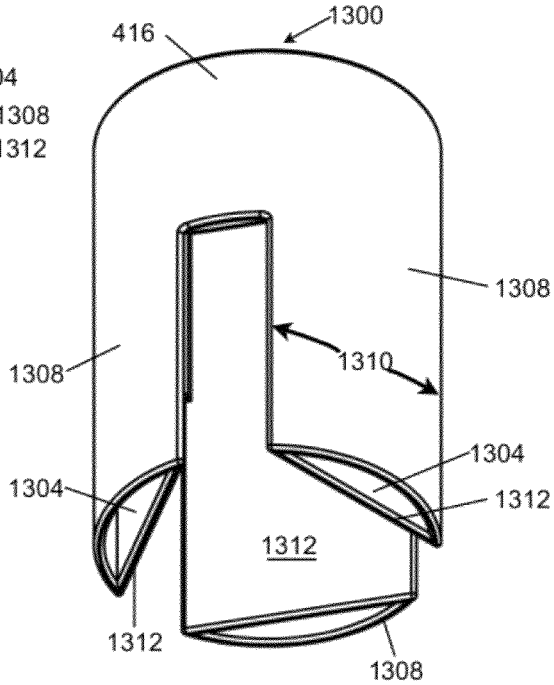
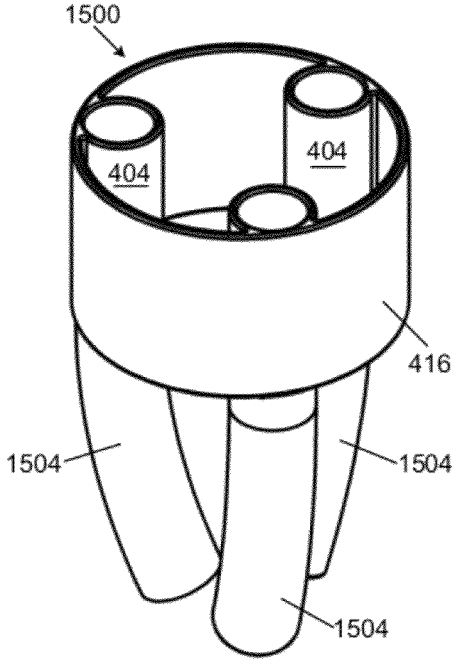
Figure 15
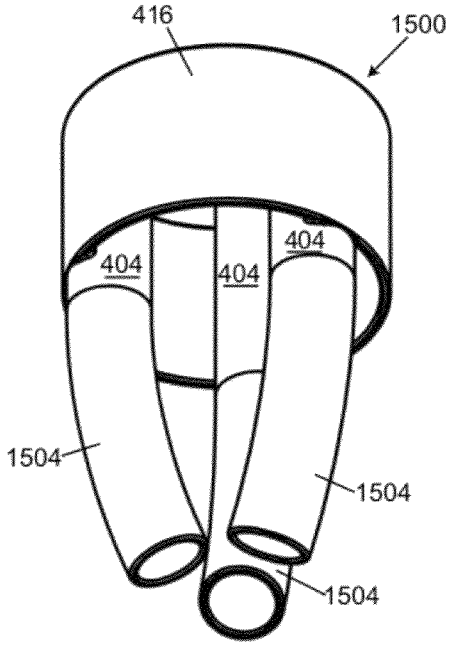
Figure 16

Figure 18
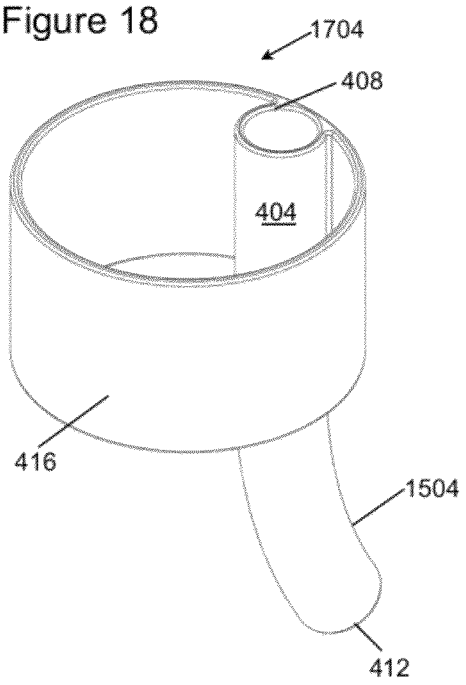
Figure 19
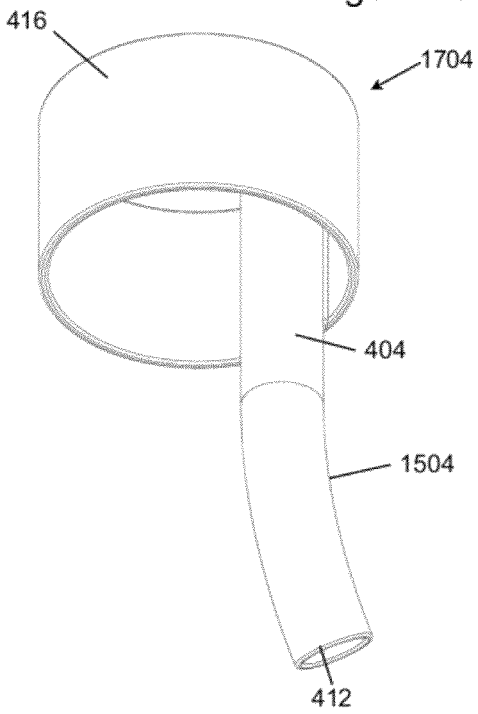
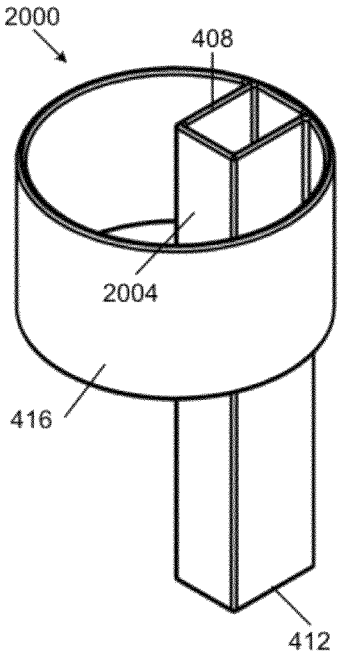
Figure 20
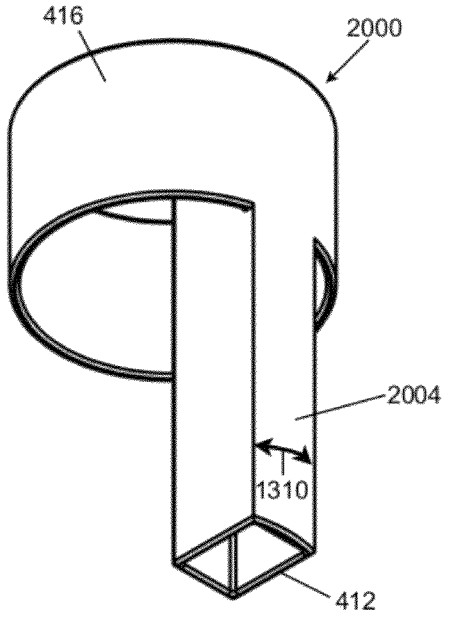
Figure 21

Figure 22
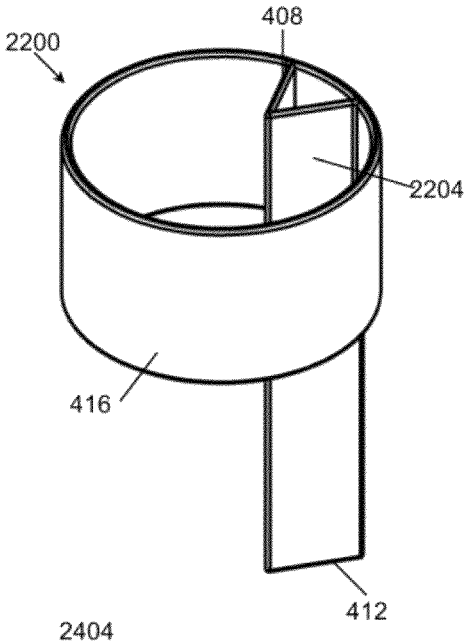
Figure 23
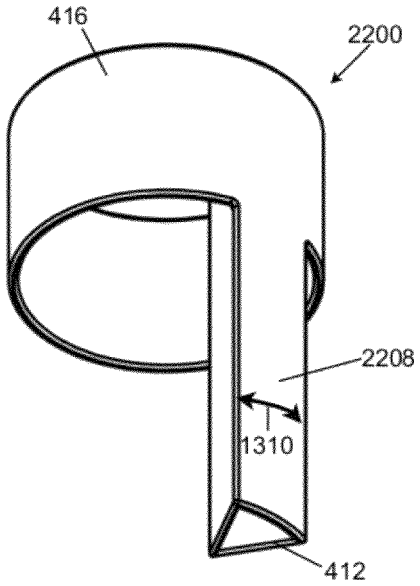
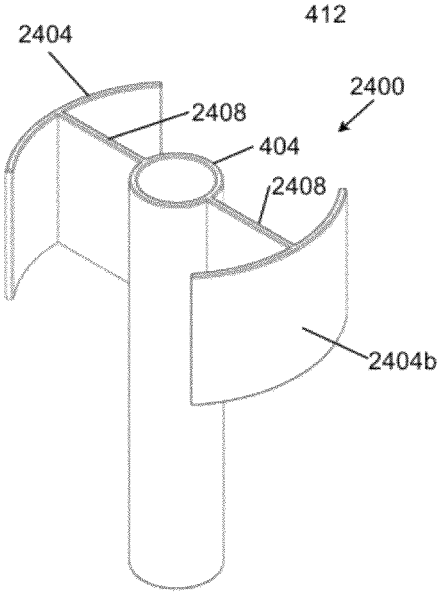
Figure 24
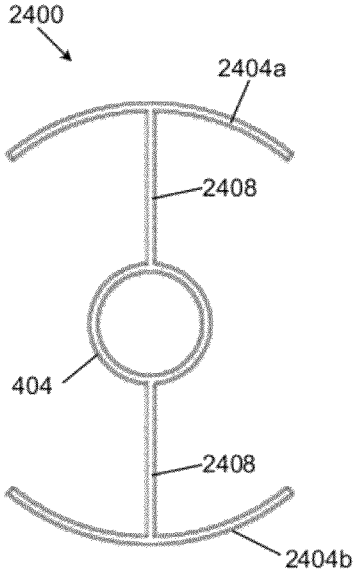
Figure 25

Figure 32
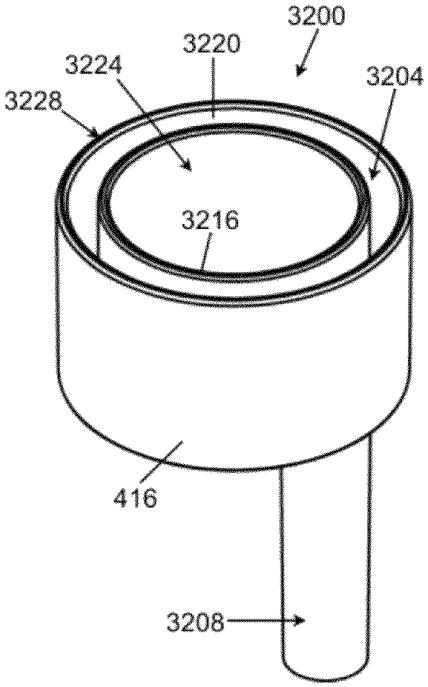
Figure 33
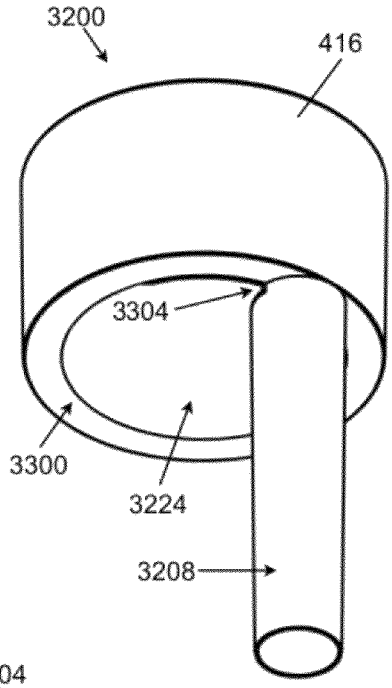
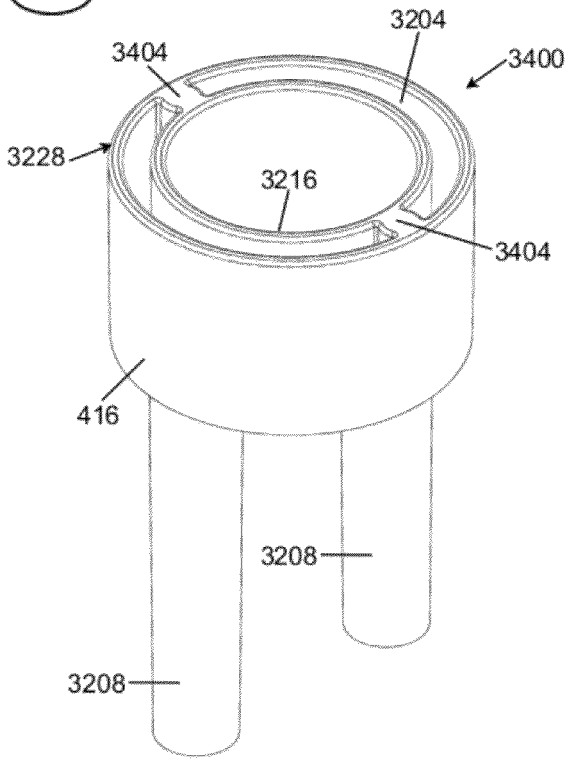
Figure 34

Figure 35
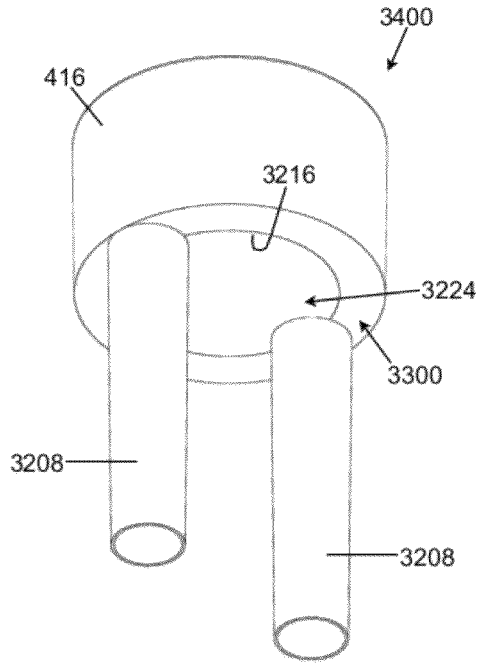
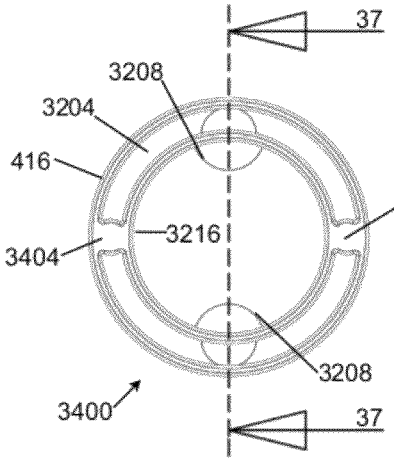
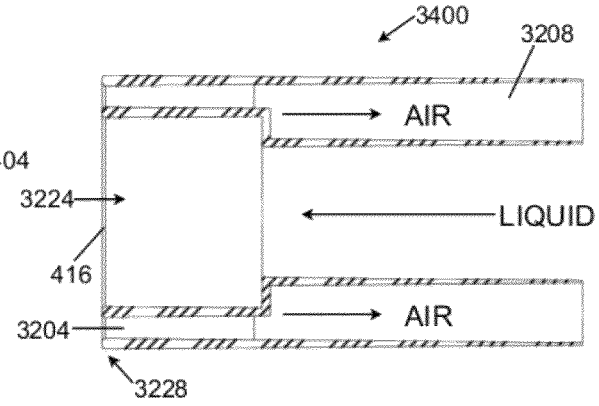
Figure 36
Figure 37

PRESSURE EQUALIZATION APPARATUS FOR A BOTTLE AND METHODS ASSOCIATED THEREWITH

CROSS-REFERENCE TO RELATED APPLICATIONS

The present application is a Continuation-in-Part of U.S. patent application Ser. No. 13/019,941 filed on Feb. 2, 2011, and U.S. patent application Ser. No. 13/101,907, filed May 5, 2011, both of which claim the benefit of U.S. Provisional Patent Application No. 61/301,133 filed on Feb. 3, 2010, and U.S. Provisional Patent Application No. 61/319,030 filed on Mar. 30, 2010; the contents of the foregoing applications are incorporated herein by reference in their entirety.

FIELD

The present disclosure is related to a device that assists with equalizing air pressure within a bottle with the atmospheric air pressure, as liquid is being poured from the bottle.

BACKGROUND

A person pouring liquid from a bottle is often faced with the liquid pouring erratically and even splashing due to "glugging" (that is, uneven flow during pouring) caused by unbalanced pressures between the atmospheric air pressure outside the bottle and the air pressure within the bottle. Referring now to FIG. 1, a bottle 100 is shown in a cross-sectional view, wherein the cross-sectional alignment is taken along line 1-1 of the top elevation view of the bottle 100 depicted in FIG. 2. The bottle 100 includes a bottle wall 104 having an exterior surface 108. The bottle wall 104 includes a base 112 and extends from the base 112 to the top 116 of the bottle 100. The top 116 of the bottle 100 further includes a bottle opening 120 that leads to the bottle interior 124. The bottle interior 124 is defined by an interior surface 128 of the bottle wall 104. The bottle 100 has a bottle length $B_L$, wherein the bottle length $B_L$ is defined herein as the height of the bottle interior 124; that is, the distance between the interior surface 128 of the bottle wall 104 at the deepest portion of the base 112 of the bottle 100 and a top edge 132 of the bottle rim 136 at the top 116.

Referring now to FIG. 3, an enlarged cross-sectional view of an upper portion 140 of the bottle 100 is shown. As those skilled in the art will appreciate, a variety of sealing mechanisms may be used to seal a bottle. By way of example, a threaded cap may be used to seal the bottle. Such a configuration is illustrated in FIG. 3, wherein a threaded cap 148 is depicted directly above the bottle 100. The upper portion 140 of the bottle 100 includes a bottleneck 152. Threads 156 along the exterior surface 108 of the bottleneck 152 are configured to engage threads within cap 148.

Still referring to FIG. 3, the bottleneck 152 includes a substantially constant bottleneck diameter $D_{Bottleneck}$. The bottleneck 152 itself extends from the bottle rim 136 to a location where the bottle 100 begins its taper outward. That is, where the diameter of the bottle 100 increases from the bottleneck diameter $D_{Bottleneck}$. Accordingly, the bottleneck 152 has a bottleneck length $L_{Bottleneck}$ that is defined as the distance between the bottle rim 136 and the bottleneck base 160, which is the location where the bottleneck diameter $D_{Bottleneck}$ no longer remains substantially constant.

Prior devices for attempting to provide for smooth fluid pouring have performance issues, require significant materials, and/or have other limitations, such as extending above the bottle top, thereby complicating or even preventing recapping/resealing of the bottle. Accordingly, there is a need for other devices to address the glugging problem associated with pouring liquids from a bottle.

SUMMARY

It is to be understood that the present disclosure includes a variety of different versions or embodiments, and this Summary is not meant to be limiting or all-inclusive. This Summary provides some general descriptions of some of the embodiments, but may also include some more specific descriptions of other embodiments.

One or more embodiments of the one or more present disclosures are directed to a device that assists with equalizing air pressure within a bottle with the atmospheric air pressure, as liquid is being poured from the bottle. Various embodiments of the pressure equalizers described herein can accommodate various bottle shapes, bottle sizes, liquids, and pouring angles. By way of example, the pressure equalizers are suitable for beverages, chemicals, solutions, suspensions, mixtures, and other liquids. In its most basic form, the pressure equalizer comprises two main fluid flow paths: (a) a channel that allows liquid to pass out of the bottle; and (b) one or more air tubes or air ducts to allow air to enter the bottle.

Furthermore, embodiments of the present disclosure are not limited to equalizing air pressure within bottles, but rather may be utilized to equalize air pressure in any container or vessel. As a couple of non-limiting examples, embodiments of the present disclosure may be employed to equalize air pressure in cartons, jugs, or any other hollow or concave structure for storing, pouring, and/or dispensing liquids.

At least one embodiment described herein utilizes one or more relatively short air tubes, as compared to the bottle length. The air tubes function by pressure differential and are not required to be in contact with an air cavity at the bottom of the bottle of liquid. In at least one embodiment, the pressure equalizer comprises at least one air tube with an air tube rim located substantially flush with the top of the bottle, or at least within 5% of the bottle rim relative to the length of the bottleneck. Unlike an insert used for alcohol bottles at a bar where the insert appears to be meant to slow the flow of liquid, embodiments described herein increase the flow of liquid and better facilitate air/gas entry into the bottle. More particularly, the pressure equalizers described herein mitigate or prevent the glugging effect that occurs when liquid is attempting to exit a bottle at the same time that air is attempting to enter the bottle. At least some embodiments of the pressure equalizers can be incorporated directly into a current bottle mold design, a new bottle mold, or as an inserted device. The device, regardless of how it is incorporated into a bottle, involves one or more air tubes that extend partially into the bottle and allow air to pass into the bottle as the liquid exits the bottle. This device not only minimizes or prevents the common glugging effect, but it can allow liquid from a bottle to be poured smoothly at any angle.

Accordingly, a bottle insert for substantially equalizing atmospheric air pressure with air pressure within a bottle when pouring a liquid from the bottle is provided, the bottle having a bottle length $B_L$, the bottle including a bottleneck and a bottle opening having an opening diameter, the bottleneck having an interior bottleneck wall and a bottleneck length $L_{Bottleneck}$ extending between a bottle opening rim at the bottle opening to a bottleneck base at a top of a bottle taper of the bottle, the bottle opening rim circumscribing the bottle opening, the bottle insert comprising:

a perimeter member adapted for contacting at least a portion of the interior bottleneck wall; and an air tube attached to the perimeter member, the air tube including an upper inlet rim and a lower end edge, the air tube including an air tube length $L_{Air\ Tube}$ extending between the upper inlet rim and the lower end edge, wherein the upper inlet rim is configured for positioning within a rim proximity distance of about 0% to 5% of the bottleneck length $L_{Bottleneck}$ above or below the bottle opening rim, and wherein the air tube length $L_{Air\ Tube}$ is equal to or greater than the bottleneck length $L_{Bottleneck}$ and equal to or less than about 25% of the bottle length $B_L$.

In at least one embodiment, the perimeter member engages the bottle by a friction fit. In at least one embodiment, the air tube comprises a flared portion. In at least one embodiment, the flared portion includes a flared portion base that does not extend distally beyond the bottleneck base. In at least one embodiment, the bottle insert further comprises at least one additional air tube. In at least one embodiment, the at least one additional air tube includes a length equal to or greater than the bottleneck length $L_{Bottleneck}$ and equal to or less than about 25% of the bottle length $B_L$.

One or more additional embodiments may comprise an air inlet channel in fluid communication with an air tube. Accordingly, a bottle insert for substantially equalizing atmospheric air pressure with air pressure within a bottle when pouring a liquid from the bottle is provided, the bottle having a bottle length $B_L$, the bottle including a bottleneck and a bottle opening having an opening diameter, the bottleneck having an interior bottleneck wall and a bottleneck length $L_{Bottleneck}$ extending between a bottle opening rim at the bottle opening to a bottleneck base at a top of a bottle taper of the bottle, the bottle opening rim circumscribing the bottle opening, the bottle insert comprising:

an air inlet channel adapted for contacting at least a portion of the interior bottleneck wall and extending circumferentially around at least a portion of the interior bottleneck wall, the air inlet channel including a perimeter member contacting at least a portion of the interior bottleneck wall, the air inlet channel including a distal base and an interior channel wall located substantially parallel to at least a portion of the perimeter member and offset radially to the interior of the perimeter member by the distal base; and an air tube attached to the air inlet channel and having a distal end extending equal to or less than about 25% of the bottle length $B_L$, at least a portion of the air tube in fluid communication with the air inlet channel.

In at least one embodiment, a top of the air inlet channel is situated within a rim proximity distance above or below the bottle opening rim, the rim proximity distance equal to or less than about 5% of the bottleneck length $L_{Bottleneck}$. In at least one embodiment, the bottle insert further comprises at least one additional air tube wherein the at least one additional air tube has an air tube diameter $D_{AirTube}$ between about 2% to 50% of the opening diameter of the bottle. In at least one embodiment, the bottle insert further comprises at least one additional air tube, the at least one additional air tube fluidly contiguous with the air inlet channel. In at least one embodiment, the bottle insert further comprises a flow block within the air inlet channel and situated between the air tube and the at least one additional air tube.

One or more additional embodiments are directed to a liquid containment and delivery device that mitigates the glugging phenomena. Accordingly, a liquid containment and delivery device is provided, comprising:

(a) a bottle having a bottle length $B_L$, the bottle including a bottleneck and a bottle opening having an opening diameter, the bottleneck having an interior bottleneck wall and a bottleneck length $L_{Bottleneck}$ extending between a bottle opening rim at the bottle opening to a bottleneck base at a top of a bottle taper of the bottle, the bottle opening rim circumscribing the bottle opening; and (b) a pressure reliever comprising an air tube attached to the interior bottleneck wall, the air tube including an upper inlet rim and a lower end edge, the air tube including an air tube length $L_{Air\ Tube}$ extending between the upper inlet rim of the air tube and the lower end edge of the air tube, wherein the upper inlet rim is positioned within about 0% to 5% of the bottleneck length $L_{Bottleneck}$ above or below the bottle opening rim, and wherein the air tube length $L_{Air\ Tube}$ is equal to or greater than the bottleneck length $L_{Bottleneck}$ and equal to or less than about 25% of the bottle length $B_L$.

In at least one embodiment, the air tube comprises a flared portion. In at least one embodiment, the flared portion includes a flared portion base that does not extend distally beyond the bottleneck base.

One or more embodiments include a pressure equalizer that includes an air tube having a flared portion. Accordingly, an article for holding and pouring a liquid is provided, comprising:

a bottle including a bottle wall having an interior surface defining a chamber, the chamber extending between a bottle opening and an interior bottom of the bottle, wherein the bottle opening is located at an end of a bottleneck of the bottle, the bottleneck including a bottleneck diameter smaller than a chamber diameter located along a bottle length extending between the bottle opening and the interior bottom; and a pressure equalizer located within the bottleneck and including at least one air tube with a flared proximal end having an inlet rim situated within a rim proximity distance of the bottle opening, the rim proximity distance equal to about 5% of the bottleneck length.

In at least one embodiment, the air tube has an air tube length no greater than about 25% of the bottle length. In at least one embodiment, a distal portion of the air tube extends into a handle of the bottle. In at least one embodiment, multiple air tubes are used and are situated substantially equidistant around an interior perimeter of the bottleneck. In at least one embodiment, the article further comprises a cap, the cap being detachably connected to the pressure equalizer for installation in the bottleneck when the cap is applied to the bottle.

In accordance with some embodiments, the air inlet tube variations can be combined. As an example, it is possible to combine one relatively small circular air inlet tube with one rectangular air inlet tube of larger size and two small triangular tubes that curve, all in one pressure equalizer device.

In use, if a bottle does not include a pressure equalizer that is integrally made with the bottle, an embodiment of a pressure equalizer insert can be inserted into the bottleneck of the subject bottle. The bottle is then tilted to pour the liquid contained in the bottle. While pouring the liquid, air enters the bottle via the one or more air tubes of the pressure equalizer as liquid exits the bottle via the open space situated around the one or more air tubes.

Various components are referred to herein as "operably associated." As used herein, "operably associated" refers to components that are linked together in operable fashion, and encompasses embodiments in which components are linked directly, as well as embodiments in which additional components are placed between the two linked components.

As used herein, "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" means A alone, B alone, C alone, A and B together, A and C together, B and C together, or A, B and C together.

As used herein, a bottle, jug, carton, or similar container device may simply be referred to as a "bottle."

Various embodiments of the present disclosures are set forth in the attached figures and in the Detailed Description as provided herein and as embodied by the claims. It should be understood, however, that this Summary does not contain all of the aspects and embodiments of the one or more present disclosures, is not meant to be limiting or restrictive in any manner, and that the disclosure(s) as disclosed herein is/are understood by those of ordinary skill in the art to encompass obvious improvements and modifications thereto.

Additional advantages of the present disclosure will become readily apparent from the following discussion, particularly when taken together with the accompanying drawings.

BRIEF DESCRIPTION OF THE DRAWINGS

To further clarify the above and other advantages and features of the present disclosure, a more particular description is rendered by reference to specific embodiments, which are illustrated in the appended drawings. It is appreciated that these drawings depict only typical embodiments and are, therefore, not to be considered limiting of its scope. The present disclosure is described and explained with additional specificity and detail through the use of the accompanying drawings in which:

FIG. 10 is a top elevation view of the device shown in FIG. 8;

FIG. 11 is a top perspective view of an embodiment described herein;

FIG. 12 is a bottom perspective view of the device shown in FIG. 11;

FIG. 13 is a top perspective view of an embodiment described herein;

FIG. 14 is a bottom perspective view of the device shown in FIG. 13;

FIG. 15 is a top perspective view of an embodiment described herein;

FIG. 16 is a bottom perspective view of the device shown in FIG. 15;

FIG. 18 is a top perspective view of an embodiment described herein;

FIG. 19 is a bottom perspective view of the device shown in FIG. 18;

FIG. 20 is a top perspective view of an embodiment described herein;

FIG. 21 is a bottom perspective view of the device shown in FIG. 20;

FIG. 22 is a top perspective view of an embodiment described herein;

FIG. 23 is a bottom perspective view of the device shown in FIG. 22;

FIG. 24 is a top perspective view of an embodiment described herein;

FIG. 25 is a top elevation view of the device shown in FIG. 24;

FIG. 32 is a top perspective view of an embodiment described herein;

FIG. 33 is a bottom perspective view of the device shown in FIG. 32;

FIG. 34 is a top perspective view of an embodiment described herein;

FIG. 35 is a bottom perspective view of the device shown in FIG. 34;

FIG. 36 is a top elevation view of the device shown in FIG. 34;

FIG. 37 is a side cross-sectional view of the device shown in FIG. 34 (taken along line 37-37 as shown in FIG. 36);

The drawings are not necessarily to scale.

DETAILED DESCRIPTION

One or more embodiments of the present disclosure include a pressure equalizer insert for placement in a bottle to allow a liquid to be poured from the bottle while at the same time substantially equalizing air pressure within the bottle with atmospheric air pressure. As a result, the liquid can be poured from the bottle without the typical glugging phenomena that generally accompanies pouring liquid from a bottle that does not possess the pressure equalizer. One or more additional embodiments include bottles having bottlenecks with the pressure equalizer device integrally formed within the bottle during manufacture of the bottle. For example, a plastic bottle, carton, or jug can be manufactured with the pressure equalizer device integrally formed in the bottleneck of the bottle, top of the carton, or neck of the jug when the bottle, carton, or jug is produced. The various embodiments of the present disclosure are described in the text below and are illustrated in the attached drawings.

Figure 1:
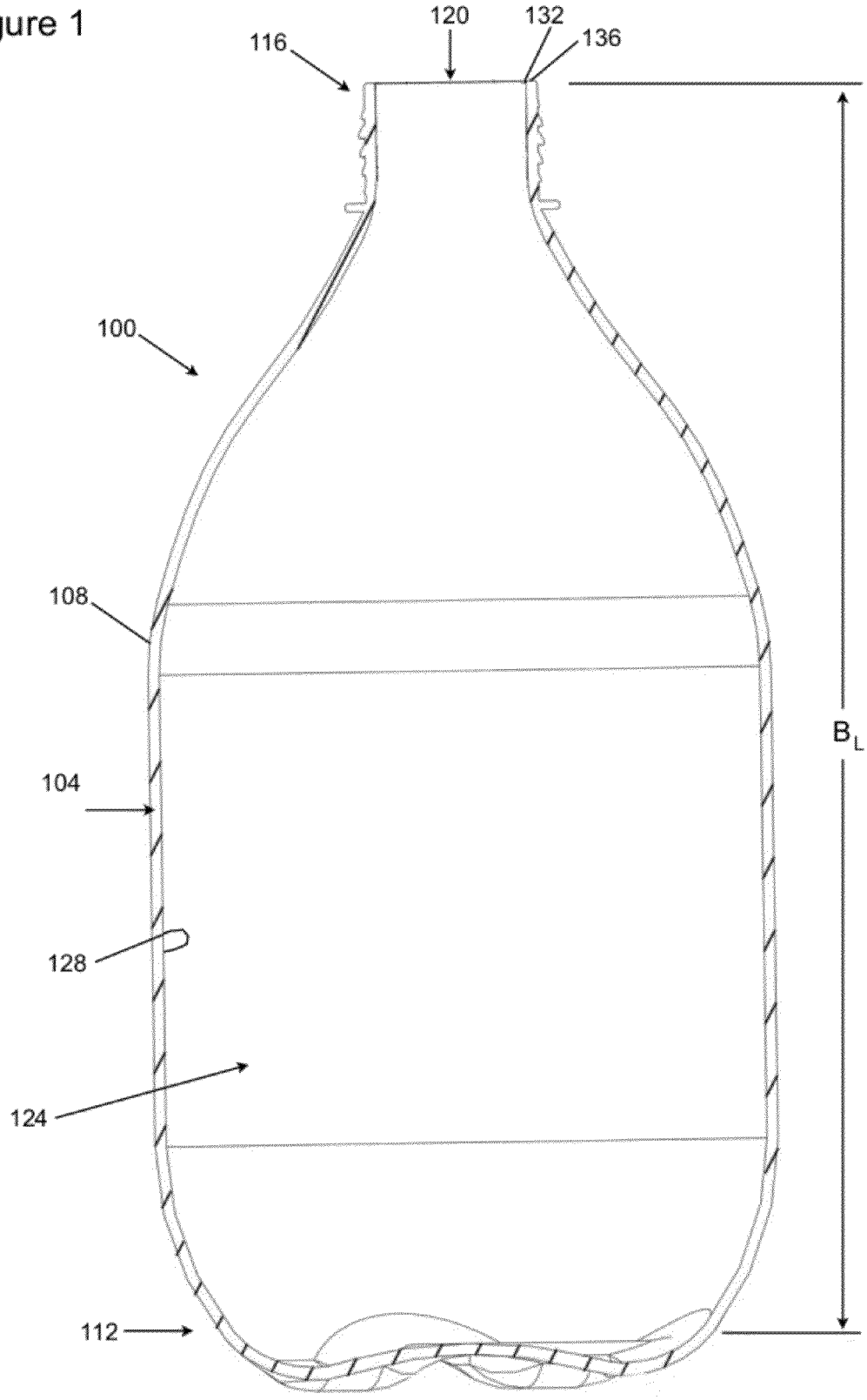
FIG. 1 is a side cross-sectional view (taken along line 1-1 as shown in FIG. 2) of a bottle.
Figure 2:
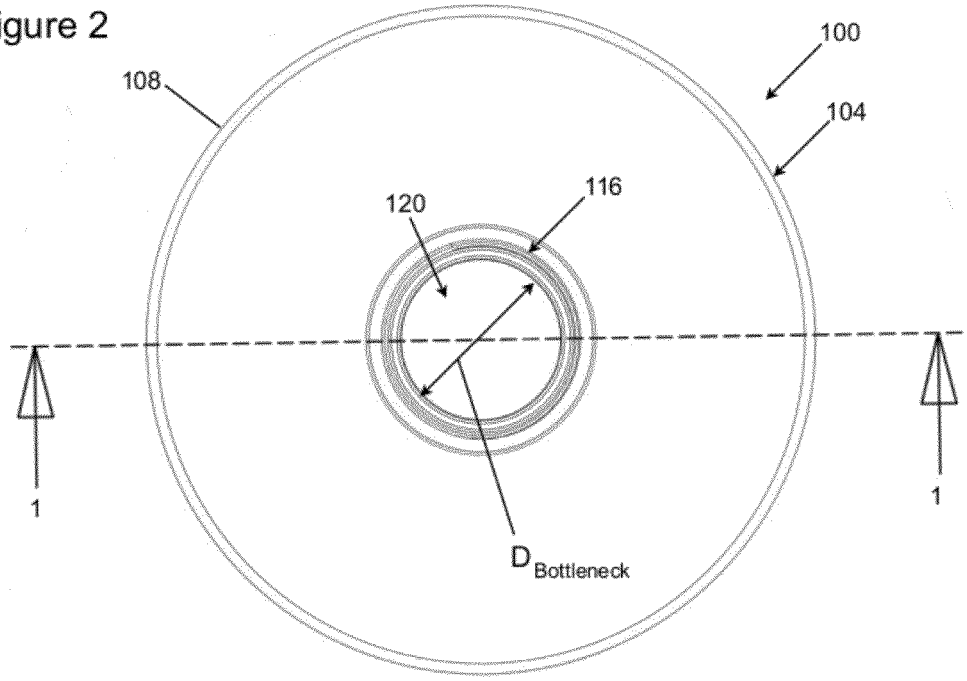
FIG. 2 is a top elevation view of the bottle depicted in FIG. 1.
Figure 3:
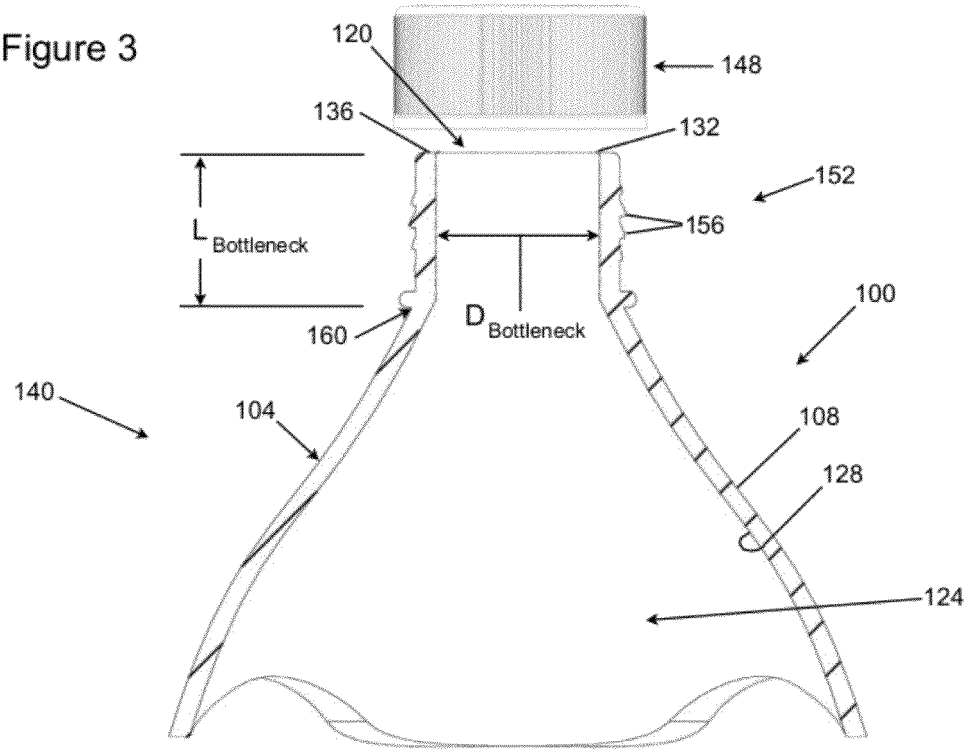
FIG. 3 is an enlarged cross-sectional view of the upper portion of the bottle depicted in FIG. 1.
Figure 4A:
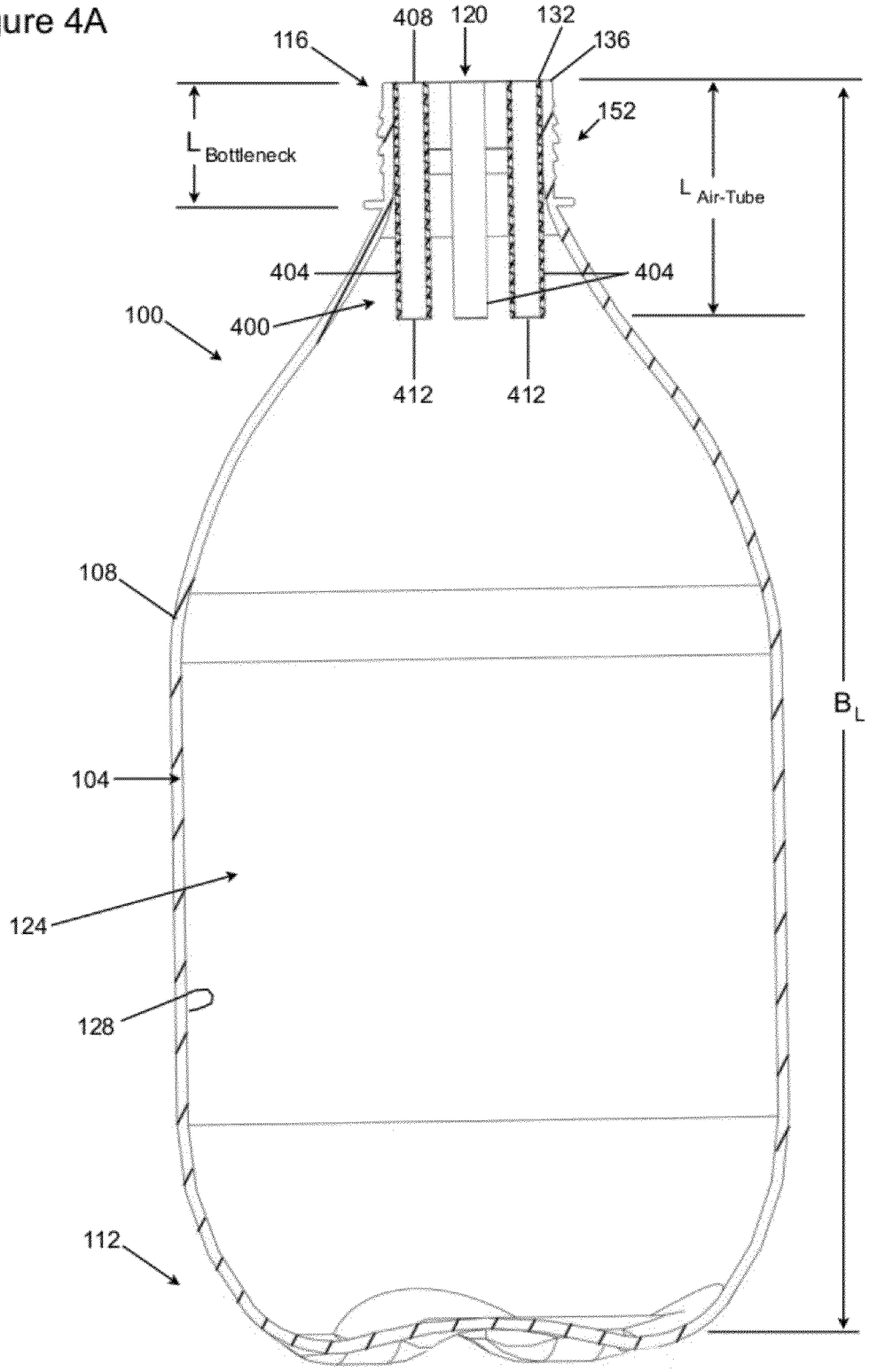
FIG. 4A is a side cross-sectional view (taken along line 4A-4A as shown in FIG. 5) of an embodiment described herein.
Figure 4B:
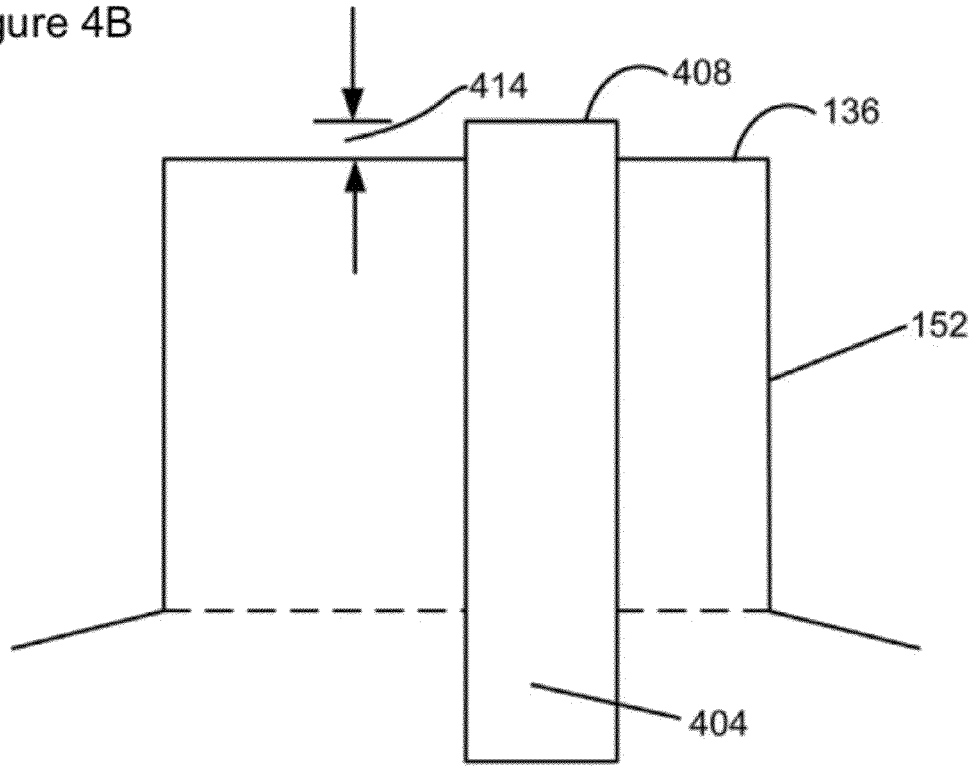
FIG. 4B is a detailed view of a bottleneck illustrating a rim proximity distance.
Figure 4C:
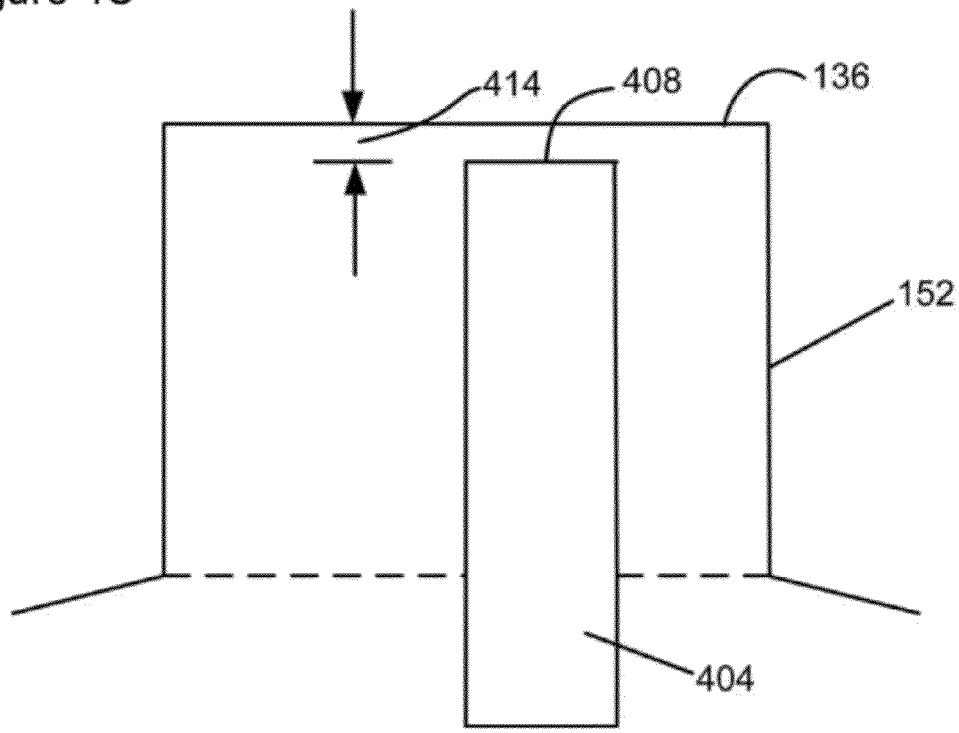
FIG. 4C is another detailed view of a bottleneck illustrating a rim proximity distance.
Figure 5:
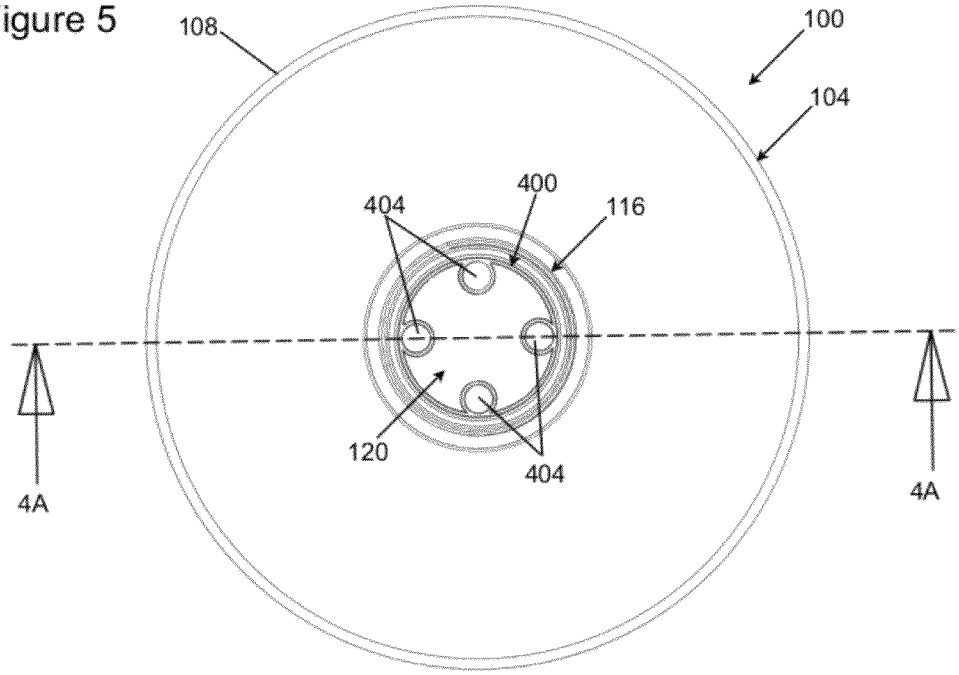
FIG. 5 is a top elevation view of the device shown in FIG. 4A.
Figure 6:
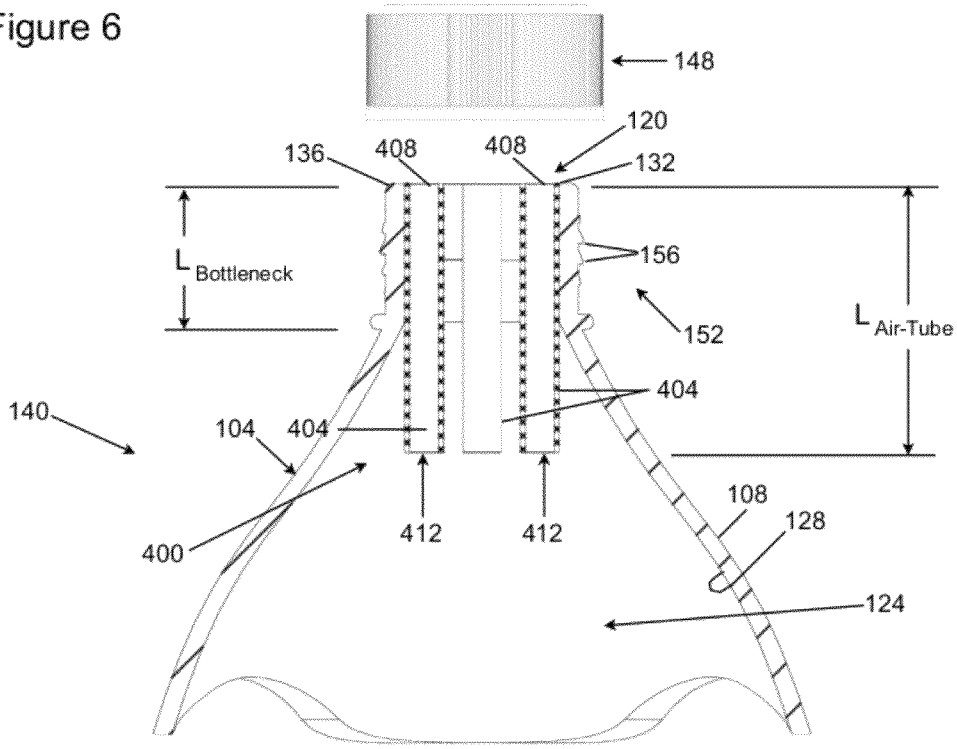
FIG. 6 is an enlarged cross-sectional view of the upper portion of the bottle depicted in FIG. 4A.
Figure 7:
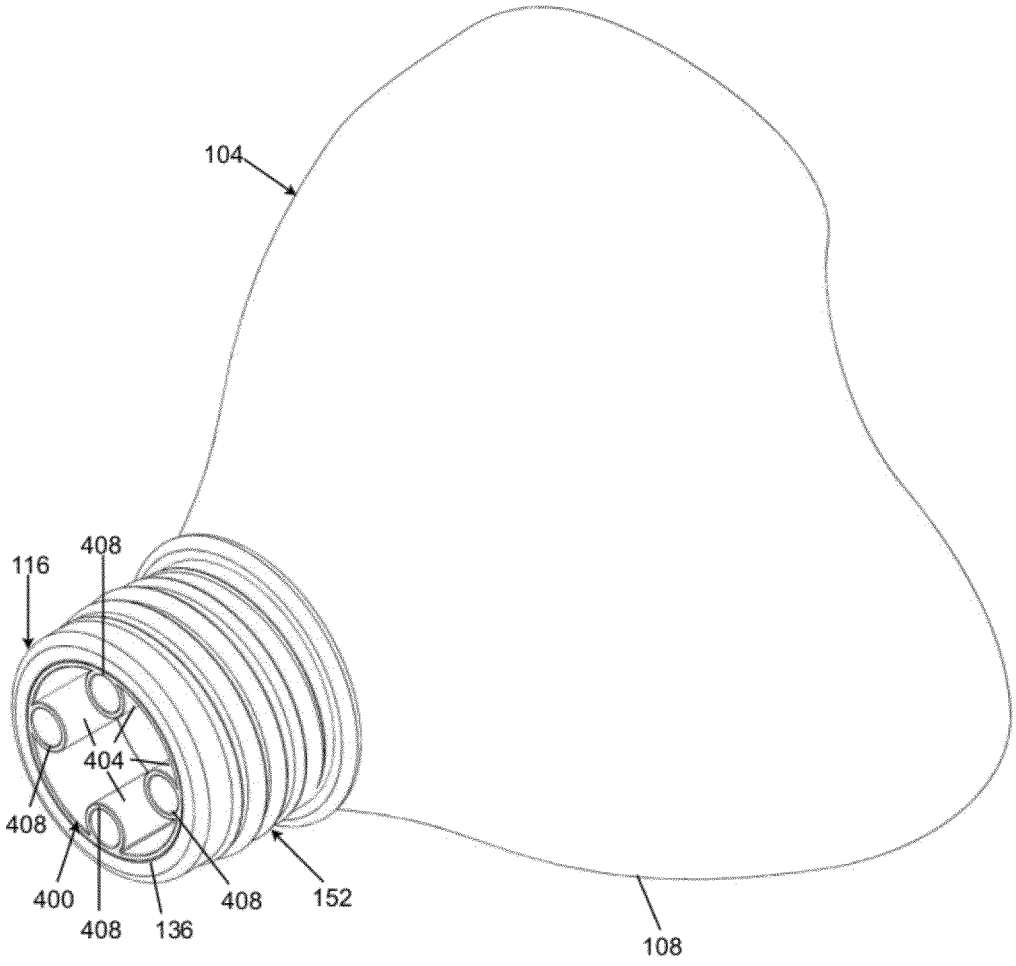
FIG. 7 is an enlarged perspective view of the upper portion of the bottle depicted in FIG. 6.

Referring now to FIG. 4A, a bottle 100 is shown that includes an embodiment of a pressure equalizer 400 inserted into the bottle 100. More particularly, FIG. 4A depicts a bottle 100 and a pressure equalizer 400 in a cross-sectional view, wherein the cross-sectional alignment is taken along line 4A-4A of the top elevation view of the bottle 100 and pressure equalizer 400 depicted in FIG. 5. The pressure equalizer 400 is located, at least in part, in the bottleneck 152 of the bottle 100. In at least one embodiment, the pressure equalizer 400 includes at least one air tube 404. As depicted in FIGS. 4A-10, the pressure equalizer 400 is shown with four air tubes 404; however, it is to be understood that embodiments of the pressure equalizer 400 may include more or less than four air tubes 404. More specifically, and as will be discussed in more detail below, one or more embodiments include a single air tube 404, while other embodiments include two or more air tubes 404. Accordingly, the number of air tubes 404 may vary for a given application.

Figure 42:
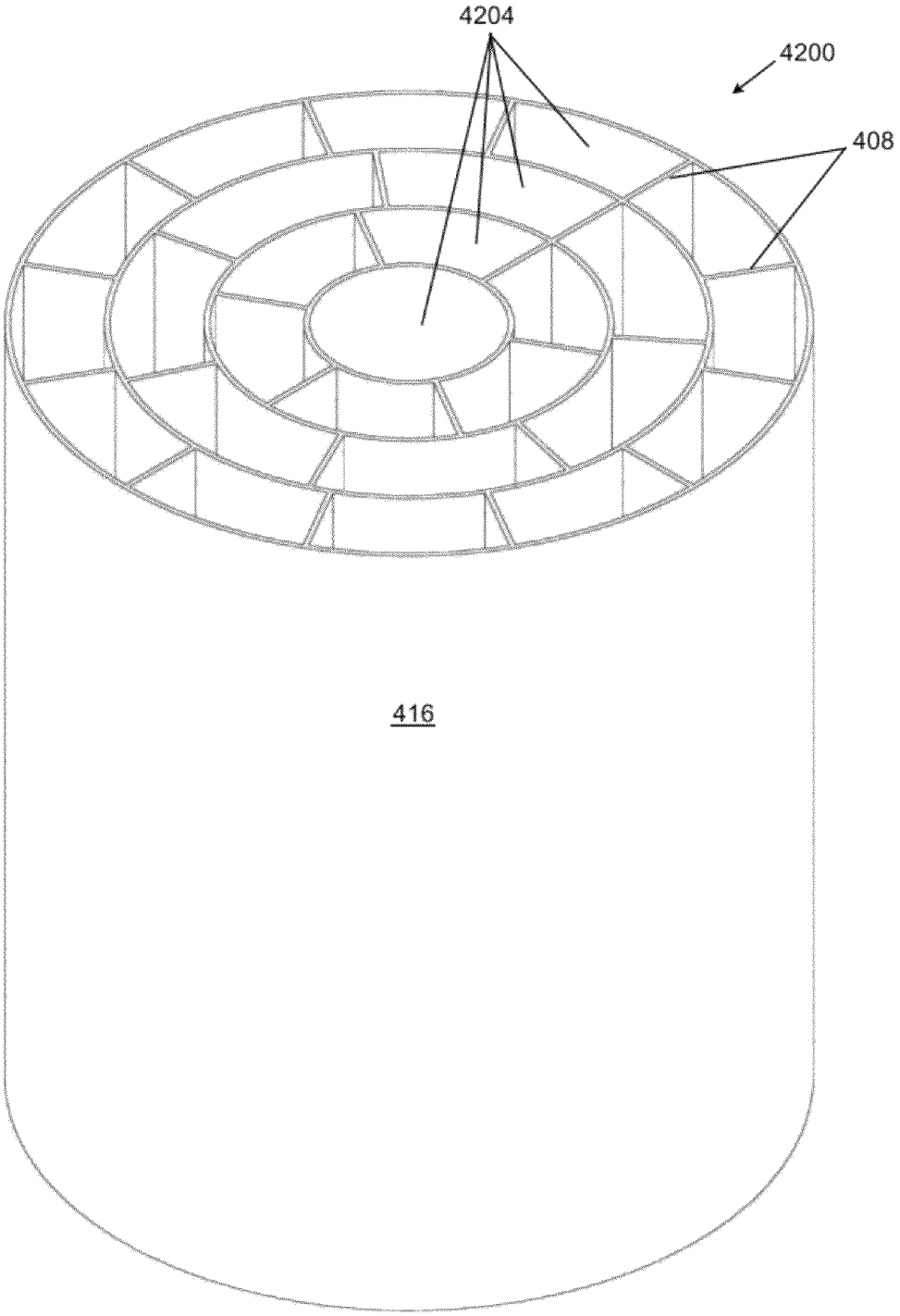
FIG. 42 is a side perspective view of an embodiment described herein.
Figure 43:
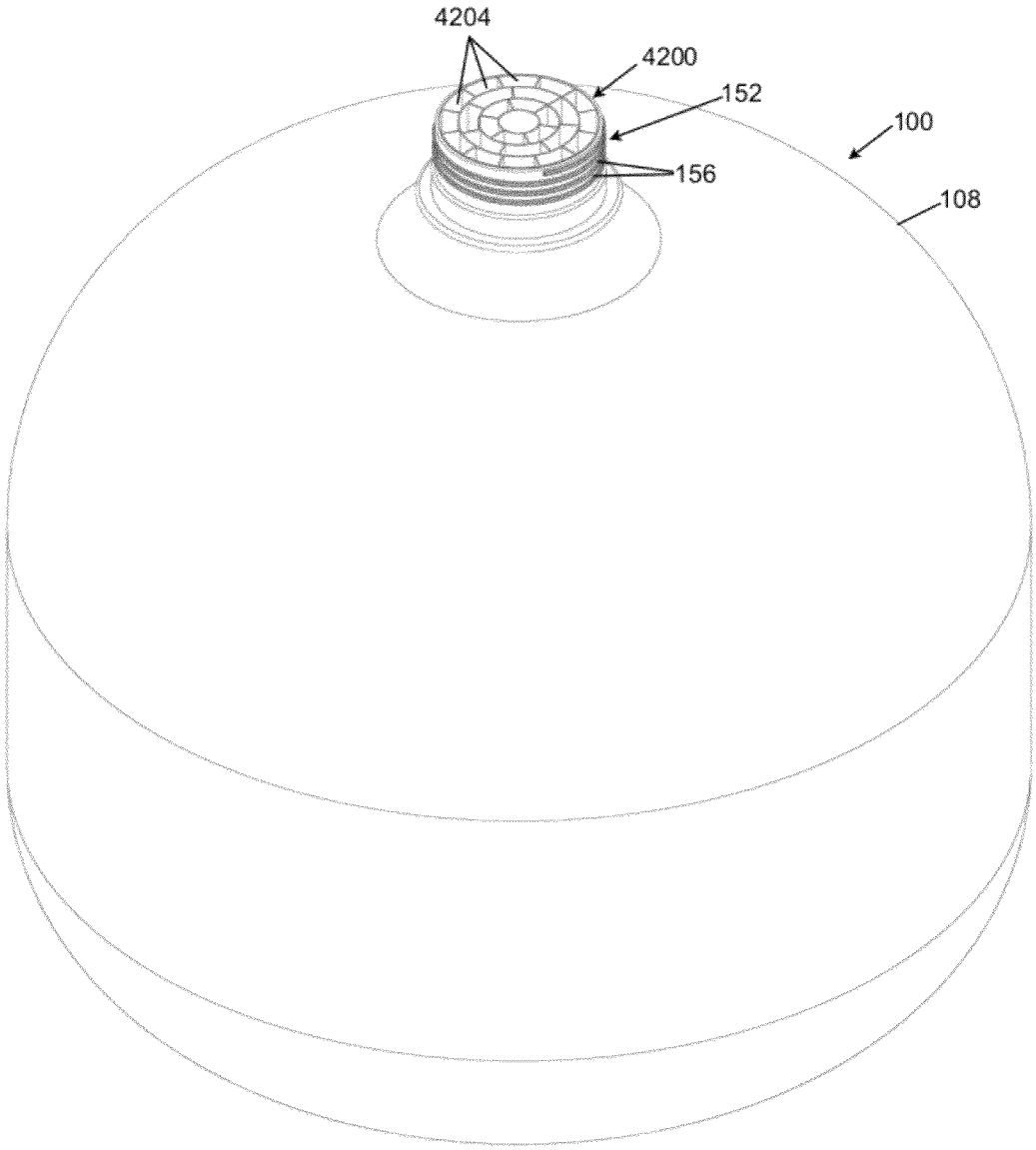
FIG. 43 is a top perspective view of an embodiment described herein.

With continued reference now to FIGS. 4A-10, each air tube 404 is sized to have an air tube diameter $D_{AirTube}$ of between about 2% to 50% of the bottleneck diameter $D_{Bottleneck}$. Here it is noted that for pressure equalizers using small air tubes, multiple air tubes are preferably used for situations where the air tube diameters $D_{AirTube}$ are at or around 2% of the bottleneck diameter $D_{Bottleneck}$. Although air tubes may occupy the entire interior space of the bottleneck (as shown in FIGS. 42 and 43 and discussed below), for any given air tube 404 the diameter or equivalent diameter (allowing for different shaped air tubes, also discussed below) for the air tubes 404 preferably does not exceed 50% of the bottleneck diameter $D_{Bottleneck}$. In addition, any given air tube 404 should not be so small as to induce capillary rise of the liquid within the bottle. Accordingly, by way of example and not limitation, a bottle having a bottleneck diameter $D_{Bottleneck}$ (that is, an inside diameter) of approximately 0.875 inches could receive a pressure equalizer 400 with a variety of number and size air tubes, such as air tubes 404 whose diameters vary between about 0.0018 inches (2% of 0.875 inches) and about 0.438 inches (50% of 0.875 inches).

Referring still to FIGS. 4A-10, and in accordance with at least one embodiment of the present disclosure, the air tubes 404 include an upper inlet rim 408 and a lower end edge 412. Accordingly, the air tubes 404 have an air tube length $L_{Air\ Tube}$ extending between the upper inlet rim 408 and the lower end edge 412. In at least one embodiment, the upper inlet rim 408 is configured for positioning substantially even with the bottle rim 136. Alternatively, in at least one embodiment the upper inlet rim 408 of the air tubes 404 is situated within a rim proximity distance 414 of about 5% of the bottleneck length $L_{Bottleneck}$ either above (as best seen in FIG. 4B) or below (as best seen in FIG. 4C) of the bottle rim 136. In addition, in at least one embodiment, the air tube length $L_{Air\ Tube}$ is equal to or greater than the bottleneck length $L_{Bottleneck}$ and equal to or less than about 25% of the bottle length $B_L$ (i.e., $L_{Bottleneck} \leq L_{Air\ Tube} \leq 25\%\ B_L$). Accordingly, by way of example and not limitation, a bottle having a bottleneck length $L_{Bottleneck}$ of 1.0 inch and a bottle length $B_L$ of 8.0 inches could receive a pressure equalizer 400 that includes one or more air tubes 404 whose upper inlet rim 408 is within 0.05 inches (5% of 1.0 inch) above or below the bottle rim 136, and whose air tube length $L_{Air\ Tube}$ is greater than or equal to 1.0 inch (the value of the bottleneck length $L_{Bottleneck}$) and less than or equal to about 2.5 inches (25% of 8.0 inches).

Figure 8:
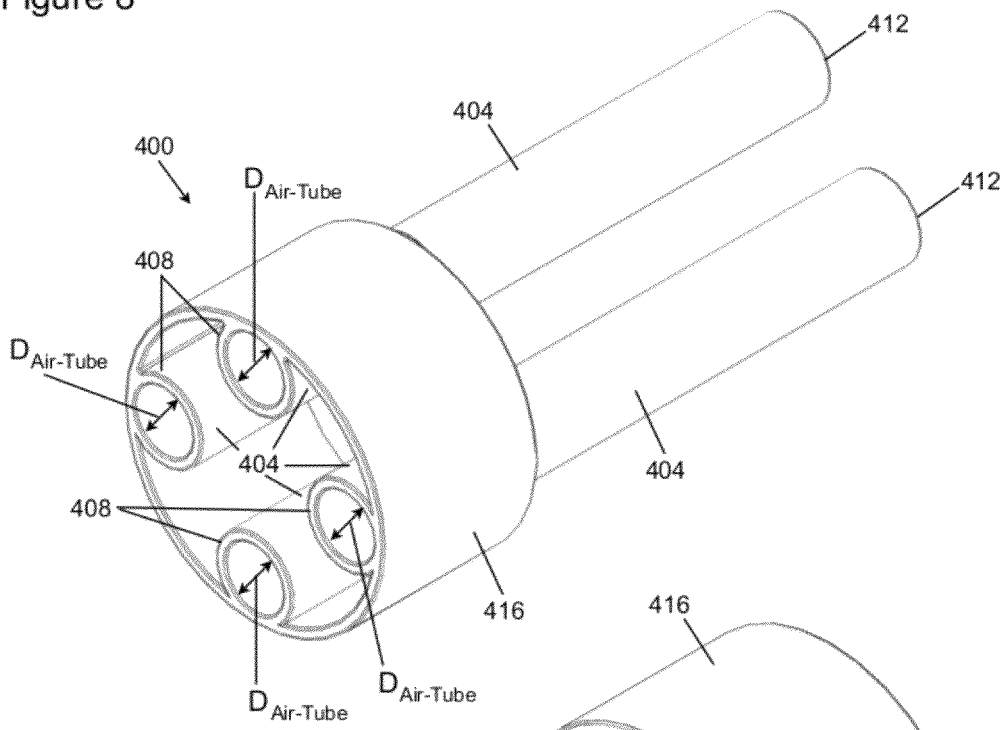
FIG. 8 is a top side perspective view of an embodiment described herein.
Figure 9:
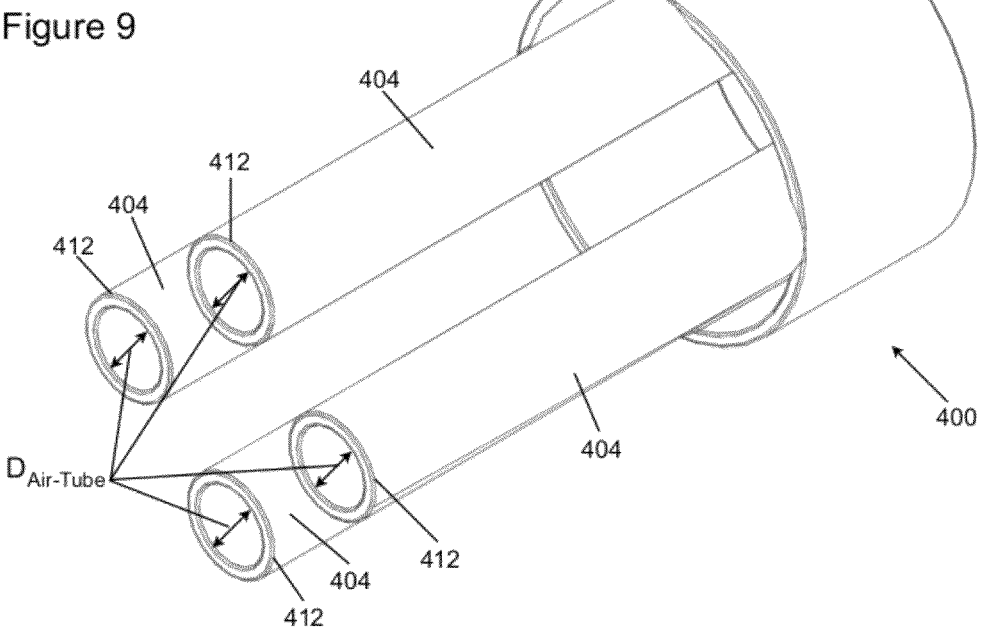
FIG. 9 is a bottom side perspective view of the device shown in FIG. 8.

Referring now to FIGS. 8 and 9, perspective views of pressure equalizer 400 are shown. As described above, the pressure equalizer 400 includes a plurality of air tubes 404, and more specifically, four air tubes 404 are shown arranged substantially equidistant around the circumference and within a perimeter member 416. For embodiments wherein the pressure equalizer 400 is an insert, the perimeter member 416 is configured to fixedly engage (e.g., by friction fit, threads, welding, adhesive, and/or fastener) the interior surface 128 of the bottleneck 152 of the bottle 100. Alternatively, if the pressure equalizer 400 is integrally formed as part of the bottle 100, then the air tubes 404 may be positioned directly around the interior surface 128 of the bottleneck 152.

Referring now to FIG. 10, in at least one embodiment the thickness of the perimeter member 416 includes a portion of the wall of the air tube 404. More particularly, each air tube 404 includes a tube wall thickness $T_{Air\ Tube\ Wall}$. The tube wall thickness $T_{Air\ Tube\ Wall}$ forms a portion of the perimeter member 416. Or, said differently, a portion of the perimeter wall thickness $T_{Perimeter\ Wall}$ forms a portion of the air tube 404.

As noted above, pressure equalizers with one or more air tubes comprise various embodiments of the present disclosure. With reference now to FIGS. 11 and 12, a pressure equalizer 1100 is shown comprising a plurality of air tubes 404, and more specifically, three air tubes 404. The air tubes 404 of pressure equalizer 1100 are situated substantially at equal distances from one another around the circumference of the perimeter member 416. Again, for an insert, the perimeter member 416 is adapted to engage at least a portion of the interior surface 128 of the bottleneck 152 of a bottle 100. If made integrally with the bottle 100, then the three air tubes 404 of pressure equalizer 1100 are attached to a portion of the interior surface 128 of the bottle wall 104 of the bottleneck 152 of a bottle 100.

Referring now to FIGS. 13 and 14, and in accordance with at least one embodiment, a pressure equalizer 1300 is shown that includes a plurality of air tubes 1304, wherein the air tubes have a cross-sectional shape other than circular. More specifically, the air tubes 1304 comprises a perimeter section 1308 having an arc 1310 that substantially matches the curvature of a portion of the perimeter member 416 (for an insert) or the interior surface 128 of the bottleneck 152 (for an integrally formed pressure equalizer). The air tubes 1304 further include a substantially planar interior portion 1312. In cross section, the air tubes 1304 are substantially that of a segment of a circle. Although of a different cross-sectional shape, the air tubes 1304 preferably include an equivalent diameter (by measuring the cross-sectional area of the air tube 1304 and solving for an equivalent diameter) that resides within the prescribed range of about 2% to 50% of the bottleneck diameter $D_{Bottleneck}$. In addition, the length of the air tubes 1304 preferably also be within the prescribed values given above (that is, $L_{Bottleneck} \leq L_{Air\ Tube} \leq 25\%\ B_L$). Use of a portion of the perimeter member 416 as part of the air tubes 1304 is advantageous because less materials are used in the manufacturing process.

Referring now to FIGS. 15 and 16, in at least one embodiment a pressure equalizer 1500 comprises air tubes 404 that include curved portions along their longitudinal length, such as along distal portions of their length. Such distal curved portions 1504 may provide advantageous routing of air as fluid exits the liquid flow channel of the pressure equalizer and air enters the bottle through the air tubes 404.

Figure 17:
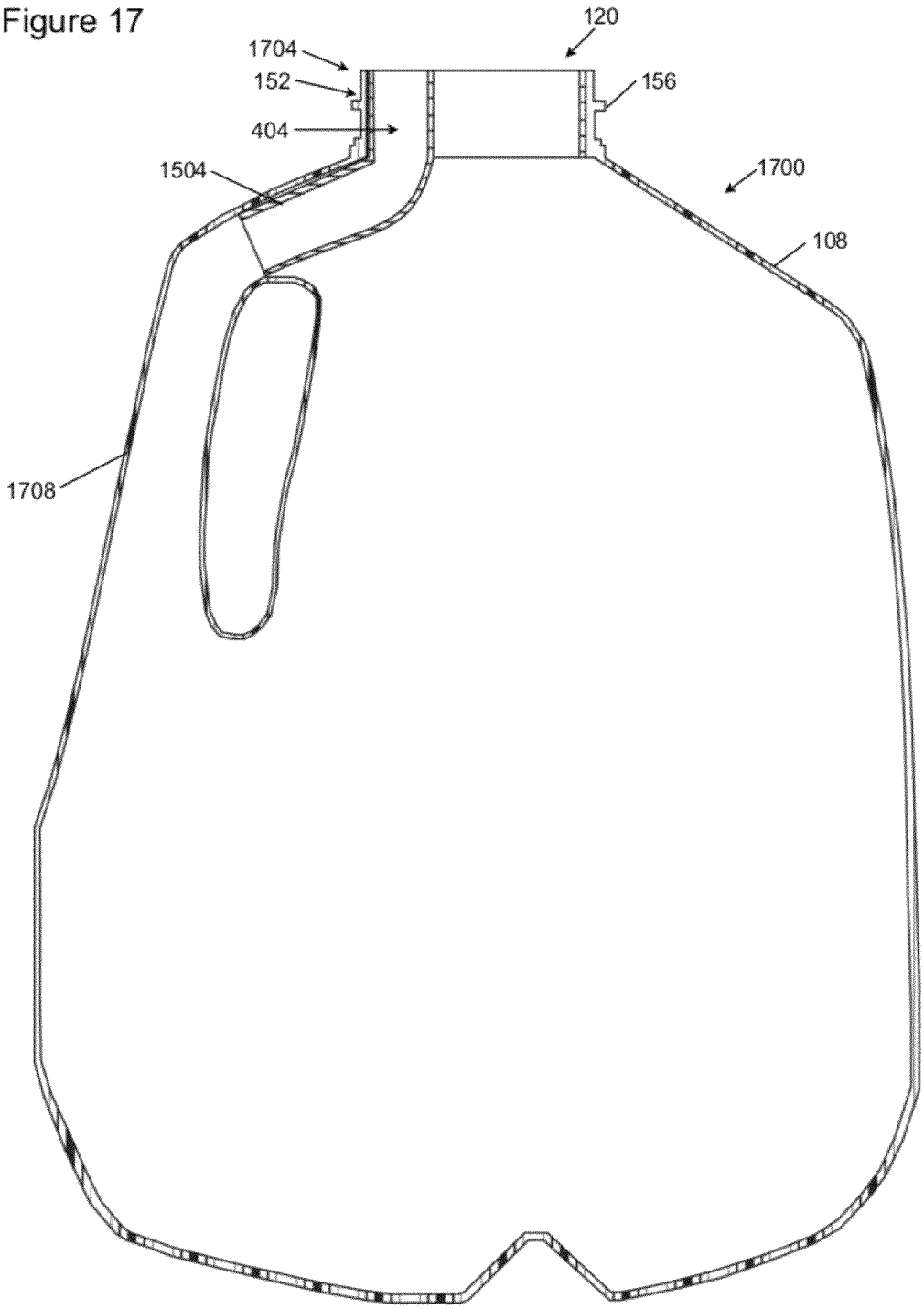
FIG. 17 is a side cross-sectional view of an embodiment described herein.
Figure 26:
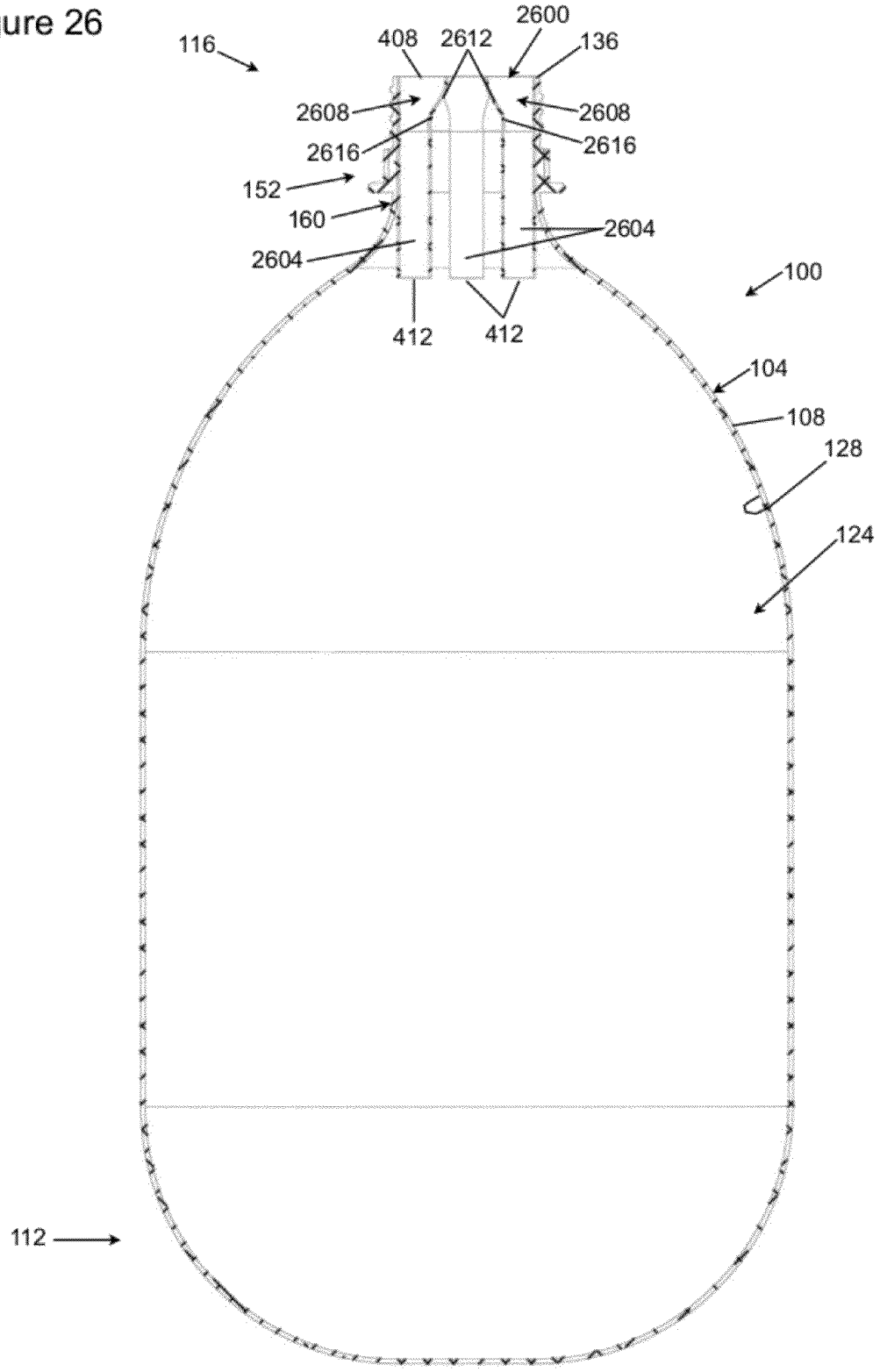
FIG. 26 is a side cross-sectional of an embodiment described herein.
Figure 27:
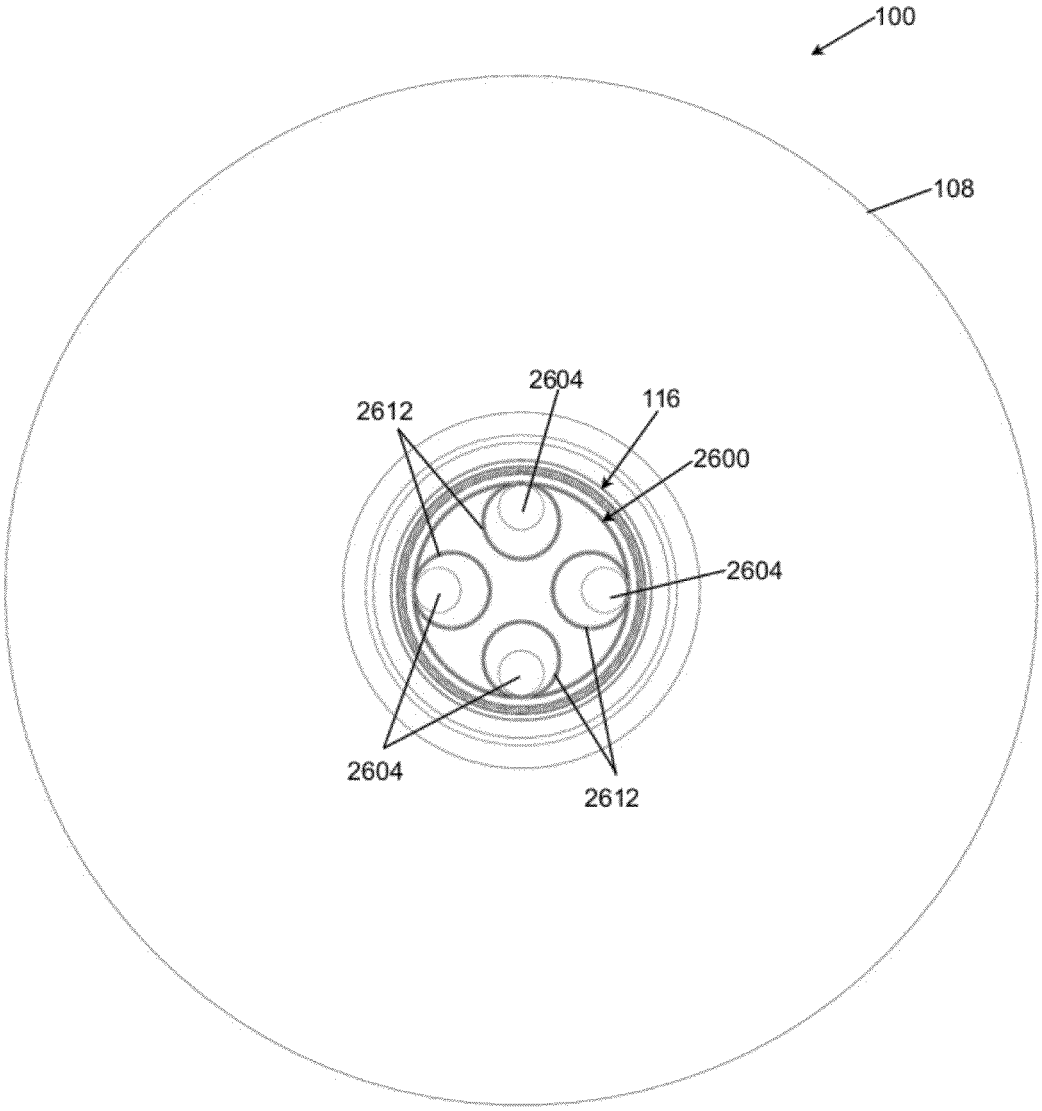
FIG. 27 is a top elevation view of the device shown in FIG. 26.

With reference now to FIG. 17, and in accordance with at least one embodiment of the present disclosure, a bottle in the form of a jug 1700 is shown that includes a pressure equalizer 1704 comprising a single air tube 404 having a curved distal portion 1504. The curved distal portion 1504 extends into a handle 1708 of the jug 1700. Accordingly, a single air tube located opposite the side of pour can prevent the glugging effect. FIGS. 18 and 19 illustrate top and bottom perspective views, respectively, of an insert type of pressure equalizer 1704.

Referring now to FIGS. 20-23, and in accordance with at least one embodiment, a series of pressure equalizers are shown that include a single air tube having cross-sectional area shapes different from a circle. More particularly, FIGS. 20 and 21 illustrate a pressure equalizer 2000 with air tubes 2004, wherein the air tubes 2004 comprise a substantially rectangular cross-sectional area shape. FIGS. 22 and 23 illustrate a pressure equalizer 2200 with air tubes 2204, wherein the air tubes 2204 comprise a substantially triangular cross-sectional area shape. Here, it noted that the air tubes 2004 and 2204 comprise a perimeter portion 2008 and 2208 that substantially match the curvature of a portion of the perimeter member 416. That is, an arc 1310 is associated with the perimeter portions 2008 and 2208 that substantially match the curvature of a portion of the perimeter member 416 (for an insert) or the interior surface 128 of the bottleneck 152 (for an integrally formed pressure equalizer).

Referring now to FIGS. 24 and 25, a pressure equalizer 2400 is shown that includes a single air tube 404, wherein the air tube is interiorly offset from perimeter wings, the perimeter wings constituting modified perimeter member. For pressure equalizer 2400, the air tube 404 resides along struts 2408 that interconnect the air tube 404 to a first perimeter wing 2404*a* and a second perimeter wing 2404*b*. As with other embodiments described herein, for embodiments wherein the pressure equalizer 2400 is an insert, the perimeter wings 2404*a* and 2404*b* are configured to fixedly engage (e.g., by friction fit, threads, welding, adhesive, and/or fastener) the interior surface 128 of the bottleneck 152 of the bottle 100. Alternatively, if the pressure equalizer 2400 is integrally formed as part of the bottle 100, then struts 2408 interconnect the air tube 404 to the interior surface 128 of the bottleneck 152.

For the various embodiments of the pressure equalizers described above, the cross-sectional areas of the air tubes are depicted as being substantially constant from the upper inlet rim 408 to the lower end edge 412 of each air tube 404. However, it is to be understood that the cross-sectional areas may vary. Moreover, with reference now to FIGS. 26-29, and in accordance with at least one embodiment of the present disclosure, a pressure equalizer 2600 is provided having one or more air tubes 2604, wherein the air tubes 2604 include a proximal end 2608 with a flared portion 2612. Accordingly, because of the presence of the flared portion 2612, the cross-sectional area of the air tube 2604 decreases along at least a portion of the longitudinal length of the air tube 2604. That is, from the upper inlet rim 408 to the flared portion base 2616. In at least one embodiment, the flared portion 2612 extends distally no further than the bottleneck base 160 of the bottleneck 152. From the flared portion base 2616 of the flared portion 2612 to the lower end edge 412 of the air tubes 2604, the air tubes 2604 have a substantially constant air tube diameter $D_{Air\ Tube}$ that resides within the prescribed range of about 2% to 50% of the bottleneck diameter $D_{Bottleneck}$. In addition, the length of the air tubes 2604 preferably also be within the prescribed values given above (that is, $L_{Bottleneck} \leq L_{Air\ Tube} \leq 25\%\ B_L$). Use of a flared portion 2612 as part of the air tubes 2604 is advantageous because it assists in routing the liquid away from the top of the air tubes, thereby mitigating the top of the air tubes from being flooded by the liquid exiting the container, allowing air to more easily enter the air inlet tubes.

Figure 28:
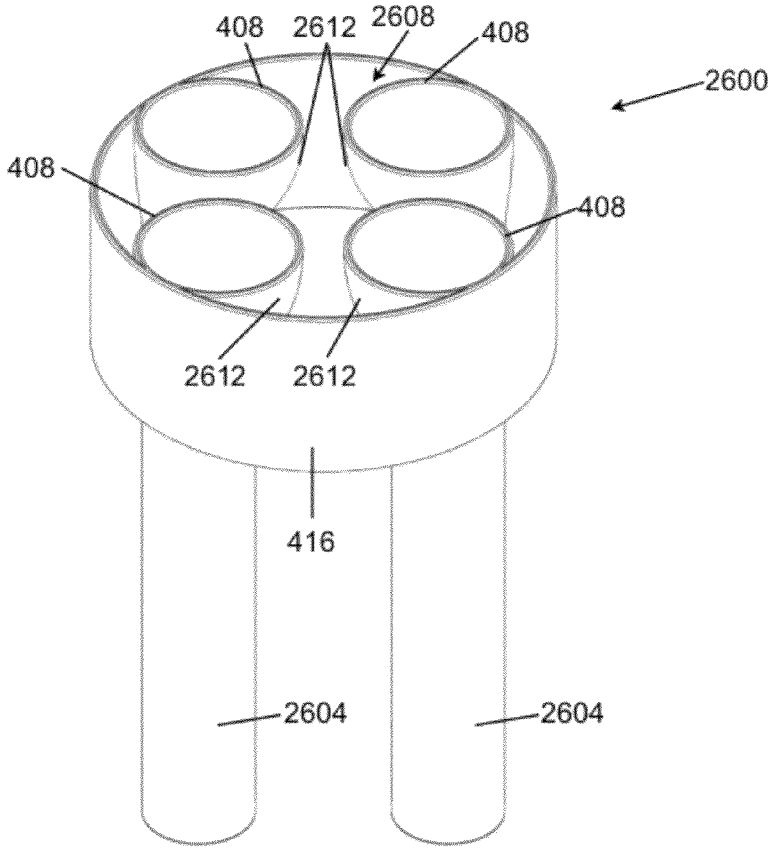
FIG. 28 is a top perspective view of an embodiment described herein.
Figure 29:
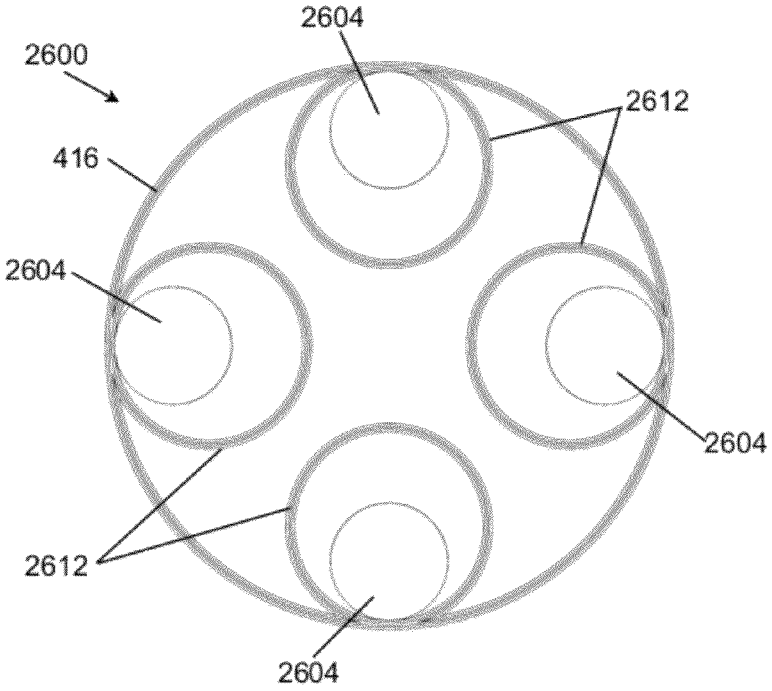
FIG. 29 is a top elevation view of the device shown in FIG. 28.

With reference now to FIGS. 28 and 29, the pressure equalizer 2600 is depicted as an insert. Accordingly, for embodiments wherein the pressure equalizer 2600 is an insert, the perimeter member 416 is configured to fixedly engage (e.g., by friction fit, threads, welding, adhesive, and/or fastener) the interior surface 128 of the bottleneck 152 of the bottle 100. Alternatively, if the pressure equalizer 2600 is integrally formed as part of the bottle 100, then the air tubes 2604 are positioned directly around the interior surface 128 of the bottleneck 152.

Figure 30:
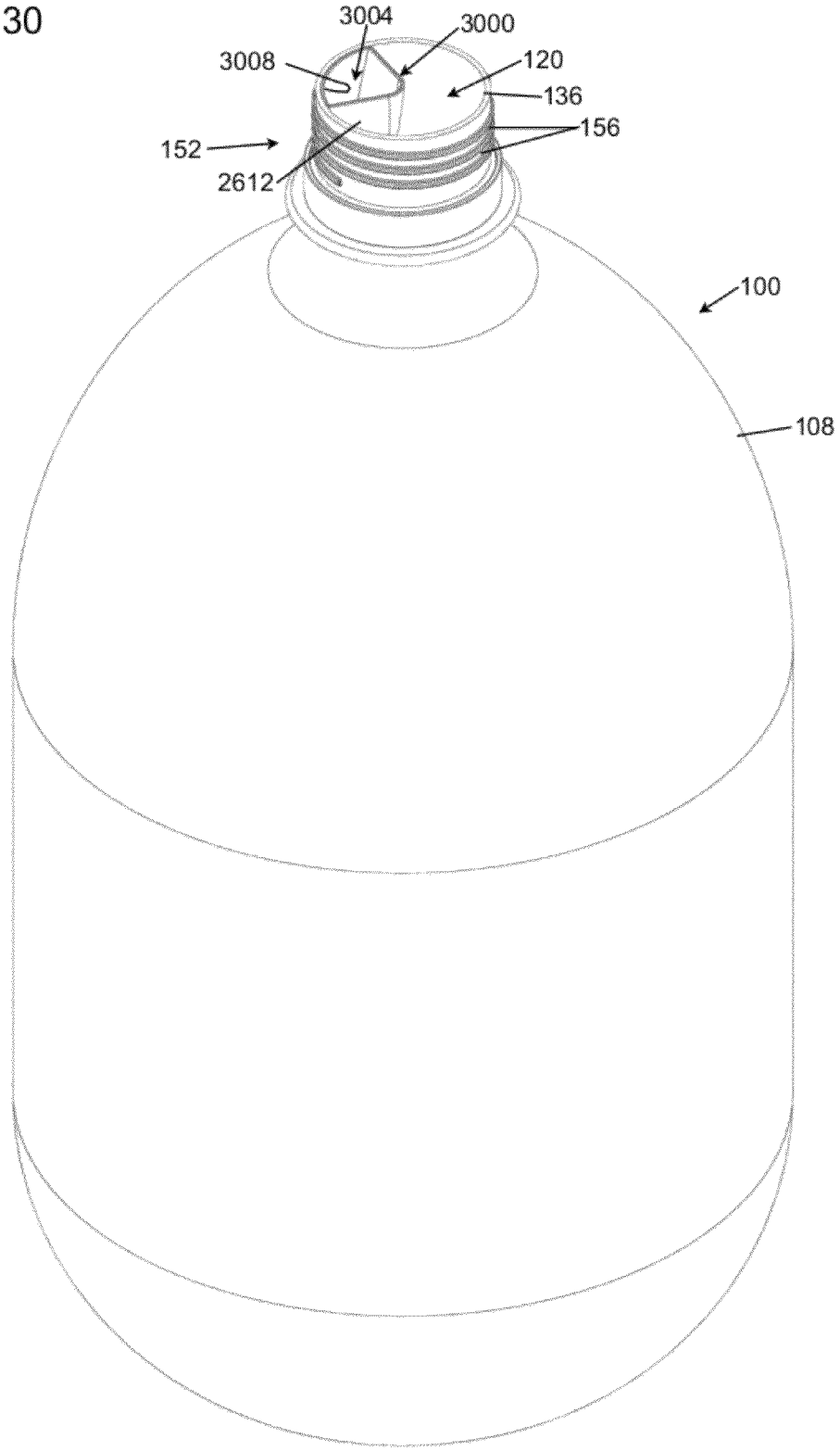
FIG. 30 is a top perspective view of an embodiment described herein.
Figure 31:
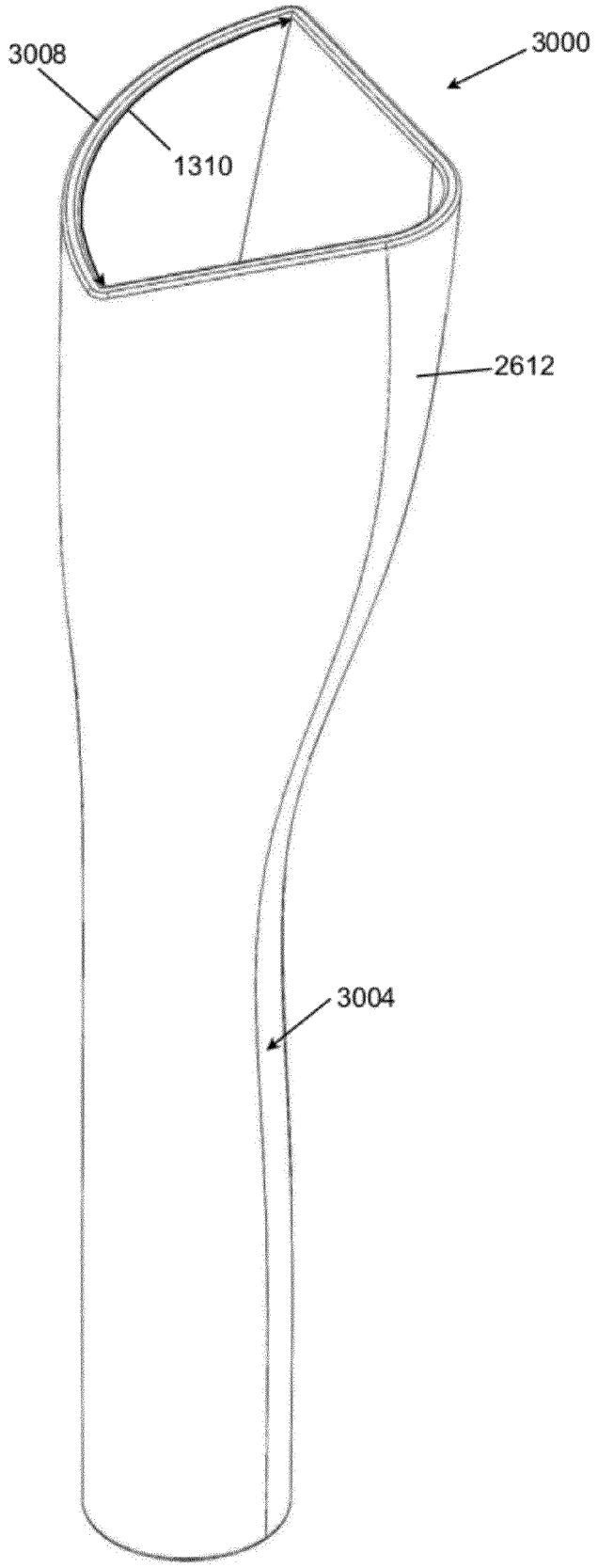
FIG. 31 is a top perspective view of an embodiment described herein and forming a portion of the device shown in FIG. 30.

Referring now to FIG. 30, and in accordance with at least one embodiment of the present disclosure, a bottle 100 is shown that includes pressure equalizer 3000 that includes a single air tube 3004. As best seen in FIG. 31, the single air tube 3004 includes a flared portion 2612. In at least one embodiment, the flared portion includes an arc 1310 associated with a perimeter portion 3008 that substantially matches the curvature of a portion of the perimeter member 416 (for an insert) or the interior surface 128 of the bottleneck 152 (for an integrally formed pressure equalizer). Use of a flared portion 2612 as part of the air tube 3004 is advantageous because a single air tube 3004 can be associated with a bottle without a handle and the liquid can be poured without glugging and without regard to the direction that the bottle is oriented.

Referring now to FIGS. 32 and 33, in at least one embodiment a pressure equalizer 3200 includes a perimeter air inlet channel 3204 and one or more air tubes 3208. The air tubes 3208 are in fluid communication with the perimeter air inlet channel 3204 to facilitate flow of air from the perimeter air inlet channel 3204 to the one or more air tubes 3208 when liquid is being poured from a bottle having the pressure equalizer 3200. As shown in FIG. 32, the perimeter air channel 3204 includes a perimeter member 416, a base 3300 (as best seen in FIG. 33), and an interior channel wall 3216 that is substantially parallel to the perimeter member 416, but offset radially to the interior of the perimeter member 416. The base 3300 may be a sloped region between the perimeter member 416 and the interior channel wall 3216. Again, for embodiments wherein the pressure equalizer 3200 is an integral portion of a bottle, the perimeter member 416 may be a portion of the bottle wall 104, such as a portion of the bottleneck 152. In at least one embodiment, an upper rim 3228 of the perimeter air inlet channel 3204 substantially corresponds to the bottle rim 136 when the pressure equalizer 3200 is associated with a bottle 100.

Referring now to FIG. 33, in at least one embodiment, the upper extent 3304 of the air tube 3208 terminates at the base 3300 of the perimeter air channel 3204. Alternatively, the upper extent 3304 of the air tube may be situated above the base 3300 of the perimeter air channel 3204, but below the upper rim 3228 of the perimeter air channel 3204.

As depicted in FIG. 32, a channel top 3220 of the perimeter air inlet channel 3204 may be open. Alternatively, at least portions of the channel top 3220 may be closed (not shown) while one or more other portions of the channel top are open.

Still referring to FIGS. 32 and 33, in use, regardless of the direction the bottle is oriented for pouring of the liquid relative to the one or more air inlet tubes 3208, air can enter the bottle via the perimeter air inlet channel 3204 and the one or more air tubes 3208 as fluid is poured from the bottle via exit channel 3224.

Referring now to FIGS. 34-37, in at least one embodiment, a pressure equalizer 3400 includes a plurality of air tubes 3208 fluidly interconnected to a perimeter air channel 3204, wherein the perimeter air channel 3204 may comprise one or more flow blocks 3404. More particularly, the pressure equalizer 3400 includes a plurality of air tubes 3208 that are interconnected to the perimeter air channel 3204 at its base 3300. The perimeter air channel 3204 includes flow blocks 3404 for preventing migration of liquid around the perimeter air channel 3204 when a bottle using the pressure equalizer 3400 is tipped for pouring a liquid from the bottle. At least one air tube of the plurality of air tubes 3208 is situated circumferentially between the flow blocks 3404 around the perimeter air channel 3204.

Figure 38:
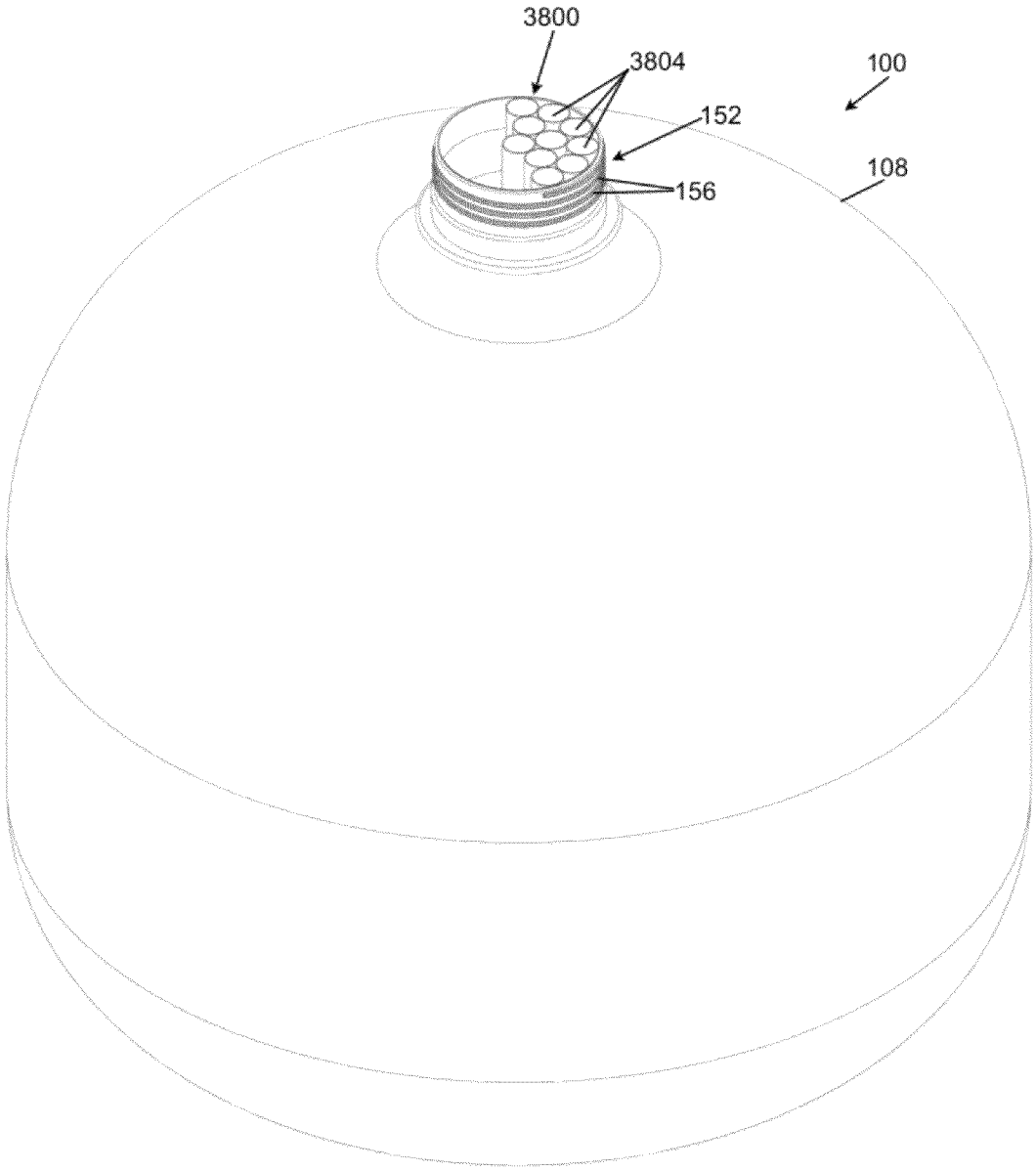
FIG. 38 is a side perspective view of an embodiment described herein.
Figure 39:
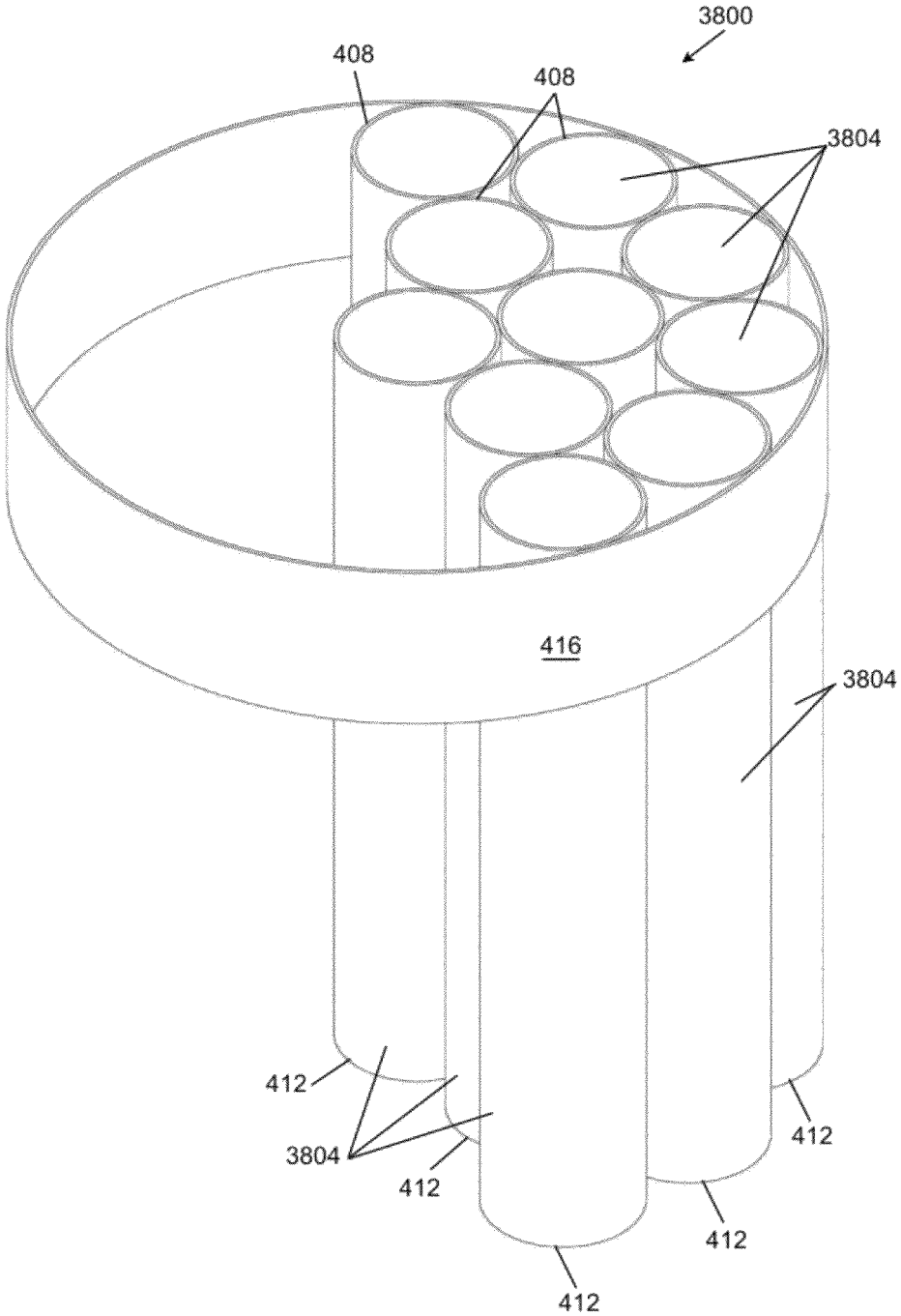
FIG. 39 is a top perspective view of an embodiment described herein.

Referring now to FIGS. 38 and 39, in at least one embodiment of the present disclosure, a pressure equalizer 3800 is shown that includes a plurality of air tubes 3804. Although not required, the air tubes are shown clustered within approximately one half of the bottleneck 152. The air tubes 3804 preferably have an air tube length $L_{Air\ Tube}$ within the prescribed values given above (that is, $L_{Bottleneck} \leq L_{Air\ Tube} \leq 25\%\ B_L$). In addition, each of the air tubes 3804 preferably has an air tube diameter $D_{Air\ Tube}$ of between about 2% to 50% of the bottleneck diameter $D_{Bottleneck}$. For the pressure equalizer 3800 shown in FIGS. 38 and 39, there are ten separate air tubes 3804 shown. However, it is to be understood that greater or fewer than ten separate air tubes 3804 are within the scope of the present embodiment. The air tubes 3804 may have uniform air tube diameters, or they may have differing air tube diameters. In addition, one or more of the air tubes 3804 may have flared portions. At least a portion of the upper inlet rim 408 of the air tubes 3804 is preferably situated within a rim proximity distance that is less than or equal to 5% of the bottleneck length $L_{Bottleneck}$.

Referring still to FIGS. 38 and 39, and as with other embodiments described and shown herein, when in use, air may enter the bottle 100 through one or more of the air tubes 3804. In addition, liquid may exit the bottle 100 through one or more of the air tubes 3804 as air enters other air tubes 3804.

However, the existence of multiple air tubes 3804 facilitates separate flow paths for air to enter the bottle 100, thereby enabling air to find a path into the bottle 100 while the liquid exits the bottle 100.

With reference to FIG. 39, the pressure equalizer 3800 is depicted as an insert. Accordingly, for embodiments wherein the pressure equalizer 3800 is an insert, the perimeter member 416 is configured to fixedly engage (e.g., by friction fit, threads, welding, adhesive, and/or fastener) the interior surface 128 of the bottleneck 152 of the bottle 100. Alternatively, if the pressure equalizer 3800 is integrally formed as part of the bottle 100, then the air tubes 3804 are positioned around a portion of the interior surface 128 of the bottleneck 152, and a number of the air tubes 3804 may be connected or interconnected to each other, particularly those air tubes 3804 residing within the inner interior portion of the bottleneck 152 and not situated directly adjacent the interior surface 128 of the bottleneck 152.

Figure 40:
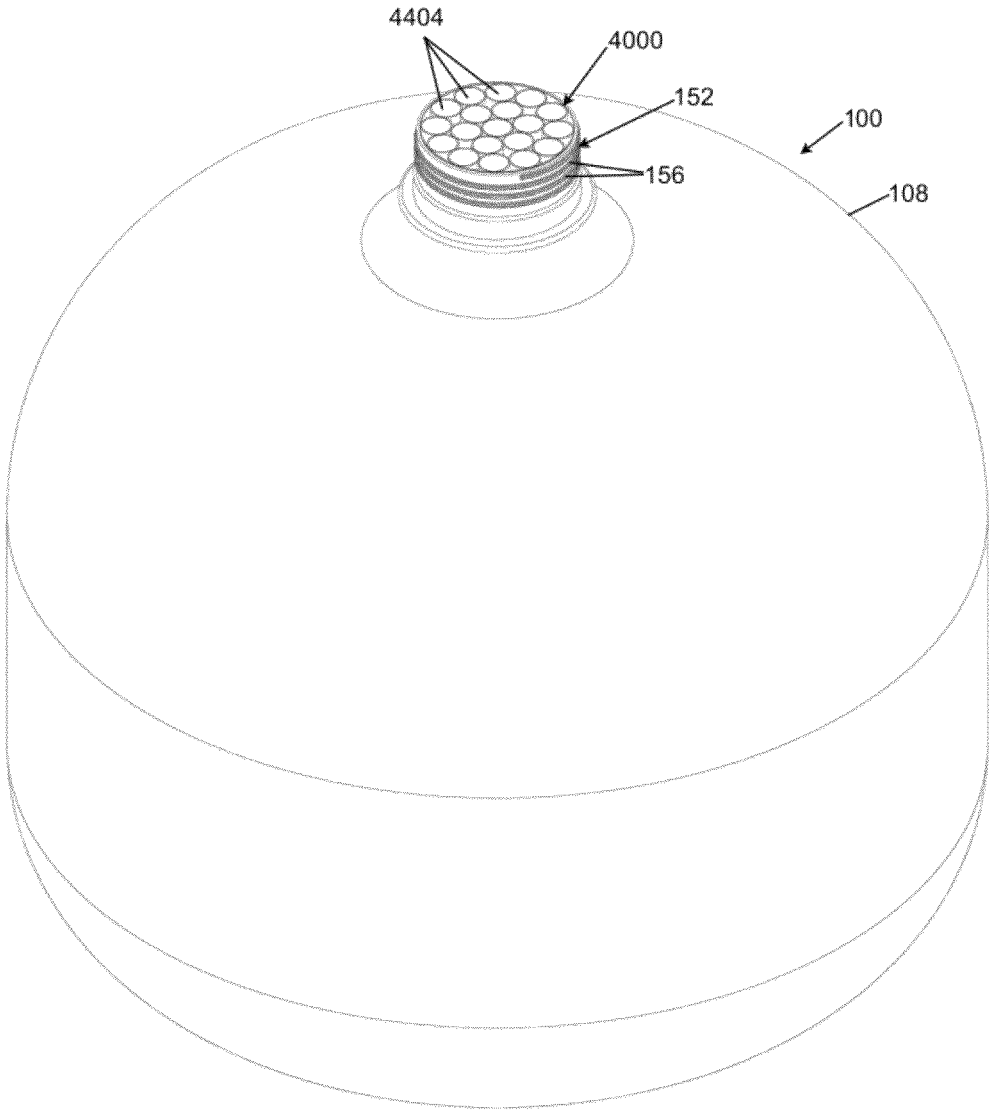
FIG. 40 is a side perspective view of an embodiment described herein.
Figure 41:
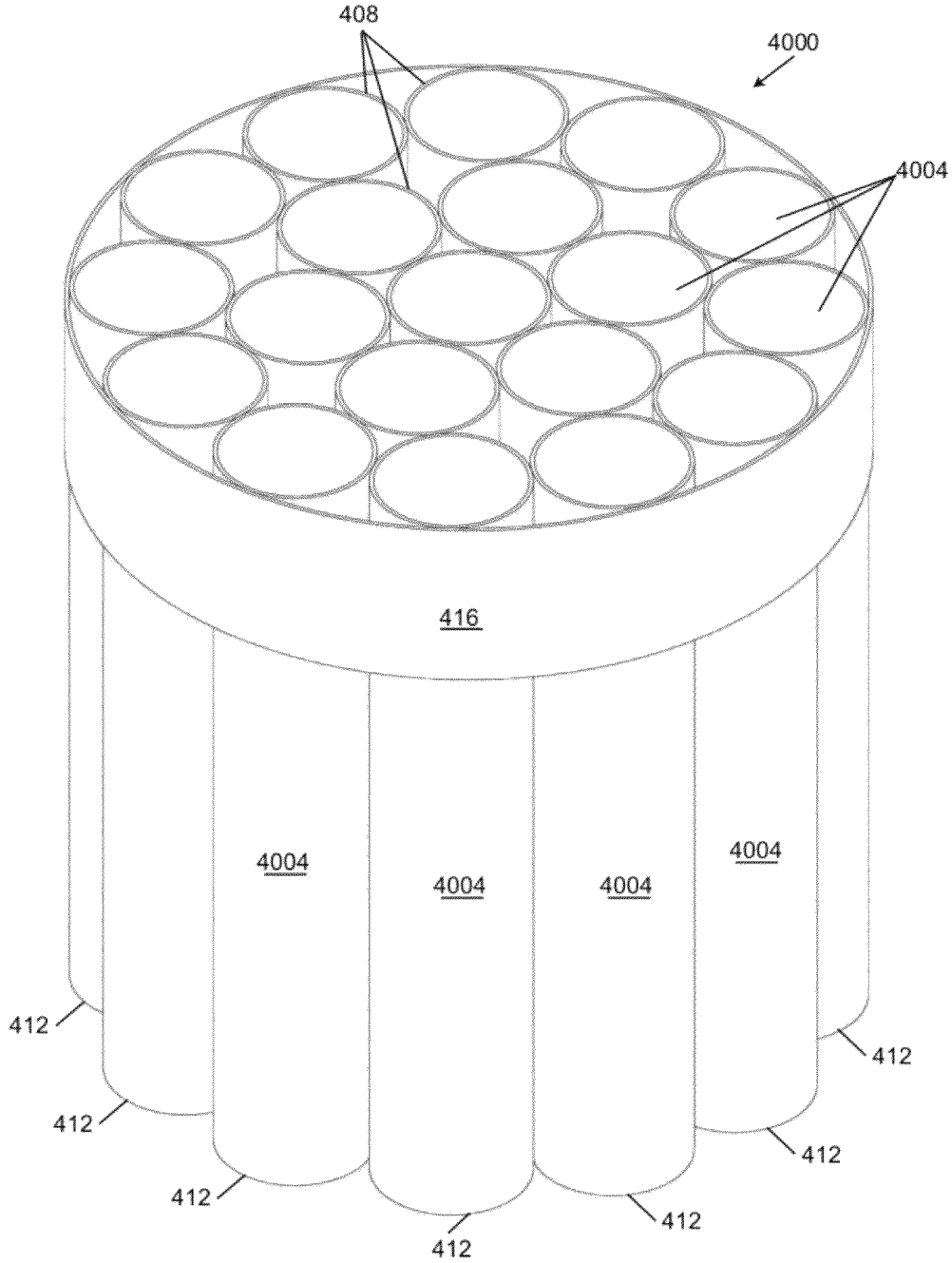
FIG. 41 is a top perspective view of an embodiment described herein.

Referring now to FIGS. 40 and 41, in at least one embodiment of the present disclosure, a pressure equalizer 4000 is shown that includes a plurality of air tubes 4004. The pressure equalizer 4000 has particular application to situations wherein a high volume and/or a high flow rate of liquid is anticipated. As can be seen, the plurality of air tubes 4004 occupies a significant portion of the bottleneck 152. The air tubes 4004 preferably have an air tube length $L_{Air\ Tube}$ within the prescribed values given above (that is, $L_{Bottleneck} \leq L_{Air\ Tube} \leq 25\%\ B_L$). In addition, each of the air tubes 4004 preferably has an air tube diameter $D_{Air\ Tube}$ of between about 2% to 50% of the bottleneck diameter $D_{Bottleneck}$. For the pressure equalizer 4000 shown in FIGS. 40 and 41, there are nineteen separate air tubes 4004 shown. However, it is to be understood that greater or fewer than nineteen separate air tubes 4004 are within the scope of the present embodiment. The air tubes 4004 may have uniform air tube diameters, or they may have differing air tube diameters. In addition, one or more of the air tubes 4004 may have flared portions.

With reference to FIG. 41, the pressure equalizer 4000 is depicted as an insert. Accordingly, for embodiments wherein the pressure equalizer 4000 is an insert, the perimeter member 416 is configured to fixedly engage (e.g., by friction fit, threads, welding, adhesive, and/or fastener) the interior surface 128 of the bottleneck 152 of the bottle 100. Alternatively, if the pressure equalizer 4000 is integrally formed as part of the bottle 100, then the air tubes 4004 are positioned around a portion of the interior surface 128 of the bottleneck 152, and a number of the air tubes 4004 may be connected or interconnected to each other, particularly those air tubes 4004 residing within the inner interior portion of the bottleneck 152 and not situated directly adjacent the interior surface 128 of the bottleneck 152.

Referring still to FIGS. 40 and 41, and as with other embodiments described and shown herein, when in use, air may enter the bottle 100 through one or more of the air tubes 4004. In addition, liquid may exit the bottle 100 through one or more of the air tubes 4004 as air enters other air tubes 4004. However, the existence of multiple air tubes 4004 facilitates separate flow paths for air to enter the bottle, thereby enabling air to find a path into the bottle 100 while the liquid exits the bottle 100.

Referring now to FIGS. 42 and 43, in at least one embodiment of the present disclosure, a pressure equalizer 4200 is shown that includes a plurality of air tubes 4204 that resided within an air tube assembly 4208. As with pressure equalizer 4000, the pressure equalizer 4200 has particular application to situations wherein a high volume and/or a high flow rate of liquid is anticipated. As can be seen, the plurality of air tubes 4204 occupy a significant portion of the bottleneck 152. The air tubes 4204 preferably have an air tube length $L_{Air\ Tube}$ within the prescribed values given above (that is, $L_{Bottleneck} \leq L_{Air\ Tube} \leq 25\%\ B_L$). In addition, each of the air tubes 4204 preferably has an air tube diameter $D_{Air\ Tube}$ (or equivalent air tube diameter as described herein) of between about 2% to 50% of the bottleneck diameter $D_{Bottleneck}$. For the pressure equalizer 4200 shown in FIGS. 42 and 43, there are three concentric rings of air tubes with a further central air tube. The air tubes 4204 may have substantially uniform cross-sectional areas, or they may have differing cross-sectional areas with differing shapes. In addition, the air tubes 4204 residing within the air tube assembly 4208 may form a pattern or they may be randomly arranged. In addition, one or more of the air tubes 4204 may have flared portions.

With reference to FIG. 43, the pressure equalizer 4200 is depicted as an insert. Accordingly, for embodiments wherein the pressure equalizer 4200 is an insert, the perimeter member 416 is configured to fixedly engage (e.g., by friction fit, threads, welding, adhesive, and/or fastener) the interior surface 128 of the bottleneck 152 of the bottle 100. Alternatively, if the pressure equalizer 4200 is integrally formed as part of the bottle 100, then the air tubes 4204 are positioned around a portion of the interior surface 128 of the bottleneck 152, and a number of the air tubes 4204 may be connected or interconnected to each other, particularly those air tubes 4204 residing within the inner interior portion of the bottleneck 152 and not situated directly adjacent the interior surface 128 of the bottleneck 152. Sidewalls between the air tubes 4204 may be shared.

Referring still to FIGS. 42 and 43, and as with other embodiments described and shown herein, when in use, air may enter the bottle 100 through one or more of the air tubes 4204. In addition, liquid may exit the bottle 100 through one or more of the air tubes 4204 as air enters other air tubes 4204. However, the existence of multiple air tubes 4204 facilitates separate flow paths for air to enter the bottle, thereby enabling air to find a path into the bottle 100 while the liquid exits the bottle 100.

Figure 44:
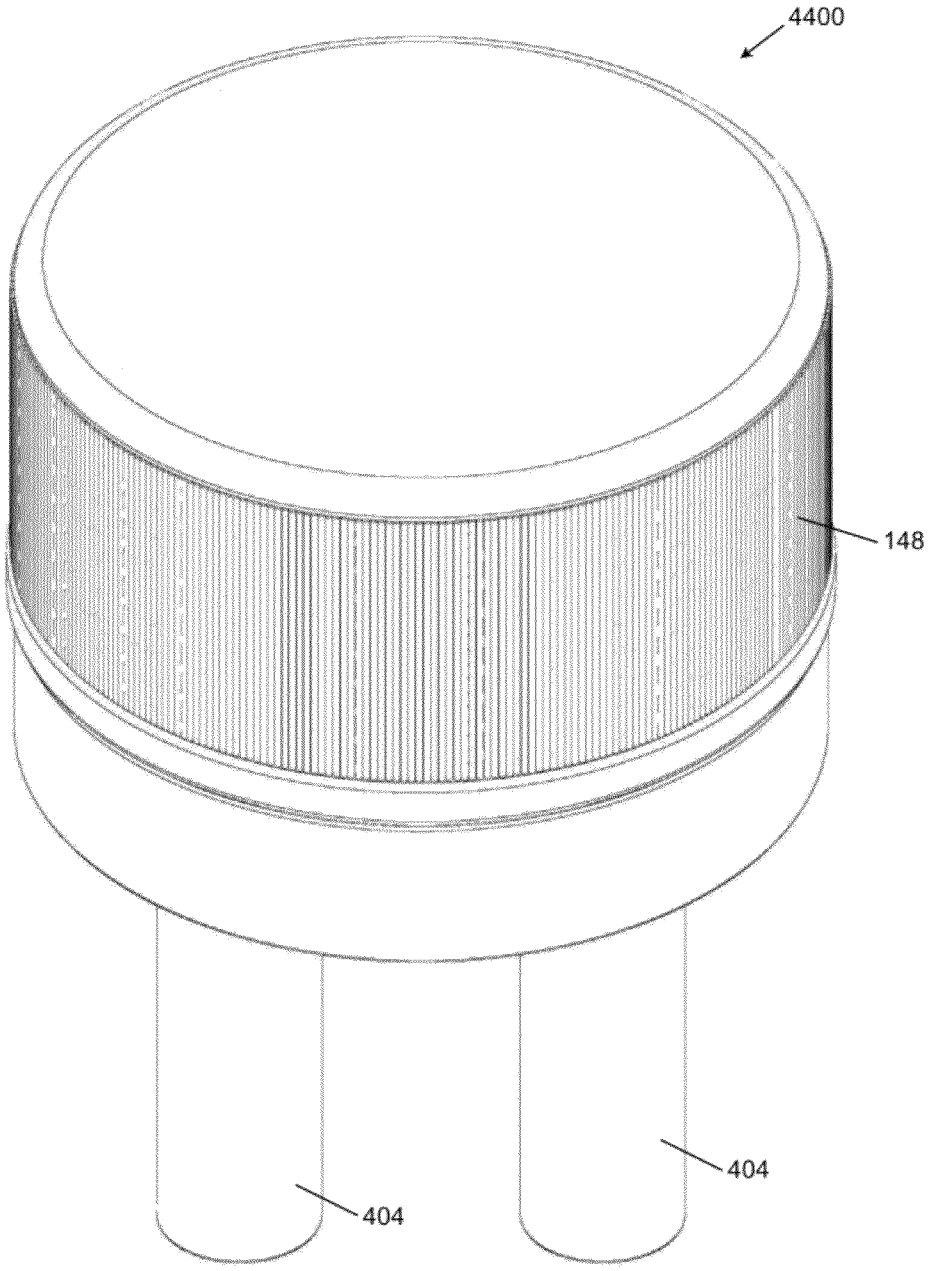
FIG. 44 is a top perspective view of an embodiment described herein.

Referring now to FIG. 44, and in accordance with at least one embodiment of the present disclosure, a carrier cap 4400 is shown that incorporates a cap 148 with a pressure equalizer, such as any one of the pressure equalizers described herein. By attaching a pressure equalizer to the inside of a bottle cap 148, a snap-capper or a rotary-chuck capping machine can install the pressure equalizer at the same time as the bottle is being capped, using the same machinery. Such a configuration provides time and cost savings for utilization of the pressure equalizers described herein. The pressure equalizer insert is attached to the cap in a similar way as the safety strip that is currently used to secure caps on bottles, such as two-liter beverage bottles. Accordingly, caps with pressure equalizer inserts are operatively associated with a bottle 100 when the caps 148 are applied with capping machines that insert the pressure equalizers with the caps 148 after filling the bottles 100. The bottle 100 is then ready for use by the consumer, and the previously installed pressure equalizer is in place for mitigating glugging when the liquid is poured from the bottle 100. Accordingly, in use, the pressure equalizer breaks free from the cap 148 when the consumer twists off the cap 148 for the first time in the same way that the consumer breaks the safety strip.

Figure 45C:
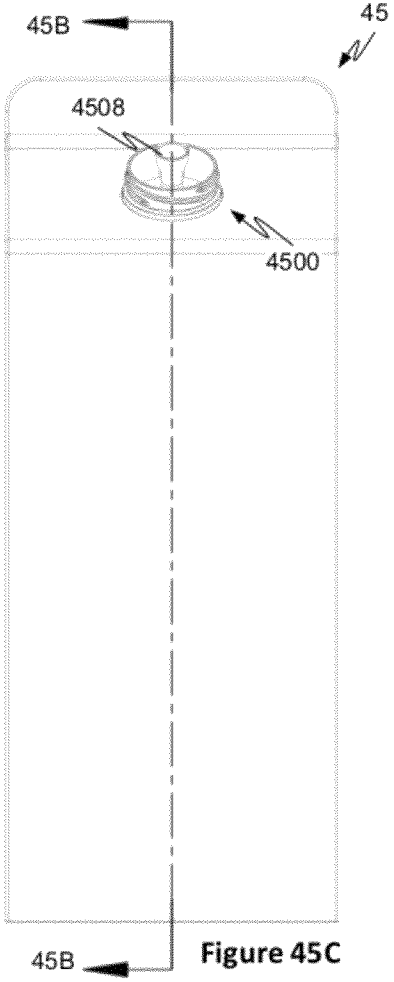
FIG. 45C is a front elevational view of a container according to embodiments described herein.
Figure 45B:
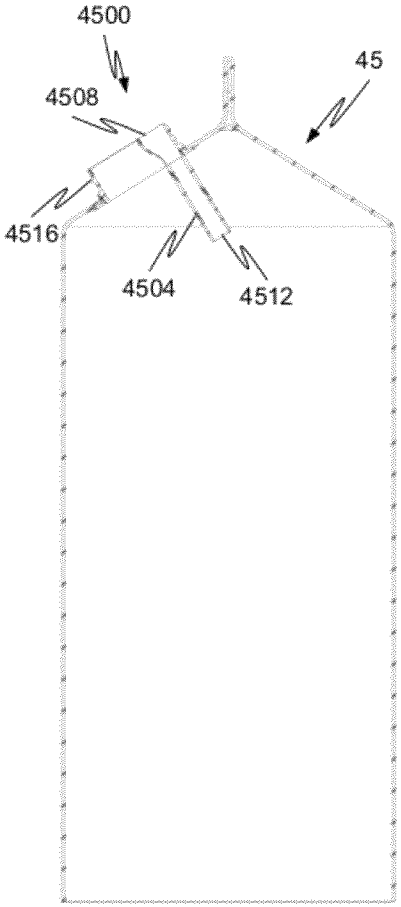
FIG. 45B is a cross-sectional side view (taken along line 45B as shown in FIG. 45C) of a container according to embodiments described herein.
Figure 45A:
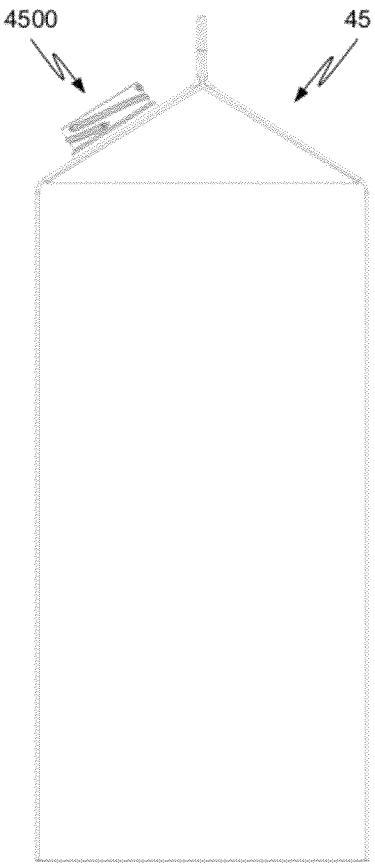
FIG. 45A is a side elevational view of a container according to embodiments described herein.
Figure 46C:
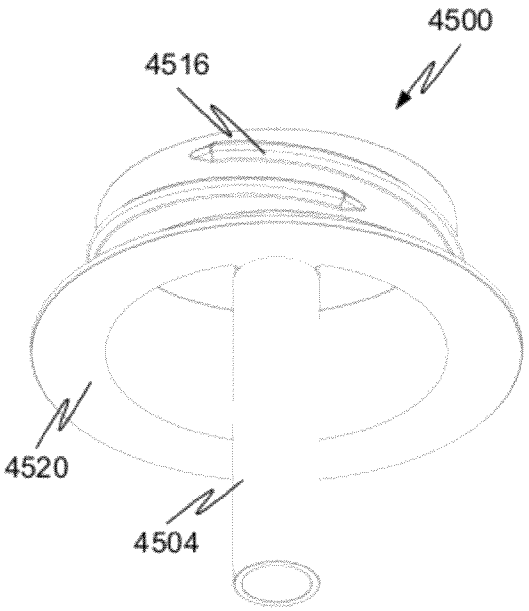
FIG. 46C is a bottom perspective view of an embodiment described herein.
Figure 46B:
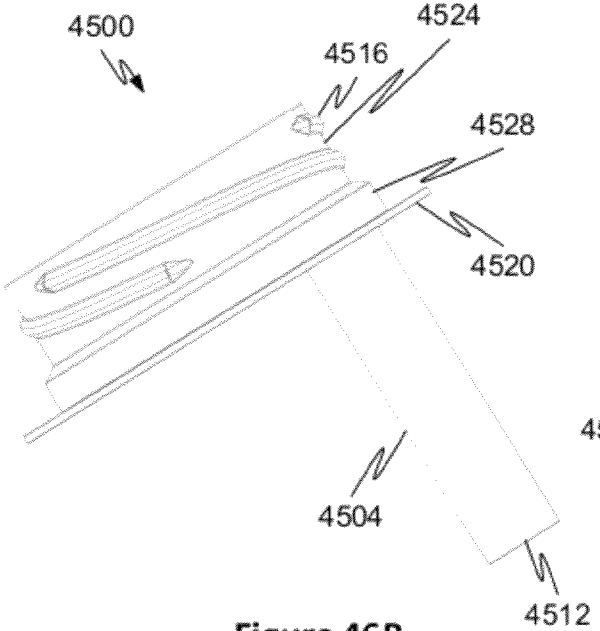
FIG. 46B is a side elevational view of an embodiment described herein.
Figure 46A:
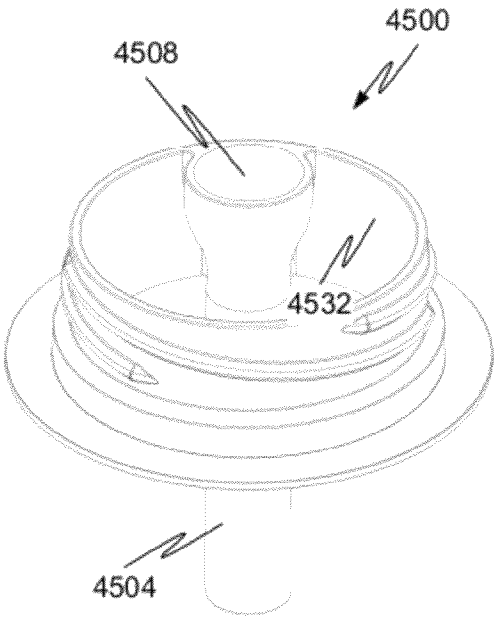
FIG. 46A is a top perspective view of an embodiment described herein.

Referring now to FIGS. 45A-C, another embodiment of a container 45 will be described in accordance with at least some embodiments of the present disclosure. Although the term "container" will be used with respect to this and other embodiments, it should be appreciated that term "container"

as well as the term "bottle" used herein can both be used to refer to any liquid holding and/or dispensing unit.

The container 45, in some embodiments, corresponds to traditional gable top packaging. In this embodiment, the container 45 comprises an integral pressure equalizer 4500. The pressure equalizer 4500 may be manufactured such that its outer surfaces which are exposed above the top of the container 45 are similar or identical to traditional spout fitments that are ultrasonically welded to the container 45. Accordingly, the pressure equalizer 4500 may be configured to be ultrasonically welded to the container 45 and, therefore, can become an integral part of the container 45.

One difference between the container 45 and other bottles discussed herein is that the container 45 does not comprise a "neck" per se. However, the "bottle length" of the container 45 may be equal to the entire length of the container 45 from its base to its top most portion within the cavity of the container 45. The "bottleneck length" of the container 45 may be equal to the height of the tilted opening of the container (e.g., from top of outer rim to bottom of outer rim).

In some embodiments, the inner surfaces of the pressure equalizer 4500 may be similar to other pressure equalizers discussed herein. As can be seen in FIGS. 45B-C and 46A-C, the pressure equalizer 4500 may comprise an air tube 4504, which extends from an upper inlet rim 4508 to a lower end edge 4512. The air tube 4504, in some embodiments may be cylindrical. In some embodiments, the air tube 4504 comprises a cross-sectional shape other than circular (e.g., elliptical, square, rectangular, triangular, etc.). In some embodiments, the air tube 4504 may have a tapered portion whereby the cross-sectional area of the air tube 4504 closer to the upper inlet rim 4508 is larger than the cross-sectional area of the air tube 4504 closer to the lower end edge 4512.

Another aspect of the pressure equalizer 4500 is that the outer surface 4524 may be configured to emulate traditional spout fitments that are integrated into containers similar to container 45. In particular, the outer surface 4524 of the pressure equalizer 4500 may comprise one or more threads 4516 at its top most portion as well as a rim 4520 positioned at some point below the threads 4516. The rim 4520 may extend beyond the outer circumference of the threads 4516 and the rim 4520 may comprise a thickness that is comparable to the thickness of the wall of the container 45. In some embodiments, a transition feature 4528 resides between the threads 4516 and the rim 4520, although a transition feature 4528 is not required.

An inner surface 4532 of the pressure equalizer 4500 may be similar to the inner surfaces of other pressure equalizers discussed herein in that the inner surface 4532 may be generally cylindrical in nature except where the cylinder is disrupted by the air tube 4504 which is integrated into the perimeter member. The difference with this pressure equalizer 4500 is that the perimeter member comprises an outer surface 4524 with features which are configured to receive a screw-on-lid rathar than to slide into the neck of a container.

In some embodiments, the air tube 4504 extends beyond the rim 4520 but is not more than three times longer than the length between the rim 4520 and top of the pressure equalizer 4500. In some embodiments, the air tube 4504 may not have a length greater than twice the length of the inner cylindrical surface 4532 of the perimeter member.

Another aspect of the present disclosure is that the pressure equalizers descried herein do not necessarily have to be designed as inserts for containers. Rather, the pressure equalizer 4500 provides but one example of a pressure equalizer which is a spout fitment that can be ultrasonically welded to (or otherwise connected to) the container 45.

Figure 47C:
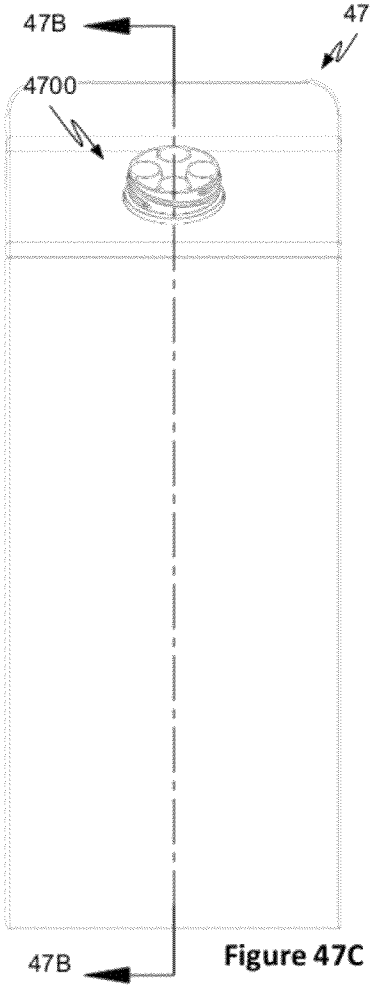
FIG. 47C is a front elevational view of a container according to embodiments described herein.
Figure 47B:
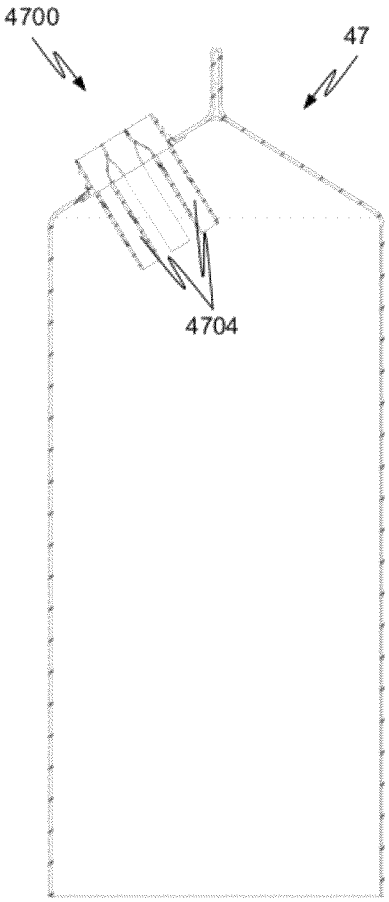
FIG. 47B is a cross-sectional side view (taken along line 47C as shown in FIG. 47C) of a container according to embodiments described herein.
Figure 47A:
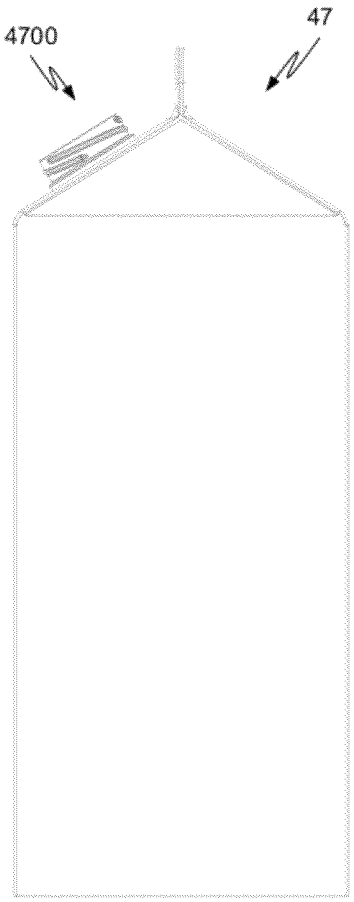
FIG. 47A is a side elevational view of a container according to embodiments described herein.
Figure 48C:
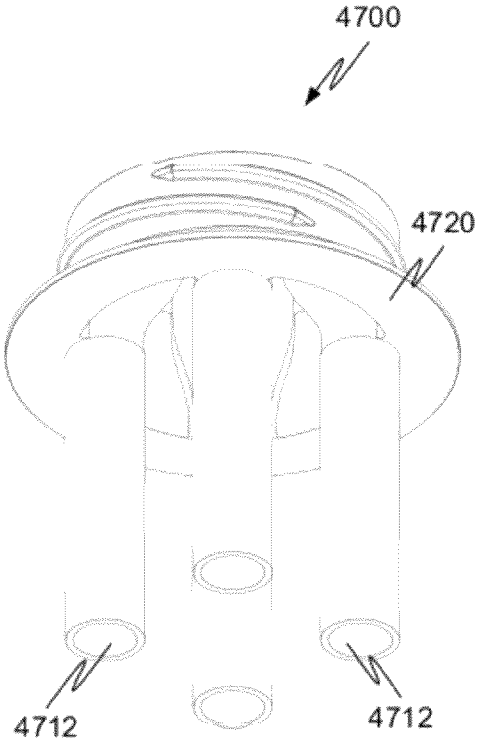
FIG. 48C is a bottom perspective view of an embodiment described herein.
Figure 48B:
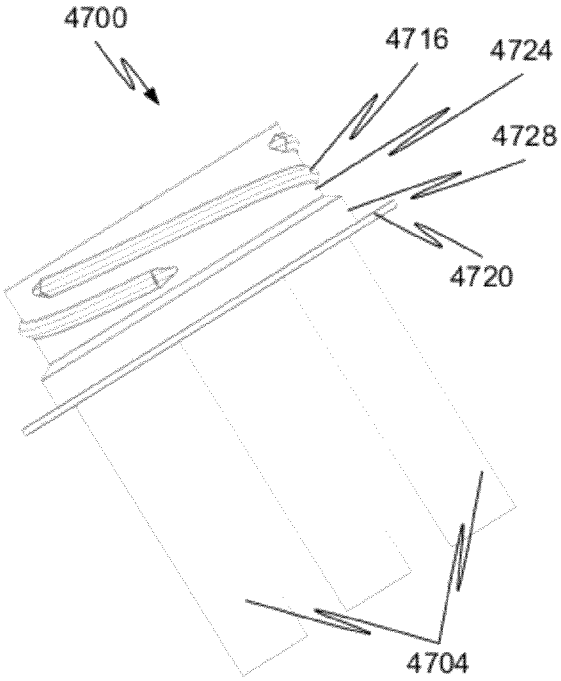
FIG. 48B is a side elevational view of an embodiment described herein.
Figure 48A:
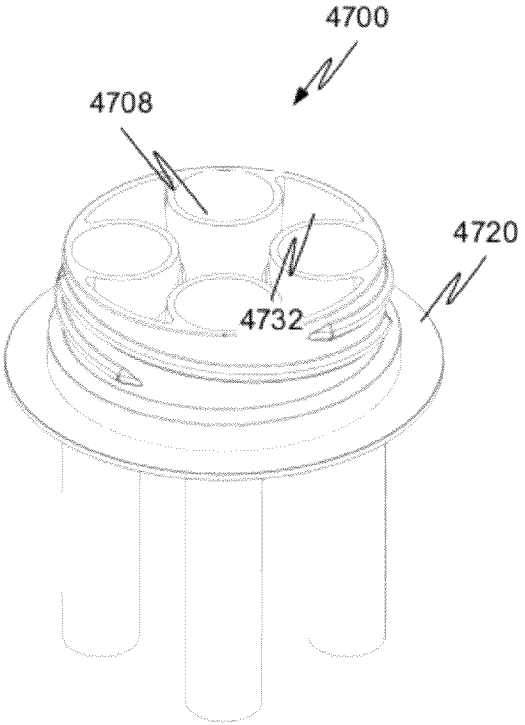
FIG. 48A is a top perspective view of an embodiment described herein.

With reference now to FIGS. 47A-C, a container 47 similar to container 45 will be described in accordance with embodiments of the present disclosure. Container 47 also comprises an integrated pressure equalizer 4700. As can be seen in FIGS. 47B-C and 48A-C, the pressure equalizer 4700 may have an outer surface 4724 that is similar or identical to the outer surface 4524 of pressure equalizer 4500. Specifically, the outer surface 4724 of pressure equalizer 4700 may comprise threads 4716, a rim 4720, and a transition feature 4728 located between the threads 4716 and rim 4720. The pressure equalizer 4700 may be configured to be integrated into the container 47 during the container 47 manufacturing process rather than being inserted into the container 47 after it has been manufactured.

The pressure equalizer 4700 differs from pressure equalizer 4500, however, in that pressure equalizer 4700 comprises a plurality of air tubes 4704 located on the inner surface 4732 of the perimeter member. Each of the air tubes 4704 may comprise an upper inlet rim 4708 and a lower end edge 4712. In some embodiments, the air tubes 4704 extend beyond the rim 4720 but are not more than three times longer than the length between the rim 4720 and top of the pressure equalizer 4700. In some embodiments, the air tubes 4704 may not have a length greater than twice the length of the inner cylindrical surface 4732 of the perimeter member.

In some embodiments, the length of each air tube 4704 may be the same within a machining tolerance. In some embodiments, the length of one air tube 4704 may differ from the length of at least one other air tube 4704. In some embodiments, the lengths of two or more air tubes 4704 may differ from each other as well as at least one other air tube 4704. In some embodiments, the air tubes 4704 are positioned symmetrically around the inner surface 4732 of the pressure equalizer 4700, while in other embodiments the air tubes 4704 may be positioned assymmetrically around the inner surface 4732.

Figure 49B:
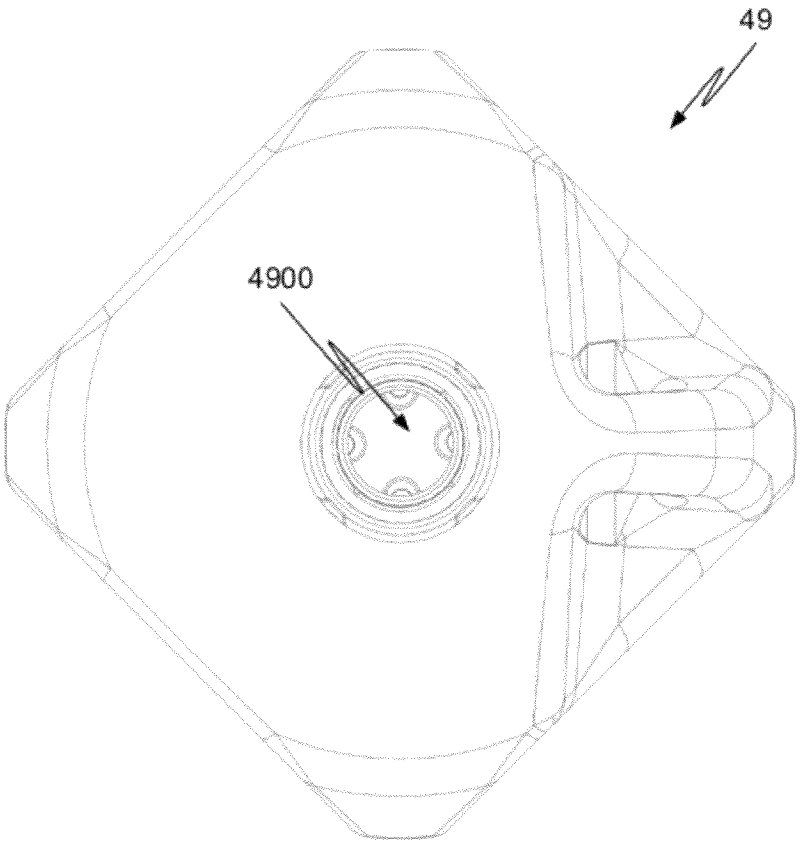
FIG. 49B is a top elevational view of a container according to embodiments described herein.
Figure 49A:
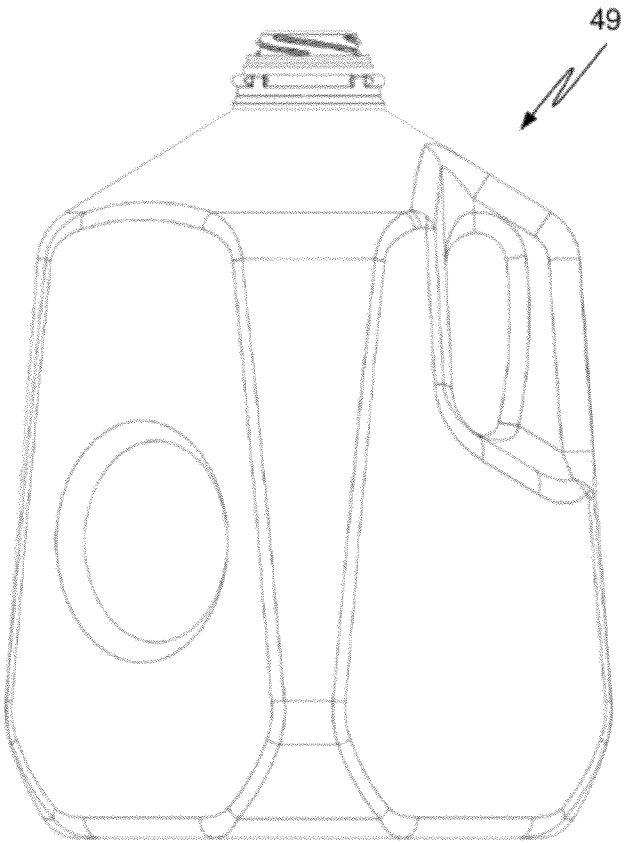
FIG. 49A is a side elevational view of a container according to embodiments described herein.
Figure 50B:
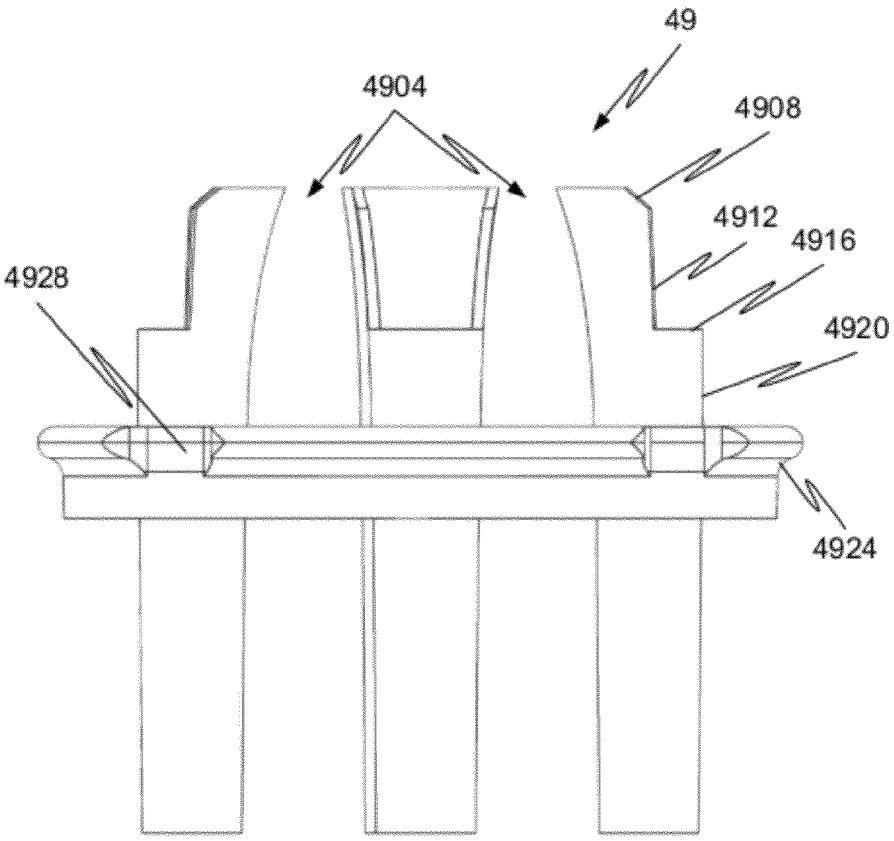
FIG. 50B is a second side elevational view of an embodiment described herein.
Figure 50A:
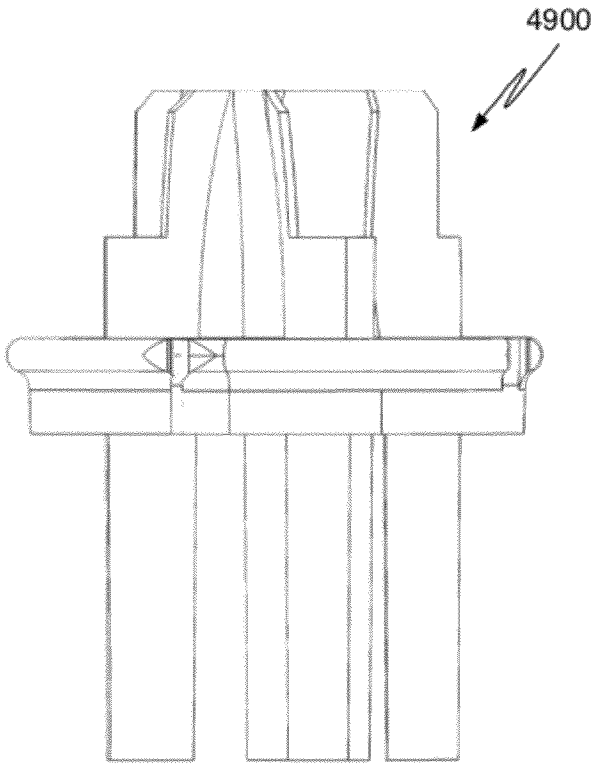
FIG. 50A is a first side elevational view of an embodiment described herein.
Figure 50C:
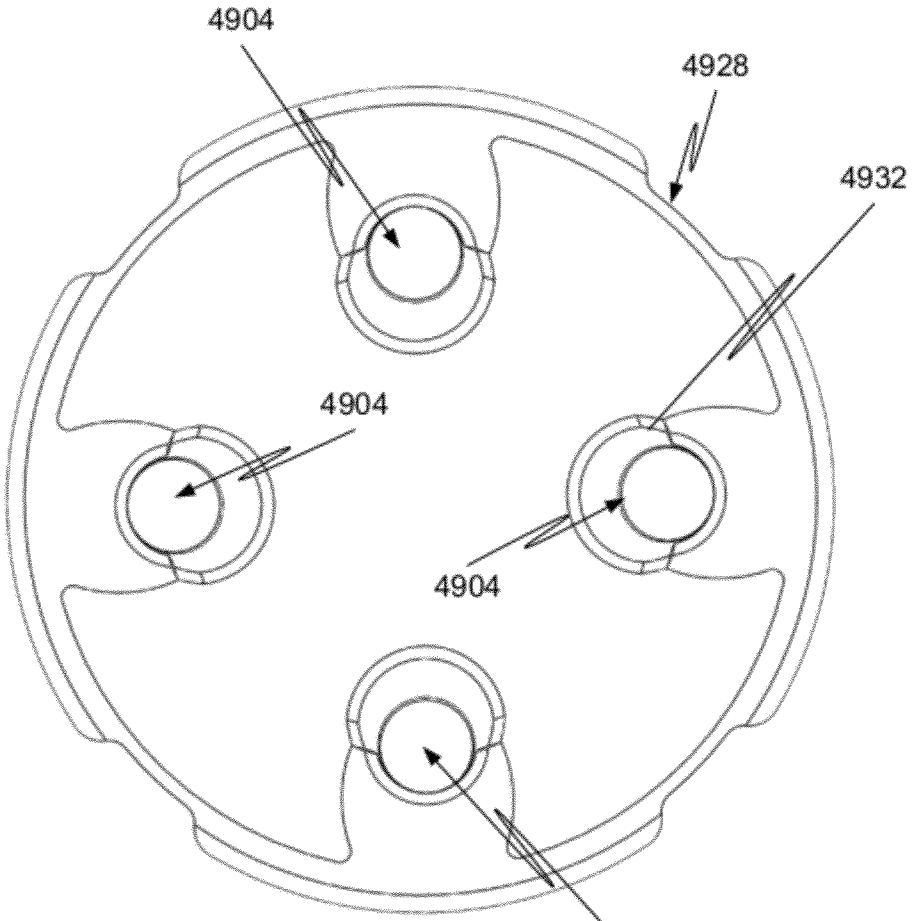
FIG. 50C is a top elevational view of an embodiment described herein.

FIGS. 49A-B depict yet another container 49 in accordance with at least some embodiments of the present disclosure. The container 49 may be similar or identical to the jug 1700. However, as can be seen in FIGS. 50A-C, the pressure equalizer 4900 designed for the container 49 may be specifically designed to conform to the inner surfaces of the container 49. More specifically, the container 49 may comprise a plurality of internal depressions or features along its bottleneck. In some embodiments, the pressure equalizer 4900 may comprise a number of exteranal features cut into the tops/outer surface(s) of the air tubes 4904. As a non-limiting example, for conforming with the interior of the container 49, the pressure equalizer 4900 may comprise a first tapered section 4908 just below the top surface of the pressure equalizer 4900. Below the first tapered section 4908 there may be a first outer surface 4912 that partially cut into the air tubes 4904. The first outer surface 3912 may comprise a first diameter that conforms with an upper-most diameter of the bottleneck in container 49.

A first transition feature 4916 may be provided that separates the first outer surface 4912 from a second outer surface 4920. In some embodiments, the first transition feature 4916 comprises a stair-step feature and the second outer surface 4920 comprises a second diameter that is larger than the first diameter of the first outer surface 4912. Furthermore, the second diameter may conform with a second diameter of the bottleneck in container 49. It should be appreciated that the container 49 comprises additional internal features, the outer surface of the pressure equalizer 4900 may be cut, molded, or otherwise manufactured to conform therewith.

In some embodiments, the pressure may further comprise a rim 4924 that locks into a notch established in the interior of the container 49. The rim 4924 may further comprise one or more notches 4928 if the internal nature of the container 49 requires such a feature to conform therewith. Other features may be incorporated into the exterior of the pressure equalizer 4900 depending upon the type of container or bottle into which pressure equalizer 4900 is inserted.

Another aspect of the present disclosure will now be discussed in connection with FIGS. 50A-B. In some embodiments, the pressure equalizer 4900 may be compressed or squeezed by forces applied on its outersurface such that the diameter of the pressure equalizer 4900 at any circumference is reduced. In particular, FIG. 50A shows the pressure equalizer 4900 in a first state or pinched state. FIG. 50B shows the pressure equalizer 4900 in a second state or un-pinched state. By providing the pressure equalizer 4900 with the ability to temporarily deform under pressure and then return to its original geometry when the pressure is removed, the pressure equalizer 4900 can be more easily inserted into the bottlenecks of various containers or bottles. Furthermore, where a pressure equalizer 4900 is provided with one or more features on its outer surface, it is advantageous to pinch the pressure equalizer 4900 and then insert the pressure equalizer 4900 into the container 49. Once inserted, the pressure equalizer 4900 can be released, thereby allowing the pressure equalizer 4900 to return to its initial geometry and recess itself into the depressions/features within the inside of the container 49.

In some embodiments it may be desirable to provide a pressure equalizer 4900 that is constructed of a material that is capable of deforming elastically under compression or tension such that its largest external feature can fit within the smallest internal feature of the container's 49 bottleneck. More specifically, the pressure equalizer 4900 may be at least partially constructed of a polymer such as plastic, rubber, and the like. Even more specifically, the pressure equalizer 4900 may be constructed of any recyclable material and the type of material selected for manufacturing the pressure equalizer 4900 may be based on the material(s) used to construct the container/bottle. In some embodiments, the material used for the pressure equalizer 4900 may correspond to the same material used to make the container 49. More specific examples of materials that may be used to construct the pressure equalizer 4900 and other pressure equalizers described herein include, without limitation, polyethylene (high-density and low-density), polyethylene terephthalate (PET), polypropylene, polystyrene, polyvinyl chloride (PVC), polytetrafluoroethylene (PTFE), polycarbonate (PC), epoxy, polyamide (PA) or nylon, rubber, synthetic rubber, cellulose-based plastics, glass, or combinations thereof.

Another aspect of the present disclosure will now be discussed in connection with FIGS. 51A-52B. In particular, a modified container 51 is depicted having a pressure equalizer 5100 integrated thereto. Details of the pressure equalizer 5100 are depicted in FIGS. 52A and 52B.

In some embodiments, the container 51 comprises a neck and shoulder as in prior art containers, except that a portion of the neck is removed and the pressure equalizer 5100 is mounted to the remaining lower portion of the container 51. By removing a portion of the neck, the amount of material required to produce the container 51 can be reduced. Furthermore, the most common point of failure in containers is the neck portion. By removing a portion of the neck, the strength of the container 51 (e.g., as measured by withstanding compression forces applied at the top of the container 51) is greatly increased, thereby enabling thinner sidewalls and further reducing the amount of material required to manufacture the container 51.

It should be appreciated that any of the pressure equalizers described herein may be used to greatly decrease the amount of material required to manufacture the container as a whole. In particular, while additional materials may be needed to construct the various component parts of the pressure equalizer, those additional materials are more than offset by the amount of material savings that can be realized for the container as a whole, thereby reducing the overall amount of material used to manufacture a container.

Indeed, even without using pressure equalizers as described herein, wall thickness and other innovations have reduced weight and plastic (particularly PET) consumption, creating 500 ml bottles that weigh as little as 9.2 grams and have and interior bottleneck diameter of approximately 21.8 mm. In accordance with at least some embodiments of the present disclosure, however, a pressure equalizer can be used to further reduce the amount of material required to produce a 500 ml bottle made from PET (or a similar plastic/resin). As one non-limiting example, by implementing a pressure equalizer as described herein, the bottleneck diameter may be reduced to approximately 11.5 mm and the undesirable glugging can be avoided. Furthermore, by employing a pressure equalizer as described herein, the overall weight of a 500 ml bottle made from PET can be reduced by approximately 8.5 to 14.5 percent (e.g., have a weight of approximately 8.42 grams to approximately 7.87 grams). Indeed, a 500 ml bottle can be achieved with significantly less material, even though more material is included at the bottleneck vis-à-vis the pressure equalizer. These material savings result in substantial savings to bottle manufacturers and manufacturers of other types of containers. Meanwhile, the container now has the ability to pour liquids accurately and without glug, whereas if a container were manufactured with the smaller bottleneck of approximately 11.5 mm without a pressure equalizer, it would take significantly longer for fluid to pour from the container.

One or more of the pressure equalizer designs described herein may be capable of reducing material requirements by up to 20 percent as compared to the most aggressive current container designs. In particular, certain embodiments of a pressure equalizer described herein have been shown to achieve 500 ml containers that are 20 percent lighter than current state-of-the-art 500 ml containers manufactured with similar materials. As material costs continue to increase, any amount of material savings without negatively impacting the container's performance is seen as a monumental step forward.

Another advantage is that a smaller diameter bottleneck or opening may be employed even when the container has hard or rigid sidewalls along its body. In other words, the pressure equalizer may allow liquids (even highly viscous ones) to exit the container through a smaller opening without requiring the sidewalls to be highly deformable. This essentially means that structural integrity of the container can be maintained while simultaneously decreasing the diameter of the bottleneck/opening.

Figure 51B:
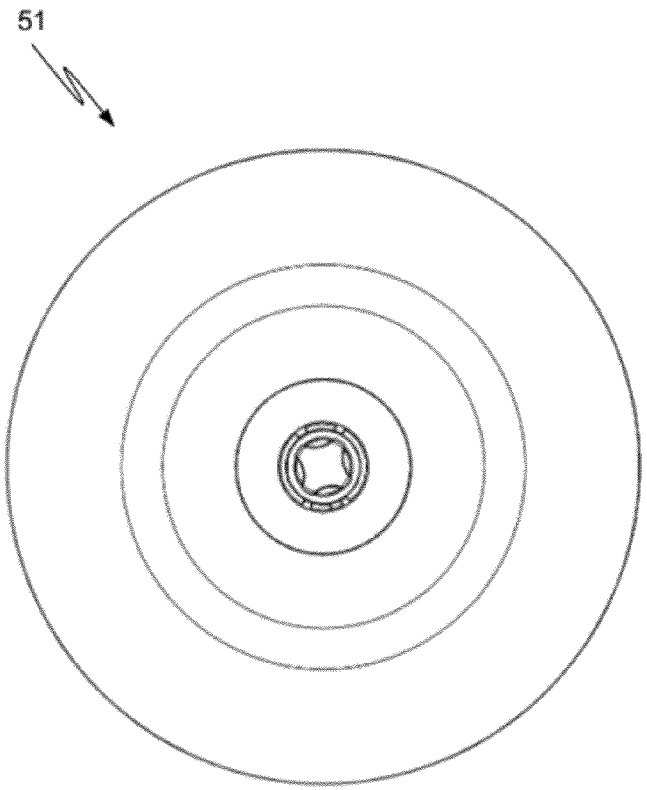
FIG. 51B is a top perspective view of the container depicted in FIG. 51A.
Figure 51A:
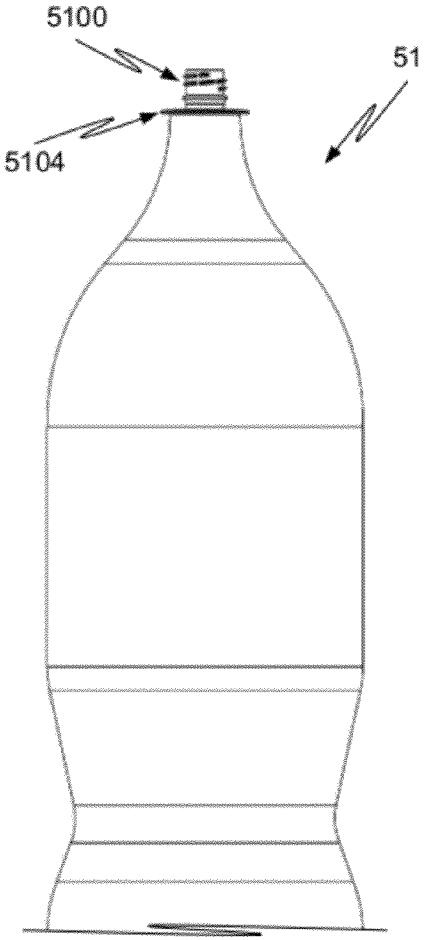
FIG. 51A is a front elevational view of a container according to embodiments described herein.
Figure 52B:
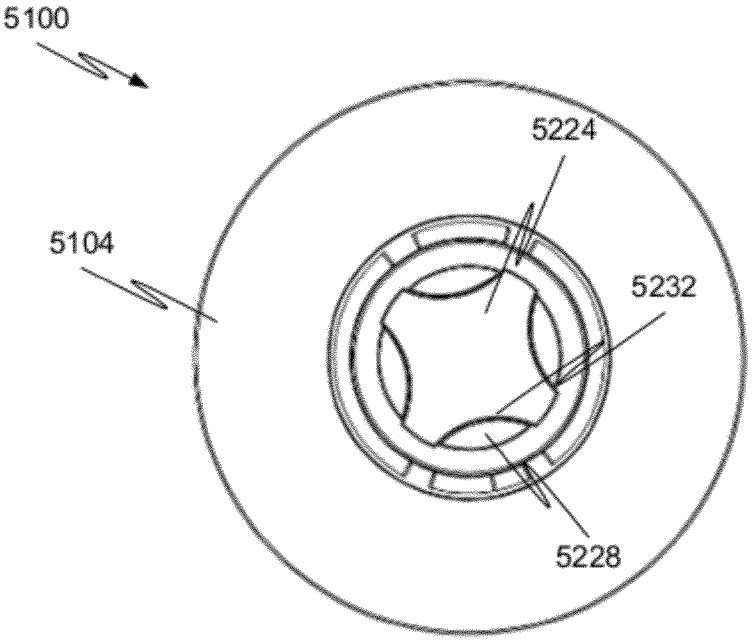
FIG. 52B is a top perspective view of an embodiment described herein.
Figure 52A:
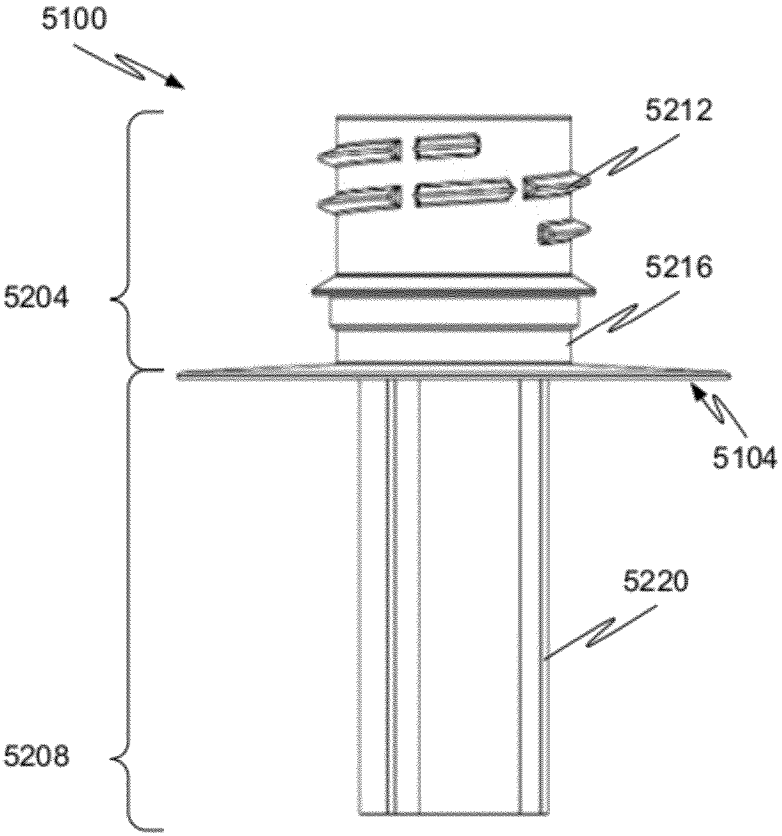
FIG. 52A is a side elevational view of an embodiment described herein.
Figure 53B:
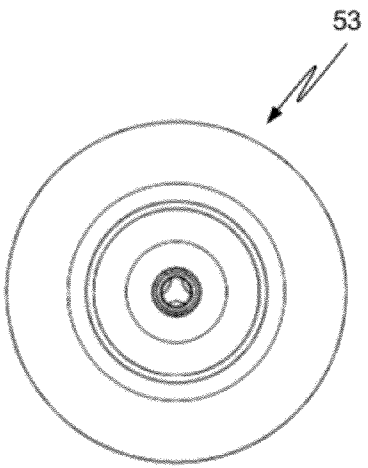
FIG. 53B is a top perspective view of the container depicted in FIG. 53A.
Figure 53A:
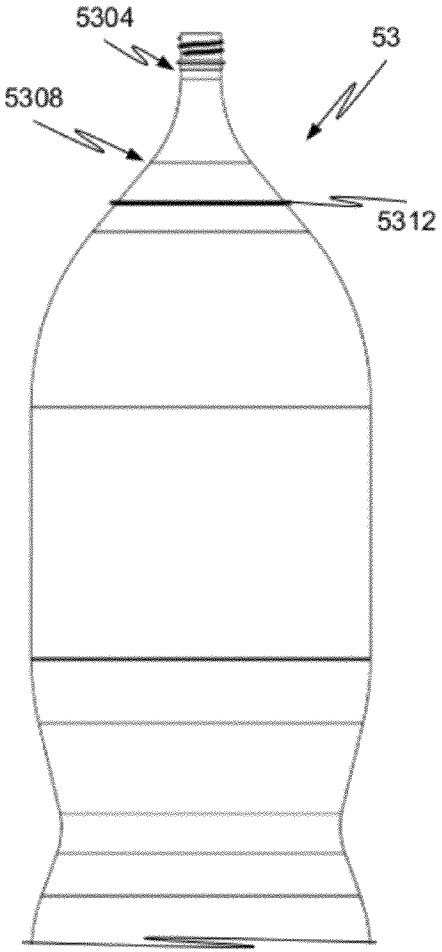
FIG. 53A is a side elevational view of a container according to embodiments described herein.

As can be seen in FIG. 51A, the pressure equalizer 5100 may comprise a flange 5104. The flange 5104 may be used as the point of connection between the pressure equalizer 5100 and the rest of the container 51. In some embodiments, the pressure equalizer 5100 may be produced in one manufacturing step and the body and neck of the container 51 may be produced in a separate manufacturing step. The flange 5104 provides the point of contact between the pressure equalizer 5100 and the container 51 and may be the point where the pressure equalizer 5100 is connected to the container 51 (e.g., via ultrasonic welding, heat-based welding, radio frequency welding, gluing, or the like).

In some embodiments, the pressure equalizer 5100 and its component parts may be constructed of a material that is similar or identical to the material used to construct the container 51. The component parts of the pressure equalizer 5100, in some embodiments, may include the flange 5104 that separates an upper portion 5204 from a lower portion 5208 of the pressure equalizer 5100. The upper portion may include threads 5212 and a neck 5216 that is positioned between the flange 5104 and a cap stop. As with other pressure equalizers discussed herein, the pressure equalizer 5100 may also comprise a number of air tubes 5220 that extend from the top of the opening of the pressure equalizer 5100 through the top portion 5204 and the bottom portion 5208. The air tubes 5220 may be constructed by sidewalls 5232 that separate the main outlet 5224 from the air inlet portions 5228. In some embodiments, the tubes 5220 may be constructed of extruded plastic tubes that are cut to dimension and then attached to the inner walls of the pressure equalizer 5100. Such a manufacturing process enables a quicker and more cost-effective option for producing the finished container 51. Specifically, the body of the container 51 can be manufactured via known methods and the pressure equalizer 5100 may be attached to the shoulder of the container 51 in a separate manufacturing step.

In some embodiments, the diameter of the flange 5104 can be larger than the diameter of the shoulder of the container 51 to which the flange 5104 is attached. By providing a larger flange 5104, the manufacturing process can be completed with more flexibility. In particular, there can be some room for error in the placement of the pressure equalizer 5100 relative to the shoulder of the container 51. This makes the manufacturing process both faster and more cost-effective.

With reference now to FIGS. 53A-55B, another container 53 will be described in accordance with embodiments of the present disclosure. The container 53 may be constructed similarly to the container 51 in that the portion of the container 53 above its shoulders (e.g., the pressure equalizer 5304) can be manufactured in a separate manufacturing process from the portion of the container 53 below its shoulders (e.g., the body portion 55).

Figure 54B:
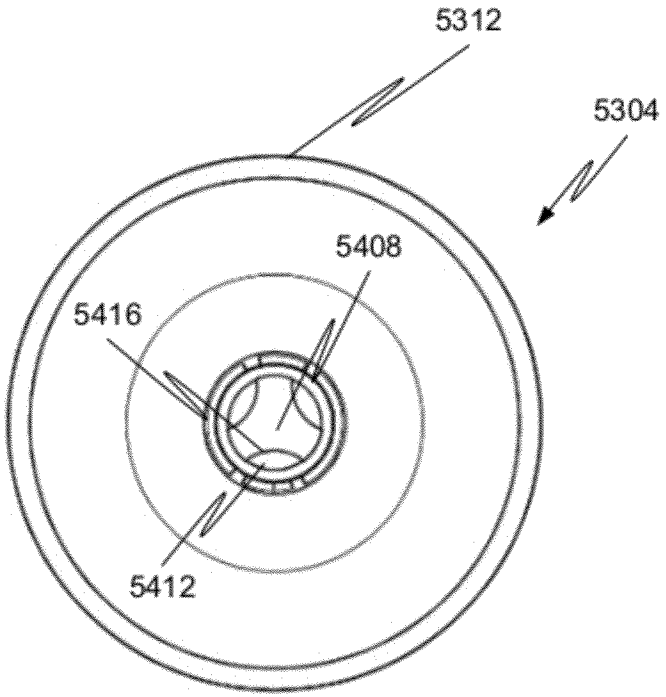
FIG. 54B is a top perspective view of an embodiment described herein.
Figure 54A:
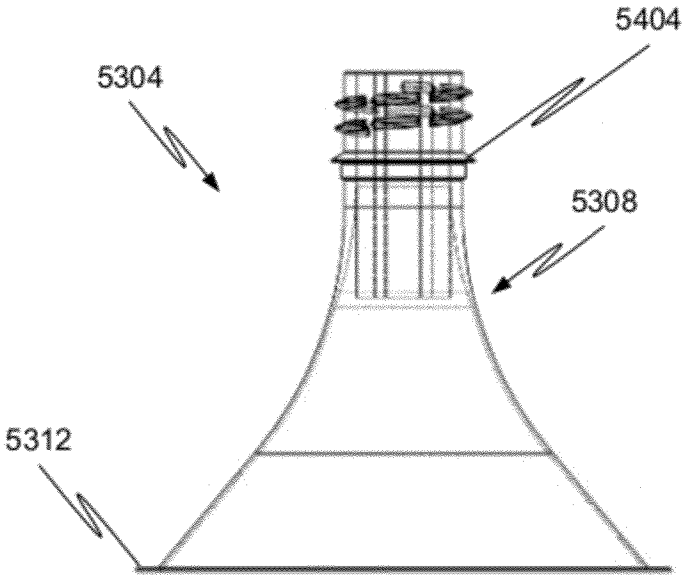
FIG. 54A is a side elevational view of an embodiment described herein.

The embodiment of the container 53 differs from container 51 in that the pressure equalizer 5304 comprises a shoulder and neck portion 5308 that is skinnier (e.g., of a smaller diameter) than the shoulder and neck portion of a traditional container. Furthermore, the entirety of the pressure equalizer 5304 is above its flange 5312. As can be seen in FIGS. 54A and 54B, the pressure equalizer 5304 may comprise a cap stopper 5404 below the threading and the shoulder and neck portion 5308. The taper of the shoulder and neck portion 5308 is greater than the taper of a shoulder and neck portion of a traditional two liter bottle. Accordingly, the diameter of the container 53 is the same at the flange 5312, but the diameter of the opening of the pressure equalizer 5304 is significantly less than a diameter of the opening in a traditional two liter bottle. In some embodiments, the diameter of the opening of the pressure equalizer 5304 is around about 10.5 mm (inner diameter of opening). Most traditional two liter bottles have an opening diameter of about 22.23 mm (inner diameter of opening). Accordingly, the pressure equalizer 5304 enables a diameter of less than half of traditional bottles, while also allowing liquids to pour through smoothly and without "glug."

In some embodiments, the pressure equalizer 5304 comprises an opening diameter of about 10.5 mm and can accommodate the smooth (e.g., without "glug") pouring of many types of liquids having various viscosities. As some non-limiting examples, the container 53 can hold liquids having a viscosity approximately equal to water at approximately similar temperatures. Even more specifically, the pressure equalizer 5304 enables the smooth pouring of liquids having a dynamic viscosity of approximately 1000 Centipoise at 20 degrees Celsius. Fluids having viscosities greater than water at room temperature (e.g., similar to molasses or oil at room temperature) may also be poured out of the container 53 through the pressure equalizer 5304 without glugging. By providing a container 53 with a smaller opening, the accuracy with which fluid is poured out of the container 53 can be greatly increased. Simultaneously, the material costs for the container 53 can be reduced because the overall amount of material required to produce the container 53 is also reduced. Further still, it is possible to achieve a container 53 with a smaller opening that does not have deformable walls. Rather, a typical bottle or container having substantially non-deformable body walls (e.g., body sidewalls that are not designed to be deformed or otherwise squeezed so as to completely depress the body of the container). In particular, the container 53 may be manufactured from a semi-crystalline PET and may have a density as described in U.S. Patent Publication No. 2007/0108156, the entire contents of which are hereby incorporated herein by reference.

Referring back to FIGS. 54A and 54B, the component parts of the pressure equalizer 5304 may further include a main outlet port 5408, one or more air inlets 5412, and one or more dividing walls 5416 that separate the air inlets 5412 from the main outlet port 5408. Similar to the pressure equalizer 5100 and other pressure equalizers discussed herein, the number of air inlets 5412 can vary without departing from the scope of the present disclosure.

Figure 55B:
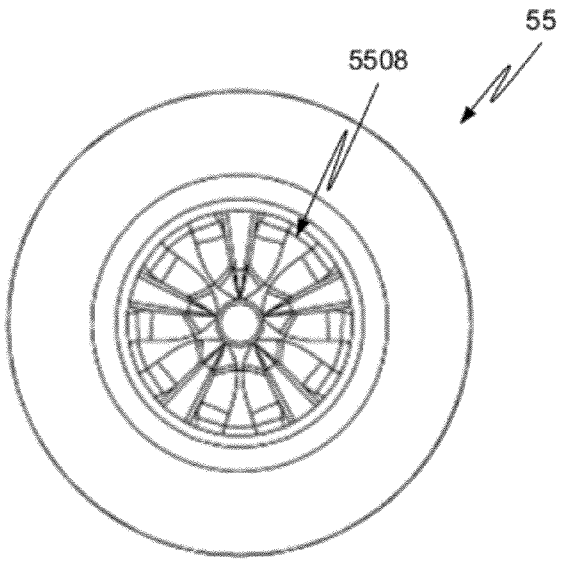
FIG. 55B is a top perspective view of an embodiment described herein.
Figure 55A:
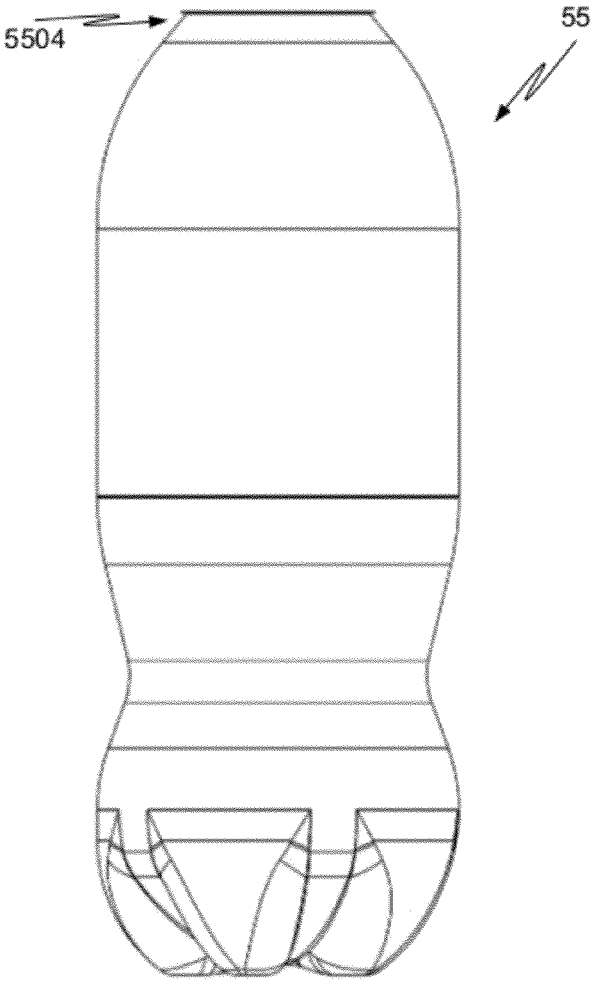
FIG. 55A is a side elevational view of an embodiment described herein.

FIGS. 55A and 55B show an intermediate container 55 before the pressure equalizer 5304 is attached thereto. The intermediate container 55 may be similar to traditional containers except that it is cut off at its neck/shoulders. A lip or flange 5504 may be established at the top of the intermediate container 55 and may provide a surface that can be attached to the pressure equalizer 5304 (e.g., via ultrasonic welding). The size of the opening 5508 of the intermediate container 55 may be the same size as the inner diameter of the pressure equalizer 5304 at its flange 5312, but the outer diameter of the flange 5312 may be larger than the outer diameter of the lip or flange 5504. The difference in the out diameters of the flanges may facilitate easier attachment of the pressure equalizer 5304 to the intermediate container 55.

Figure 56C:
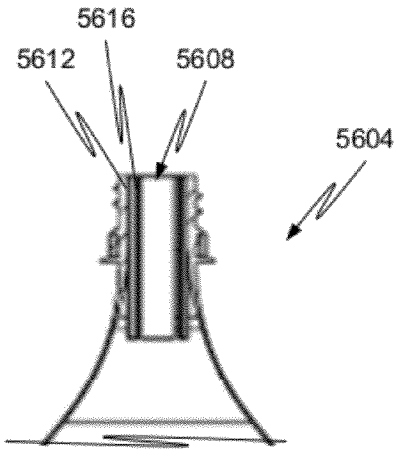
FIG. 56C is a cross-sectional view of the container taken along line 56C as shown in FIG. 56B.
Figure 56B:
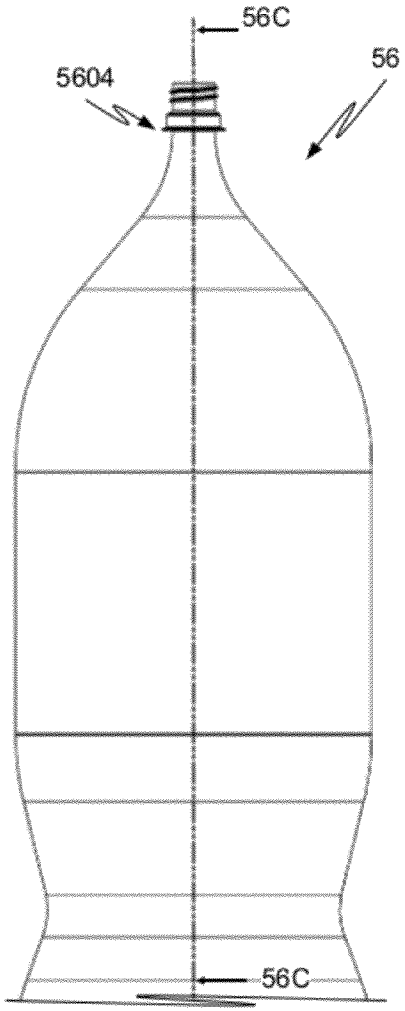
FIG. 56B is a side elevational view of the container depicted in FIG. 56A.
Figure 56A:
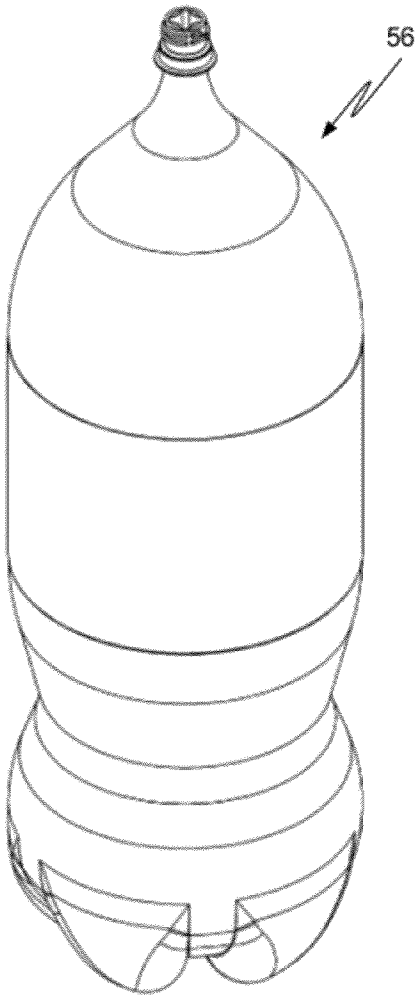
FIG. 56A is a isometric view of a container according to embodiments described herein.

With reference now to FIGS. 56A and 56B, yet another container 56 will be described in accordance with embodiments of the present disclosure. The container 56 may comprise similar characteristics to container 53, except that the pressure equalizer 5604 may be integrated into the body of the container rather than being produced in a separate manufacturing step. Accordingly, the pressure equalizer 5604 may comprise similar components to the pressure equalizer 5304 (e.g., a main outlet port 5608, one or more air inlets 5612, and one or more dividing walls 5616 that separate the air inlets 5612 from the main outlet port 5608). However, the pressure equalizer 5604 may not comprise a flange or any other feature for connecting to the body of the container 56. Rather, the container 56 may be produced as a single integrated product and the sidewalls 5616 (e.g., features that create the air inlets 5612) may be added to the container 56 after the container has been created. In some embodiments, the air inlets 5612 (and specifically the materials of the dividing walls 5616) may be cut to the appropriate dimension and inserted in the opening of the container 56 (either before or after the container has been filled with a liquid). The cut portions of material may then be ultrasonically welded or otherwise attached to the inner surface of the bottleneck.

Figure 57B:
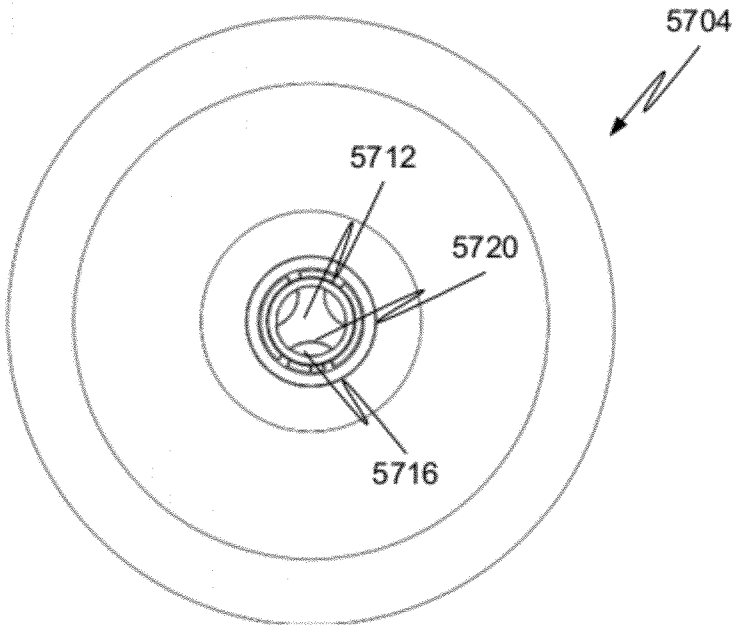
FIG. 57B is a top perspective view of an embodiment described herein.
Figure 57A:
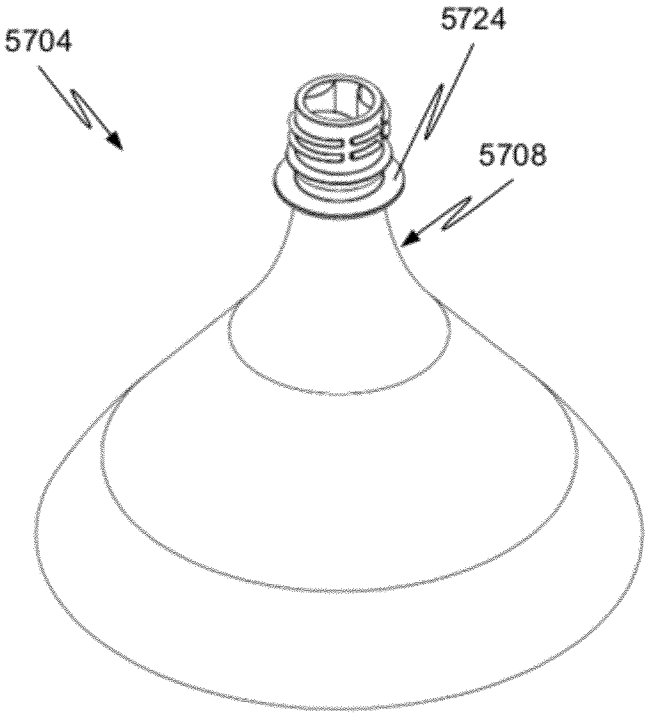
FIG. 57A is an isometric view of an embodiment described herein.

FIGS. 57A and 57B show yet another pressure equalizer 5704 in accordance with embodiments of the present disclosure. The pressure equalizer 5704 is similar to the pressure equalizer 5304 except that the pressure equalizer 5704 doesn't have a flange 5312. The pressure equalizer 5704 is also similar to the pressure equalizer 5604 except that the pressure equalizer 5704 is attached to the body of a container in a separate manufacturing step. Accordingly, the component parts of the pressure equalizer 5704 may be similar or identical to the component parts of the pressure equalizer 5604 and may include a neck and shoulder 5708, a main outlet 5712, one or more air inlets 5716, one or more dividing walls 5720, and a cap stopper 5724. As with other pressure equalizers discussed herein, the material with which the pressure equalizer 5704 is manufactured may include any type of known plastic, glass, synthetic, or the like.

Figure 58B:
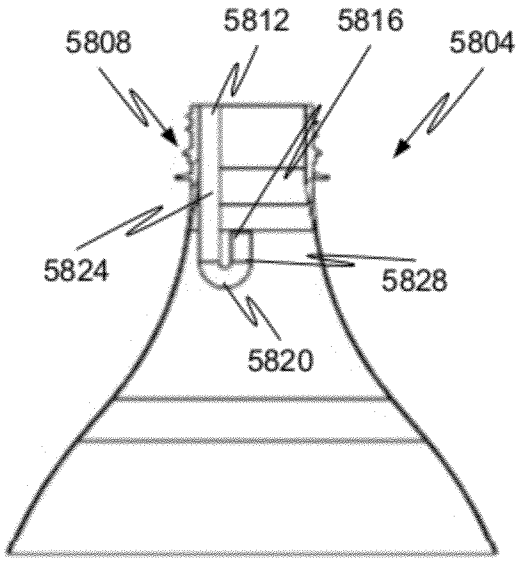
FIG. 58B is a cross-sectional view taken along line 58B as shown in FIG. 58A.
Figure 58A:
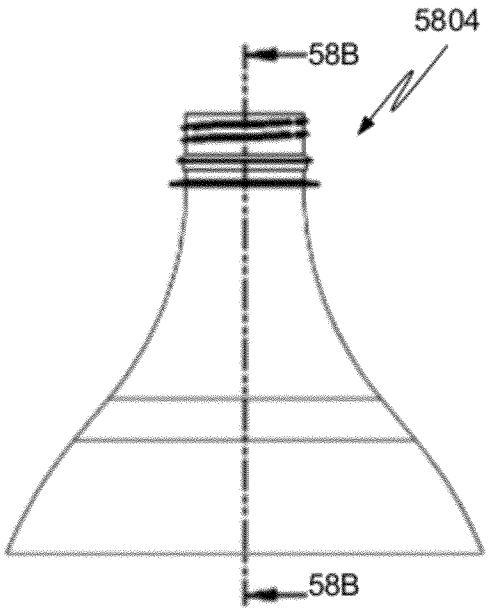
FIG. 58A is a side elevational view of an embodiment described herein.

FIGS. 58A thru 61B depict other possible configurations of the inlet tubes that may be used to further enhance the effectiveness of any pressure equalizer described herein. Referring initially to FIGS. 58A and 58B, a pressure equalizer 5804 is shown to include an air inlet 5808 that extends the path that fluid within the container would have to travel before arriving at the opening 5812. By extending the flow path within the air inlet 5808, the air inlet 5808 makes it more likely that air will flow from opening 5812 to opening 5816 rather than having fluid within the container flow from opening 5816 to opening 5812.

In some embodiments, the air inlet 5808 comprises a first opening 5812 proximate to the opening of the container and a second opening 5816 that is within the neck or shoulder of the container. A first bend 5820 may be positioned between the first opening 5812 and second opening 5816. A first portion 5824 of the air inlet 5808 may be positioned between the first opening 5812 and first bend 5820 while a second portion 5828 of the air inlet 5808 may be positioned between the second opening 5816 and the first bend 5820. The length of the first portion 5824 may be greater than the length of the second portion 5828. Furthermore, the diameters and/or profiles of the first opening 5812 and second opening 5816 do not necessarily have to be the same. Rather, the first opening 5812 may be larger in diameter than the second opening 5816 or vice versa. Likewise, the shape of the first opening 5812 does not necessarily have to be the same as the shape of the second opening 5816.

Figure 59B:
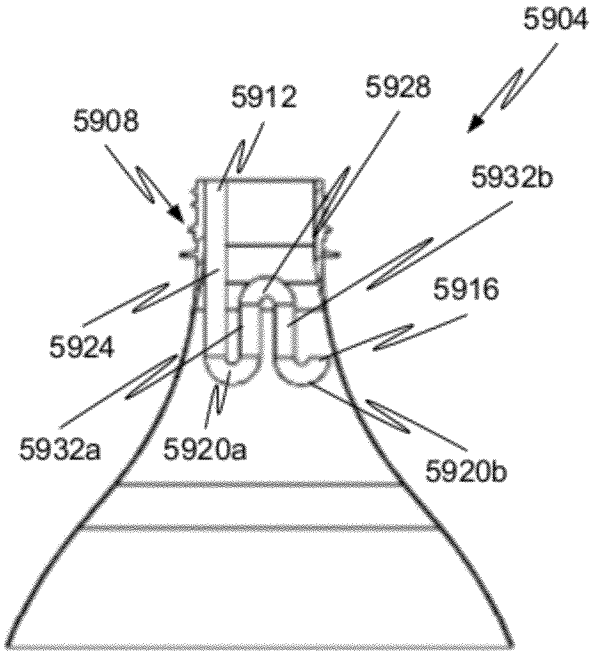
FIG. 59B is a cross-sectional view taken along line 59B as shown in FIG. 59A.
Figure 59A:
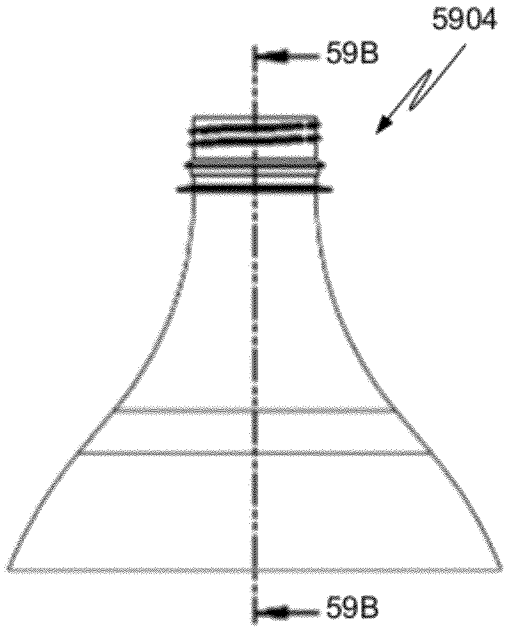
FIG. 59A is a side elevational view of an embodiment described herein.

The pressure equalizer 5904 in FIGS. 59A and 59B comprises an air inlet 5908 that is slightly different from air inlet 5808. Specifically, the air inlet 5908 comprises multiple bends including a first and second upward bend 5920*a*, 5920*b* as well as a downward bend 5928. A first portion 5924 of the air inlet 5908 may reside between the first opening 5912 and the first upward bend 5920*a*. A second portion 5932*a* of the air inlet 5908 may reside between the first upward bend 5920*a* and the downward bend 5928. A third portion 5932*b* of the air inlet 5908 may reside between the downward bend 5928 and the second upward bend 5920*b*. The multiple bends between the first opening 5912 and the second opening 5916 may further increase the path that fluid would have to flow through the air inlet 5908. Therefore, the fluid pouring out of the container having the pressure equalizer 5904 will naturally select the main outlet of the container rather than coming out of the air inlet 5908.

It should be appreciated that the number of bends in the air inlet 5908 may be greater or lesser than the number of bends shown in FIGS. 59A and 59B. Specifically, the air inlet 5908 may comprise one, two, three, four, five, six, or more bends without departing from the scope of the present disclosure. Further still, the bends do not necessarily have to be 180 degree bends, but rather can be bends of any amount. In some embodiments, the bends may be 90 degree bends and the direction in which the second opening faces is orthogonal to the direction in which the first opening faces. Any other variations of the air inlets may also be performed in accordance with embodiments of the present disclosure.

Figure 60B:
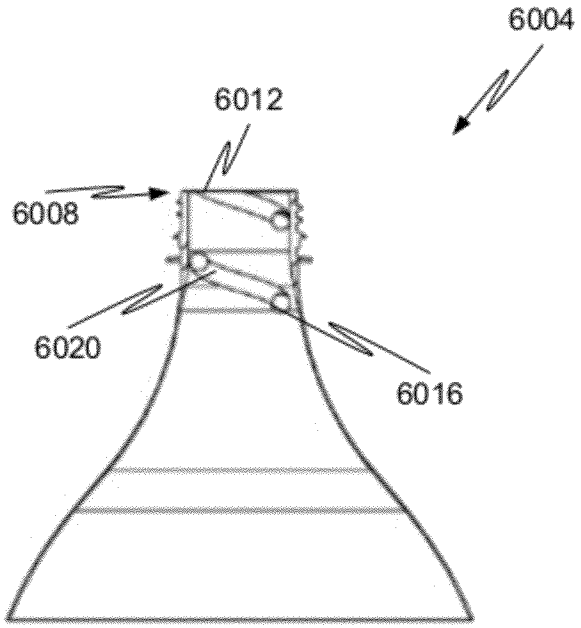
FIG. 60B is a cross-sectional view taken along line 60B as shown in FIG. 60A.
Figure 60A:
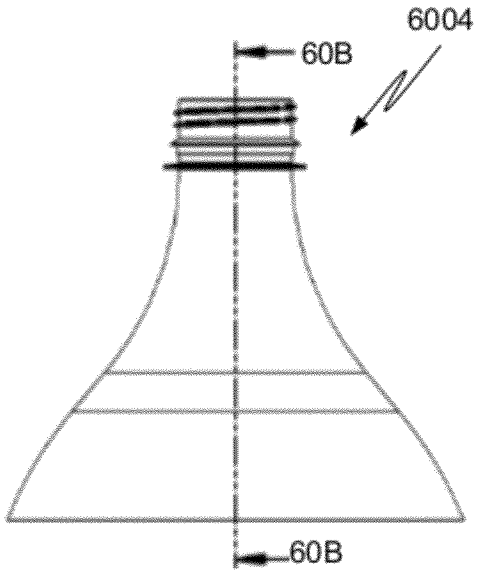
FIG. 60A is a side elevational view of an embodiment described herein.

Referring now to FIGS. 60A and 60B, yet another type of pressure equalizer 6004 comprising yet another type of air inlet 6008 is shown in accordance with embodiments of the present disclosure. The air inlet 6008 may comprise a helical shape and contours or follows the inner diameter of the bottleneck. Similar to other air inlets, the air inlet 6008 may comprise a first opening 6012 and a second opening 6016 with a helical portion 6020 there between. The helical portion 6020 of the air inlet 6008 may be integrated into the pressure equalizer 6004 or it may be manufactured separately and connected to the inside wall of the bottleneck in a separate manufacturing step (e.g., via ultrasonic welding). In some embodiments, the helical portion 6020 may be attached continuously to the inside wall of the bottleneck. In other embodiments, the helical portion 6020 may be spot welded at discrete points to the inside wall of the bottleneck.

Figure 61B:
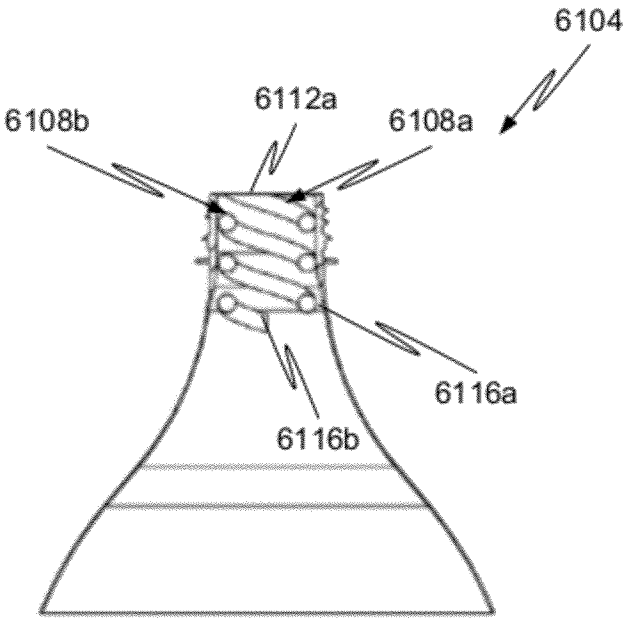
FIG. 61B is a cross-sectional view taken along line 61B as shown in FIG. 61A.
Figure 61A:
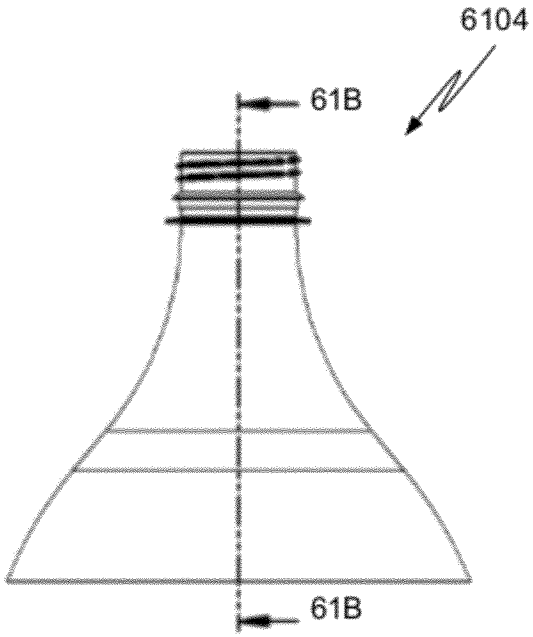
FIG. 61A is a side elevational view of an embodiment described herein.

FIGS. 61A and 61B show still another type of pressure equalizer 6104 having multiple air inlets 6108*a*, 6108*b*. Each of the air inlets 6108*a*, 6108*b* may comprise helical portions that wrap around the inner wall of the bottleneck. Each air inlet 6108*a*, 6108*b* may also comprise first opening 6112*a*, 6112*b* and a second opening 6116*a*, 6116*b*. The first openings 6112*a*, 6112*b* may be positioned across from one another (e.g. on opposite sides of the bottle opening) and the helical portions of each air inlet 6108*a*, 6108*b* may fit next to each other as they spiral down the bottleneck. Each air inlet 6108*a*, 6108*b* may be similar or identical to the air inlet 6008. Accordingly, it should be appreciated that a pressure equalizer may be equipped with one, two, three, four, or more similar types of helically-shaped air inlets.

As described herein, any number of manufacturing methods (e.g., fully-automated, partially-automated, manual) may be employed to produce a container having a pressure equalizer. In some embodiments, a manufacturing method may: (1) employ blow molding techniques to blow mold a smaller container top (e.g., having an inner diameter of approximately 11.5 mm); (2) extrude the air inlet(s); and (3) attach the air inlets to the inner sidewalls of the bottleneck using one or more of (friction welding, ultrasonic welding, radio frequency welding, heat welding, gluing, or the like).

As noted above, it is also possible to create a pressure equalizer that leaves the support ledge and throat of the bottle the same size. To do this, the entire top of the pre-formed container goes away, right down to the support ledge. The pressure equalizer is then produced that includes the spout, air tubes, an appropriately-sized cap and a break-band to indicate that the cap has not been removed. The pressure equalizer may then be attached (e.g., welded and/or glued) to the top of the pre-formed container.

As discussed above, it may also be possible to extrude the air tubes and create a variety of snap-in systems, where each air tube is separately snapped into features within the spout. Alternatively, or in addition, a complete pressure equalizer may be provided with snaps or other friction fitting elements to snap the pressure equalizer into place relative to the body of the container.

Another advantage contemplated herein is the ability to employ bottle stacking. Specifically, since the bottle cap size is reduced (e.g., due to the reduction in the diameter of the bottle top), the top of one bottle or container may be sized to fit into the bottom of another bottle.

It should be appreciated that any number of materials may be used to manufacture the pressure equalizers described herein. For example, metal, metal alloys, non-metal alloys, ceramics, plastics, glass, and other materials used for the construction of container may be used for the pressure equalizers without departing from the scope of the present disclosure.

In at least one embodiment of the various pressure described herein, the top rim of the one or more air tubes associated with the pressure equalizer do not extend above the bottle rim 136 of the bottle 100. Advantageously, a cap associated with the bottle can be reused with the pressure equalizer in the bottle 100.

Air tubes described herein preferably include solid, non-perforated tubing walls. That is, there are no holes along the side walls of the air tubes between the upper inlet rims 408 and the lower end edges 412 of the air tubes. In at least one embodiment of all of the various pressure equalizers described herein, there are no holes along the side walls of the air tubes between the upper inlet rims 408 and the lower end edges 412 of the air tubes. In at least one embodiment of all of the various pressure equalizers described herein, and as someone of ordinary skill in the art would appreciate, if present, any holes within the sidewalls of the air tubes preferably do not materially impact the flow characteristics of the subject pressure equalizer.

In at least one embodiment of the various pressure equalizers described herein, the lower end edges of the air tubes do not extend below about 25% of the bottle length $B_L$.

In at least one embodiment of the various pressure described herein, at least a portion of the upper inlet rim 408 of at least one air tube is situated within a rim proximity distance that is less than or equal to 5% of the bottleneck length $L_{Bottleneck}$.

In at least one embodiment of the various pressure equalizers described herein, even if having a non-circular cross-sectional shape, the air tubes preferably include a diameter or equivalent diameter (by measuring the cross-sectional area of the air tube and solving for an equivalent diameter) that resides within a range of about 2% to 50% of the bottleneck diameter $D_{Bottleneck}$. In addition, the air tube length $L_{Air\ Tube}$ of the air tubes is greater than or equal to the bottleneck length $L_{Bottleneck}$ and less than or equal to about 25% of the bottle length $B_L$(that is, $L_{Bottleneck} \leq L_{Air\ Tube} \leq 25\%\ B_L$).

The present disclosure may be embodied in other specific forms without departing from its spirit or essential characteristics. The described embodiments are to be considered in all respects only as illustrative and not restrictive. The scope of the disclosure is, therefore, indicated by the appended claims rather than by the foregoing description. All changes which come within the meaning and range of equivalency of the claims are to be embraced within their scope.

The one or more present disclosures, in various embodiments, include components, methods, processes, systems and/or apparatus substantially as depicted and described herein, including various embodiments, subcombinations, and subsets thereof. Those of skill in the art will understand how to make and use the present disclosure after understanding the present disclosure.

The present disclosure, in various embodiments, includes providing devices and processes in the absence of items not depicted and/or described herein or in various embodiments hereof, including in the absence of such items as may have been used in previous devices or processes (e.g., for improving performance, achieving ease and/or reducing cost of implementation).

The foregoing discussion of the disclosure has been presented for purposes of illustration and description. The foregoing is not intended to limit the disclosure to the form or forms disclosed herein. In the foregoing Detailed Description for example, various features of the disclosure are grouped together in one or more embodiments for the purpose of streamlining the disclosure. This method of disclosure is not to be interpreted as reflecting an intention that the claimed disclosure requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the disclosure.

Moreover, though the description of the disclosure has included description of one or more embodiments and certain variations and modifications, other variations and modifications are within the scope of the disclosure (e.g., as may be within the skill and knowledge of those in the art, after understanding the present disclosure). It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A container, comprising:

a main body portion configured to contain a liquid;

a container opening which provides a point of exit for liquid contained in the main body portion;

a bottleneck between the container opening and the main body portion, the bottleneck comprising a cross-sectional area that is smaller than a cross-sectional area of the main body portion; and a pressure equalizer having at least one air inlet and being positioned in the bottleneck, the pressure equalizer enabling the liquid to exit the container opening and simultaneously enabling air to enter the main body portion through the at least one air inlet such that the flow of the liquid from the main body portion is substantially continuous such that the liquid, when poured at any container angle, exits the container opening smoothly and without glugging, wherein the container opening comprises a diameter of less than about 15 mm.

2. The container of claim 1, wherein the liquid comprises a viscosity that is greater than or equal to a viscosity of water at room temperature.

3. The container of claim 2, wherein the diameter of the container opening is less than about 11 mm.

4. The container of claim 2, wherein the diameter of the container opening is less than about 10.5 mm.

5. The container of claim 1, wherein a viscosity of the liquid is greater than a viscosity of oil at room temperature.

6. The container of claim 5, wherein the oil is motor oil.

7. The container of claim 5, wherein the diameter of the container opening is less than about 10.5 mm.

8. The container of claim 1, wherein the pressure equalizer is modular.

9. The container of claim 8, wherein the modular pressure equalizer is ultrasonically welded to the bottleneck.

10. The container of claim 1, wherein the bottleneck is incorporated into the pressure equalizer, wherein the pressure equalizer comprises a flange, and wherein the flange of the pressure equalizer is ultrasonically welded to the main body portion.

11. The container of claim 1, wherein the main body portion is made of a semi-crystalline PET and wherein the ratio weight of the walls on weight of the bottom is between about 3.4 and 3.8.

12. The container of claim 1, wherein the pressure equalizer comprises a cap stopper and threading positioned above the cap stopper.

13. The container of claim 1, wherein the main body portion and container bottleneck are configured to contain approximately 500 ml of the liquid.

14. The container of claim 13, wherein the main body portion, the bottleneck, and the pressure equalizer are made of a semi-crystalline PET and wherein the main body portion, and the bottleneck comprise a collective weight of no more than 8.42 grams.

15. The container of claim 14, wherein the main body portion, and the bottleneck comprise a collective weight of no more than 7.87 grams.

16. The container of claim 1, wherein the at least one air inlet is constructed of an extruded plastic tube.

* * * * *